US007166330B2

(12) United States Patent
Takahashi et al.

(10) Patent No.: US 7,166,330 B2
(45) Date of Patent: Jan. 23, 2007

(54) METHOD FOR FORMING A GLITTERING COATING FILM

(75) Inventors: Masashi Takahashi, Tokyo (JP); Taizo Nanke, Osaka (JP); Katsumi Kunugi, Tokyo (JP); Mitsuo Kamisato, Tokyo (JP); Takahiko Hamada, Aichi (JP); Masamichi Arima, Tokyo (JP); Hideo Ishibashi, Osaka (JP); Ayako Iwakoshi, Osaka (JP); Toshikatsu Kobayashi, Osaka (JP)

(73) Assignee: Nippon Paint Co., Ltd., Osaka (JP)

( * ) Notice: Subject to any disclaimer, the term of this patent is extended or adjusted under 35 U.S.C. 154(b) by 0 days.

(21) Appl. No.: 11/092,135

(22) Filed: Mar. 29, 2005

(65) Prior Publication Data

US 2006/0057363 A1 Mar. 16, 2006

(30) Foreign Application Priority Data

| | | |
|---|---|---|
| Mar. 29, 2004 | (JP) | 2004-096797 |
| Mar. 29, 2004 | (JP) | 2004-096798 |
| Mar. 29, 2004 | (JP) | 2004-096799 |
| Mar. 29, 2004 | (JP) | 2004-096800 |
| Mar. 29, 2004 | (JP) | 2004-096801 |

(51) Int. Cl.

| | |
|---|---|
| ***B05D 5/00*** | (2006.01) |
| ***B05D 7/16*** | (2006.01) |
| ***B05D 1/02*** | (2006.01) |
| ***B05D 1/38*** | (2006.01) |
| ***B05D 3/00*** | (2006.01) |

(52) U.S. Cl. ..... 427/372.2; 427/384; 427/388.1; 427/407.1; 427/409; 427/419.1; 427/419.2; 427/421.1; 427/427.4; 427/427.5

(58) Field of Classification Search ..... 427/372.2, 427/384, 388.1, 407.1, 409, 419.1, 419.2, 427/421.1, 427.4, 427.5

See application file for complete search history.

(56) References Cited

U.S. PATENT DOCUMENTS 5,266,400 A * 11/1993 Yarusso et al. ..... 428/345
5,972,425 A * 10/1999 Nishi et al. ..... 427/195
6,544,588 B2 * 4/2003 Yamamori et al. ..... 427/261

FOREIGN PATENT DOCUMENTS

| | | |
|---|---|---|
| JP | 11-076800 | 3/1999 |
| JP | 11-80647 | 3/1999 |
| JP | 11-080647 A * | 3/1999 |
| JP | 11-236521 | 8/1999 |
| JP | 11-343431 | 12/1999 |
| JP | 2000-239853 | 9/2000 |
| JP | A-2002-343149 | 11/2002 |
| JP | 2003-103158 | 4/2003 |
| JP | 2003-291255 | 10/2003 |
| JP | 2003-327870 | 11/2003 |
| JP | 2004-075703 | 3/2004 |
| JP | 2004-256915 | 9/2004 |
| JP | 2005-015647 | 1/2005 |
| WO | WO 02/094953 | 11/2002 |
| WO | WO 02/094954 | 11/2002 |

* cited by examiner

*Primary Examiner*—William Phillip Fletcher, III
(74) *Attorney, Agent, or Firm*—Jack Schwartz & Associates

(57) ABSTRACT

A method for forming a glittering coating film in which after a glittering base coating film is formed on a substrate to be coated by applying thereto a glittering base coating material containing a colloid particle liquid containing noble metal or copper colloid particles, the glittering base coating film is heated or set, and then a clear coating film is formed. By the method, a glittering coating film is provided which has weathering resistance and high gloss, and develops a metal feeling or a coloring metal feeling giving rise to a less feeling of metal particles than by the plating-tone coating film, and superior in design property.

19 Claims, No Drawings

METHOD FOR FORMING A GLITTERING COATING FILM

FIELD OF THE INVENTION

The present invention relates to a method for forming a glittering coating film and an object coated by the method.

RELATED ART

In a field requiring design properties of high level, an automobile body and automobile parts such an aluminum wheel, a glittering coating material using, for example, metallic coating material containing aluminum flakes is applied to an object to be coated to thereby develop a metallic tone. Also in a glittering feeling by metallic tone, demand of luxury taste by, for example, plating tone has increased year by year.

For a metallic coating material for forming a metallic coating film having such a luxury taste, a metallic coating material is disclosed which is capable of forming a coating film having an appropriate metal like gloss (Patent document 1). The coating material is a metallic coating material containing bright pigments of metal flakes that are formed by pulverizing a vapor deposition metal film, preferably aluminum flake as bright pigments. After the metallic coating material is applied onto a base coating film, a clear overcoating process is performed.

In the patent document 1, the metal flakes formed by pulverizing a vapor deposition metal film, preferably aluminum flake is used for a glittering pigment. A coating film formed has a metallic tone close to the metallic tone developed by the plated surface (This coating film will be referred to as a "plating-tone coating film".), but the coating film cannot develop a metal feeling free from a feeling of metal particles in a satisfactory level.

A method forming a coating film containing colloid particles of noble metal or copper has been known. The method includes a process of forming a coating film from a coating material containing metal colloid particles obtained by reducing a noble metal or copper compound in the presence of a polymer dispersing agent, and next process of forming a metal thin film by heating the coating film to melt and coagulate the colloid particles in the coating film (see patent document 2).

It is noted that the coating film forming method of the patent document 2 is applied particularly to a reflector plate for the reflection type liquid crystal display. In this respect, to apply the method to the coating of an object to be coated that requires high weathering resistance, for example, an automobile, some improvement of the method must be made.

For a coating material which ensures retention of stable matting property against change in the coating conditions and adjusts the appearance of a metal surface, a satin-touch aluminum material is known in which 1) a glittering coating film of a coating material containing a glittering pigment, and 2) a coating film having a dried coating film thickness of 10 to 50 μm, which is made of a clear coating material containing 5 to 60 pts. mass of spherical resin microparticles an average particle diameter (d) 50 of which is within a range from 10 to 50 μm, based on 100 pts. mass of a resin solid content for forming a coating film, are successively formed on an aluminum base material (see patent document 3).

For the glittering pigment used as a glittering material for the glittering coating film referred to in the patent document 3, the following materials may be enumerated: leafing or non-leafing type aluminum flakes, metal titanium flakes, stainless steel flakes, plate like iron oxide, phthalocyanine flakes, graphite, titanium-dioxide coated mica, colored mica, metal plated mica, metal plated glass flakes, titanium dioxide coated aluminum flakes, titanium-dioxide coated silicon-oxide flakes, cobalt sulfide, manganese sulfide, and titanium sulfide. Any of those glittering pigments does not develop a metal feeling free from a feeling of metal particles in satisfactory levels, however.

Patent document 1: Japanese Patent Application Laid-Open No. Hei 11-343431

Patent document 2: Japanese Patent Application Laid-Open No. 2000-239853

Patent document 3: Japanese Patent Application Laid-Open No. 2003-291255

SUMMARY OF THE INVENTION

Accordingly, a major object of the present invention is to provide a glittering coating film which has weathering resistance and high gloss, and develops a metal feeling or a colored metal feeling giving rise to a less feeling of metal particles than by the plating-tone coating film. Another object of the invention is to provide a glittering coating film which has weathering resistance, and develops a metal feeling giving rise to a less feeling of metal particles than by the plating-tone coating film and a deep matte-feeling. A still another object of the invention is to provide a glittering coating film which has weathering resistance and high gloss, and develops a metal feeling giving rise to a less feeling of metal particles than by the plating-tone coating film, and a metal feeling with hue of a composite metal colloid and a metal compounded by using the metal colloid and another metal (chemical compound) or hue of the metal used, and further provide a glittering coating film given coloring feeling. A further object of the invention is to provide a glittering coating film giving rise to a less feeling of metal particles than by the plating-tone coating film, and develops an unprecedented variation of design properties.

Considerable study efforts were expended with an attempt to provide successful solutions to the problems as mentioned above, and a technical idea of the invention was reached.

The technical idea of the invention may be implemented in a variety of modes.

(1) A method for forming a glittering coating film in which after a glittering base coating film is formed on a substrate to be coated by applying thereto a glittering base coating material containing a colloid particle liquid containing noble metal or copper colloid particles, the glittering base coating film is heated or set, and then a clear coating film is formed by executing any of the following processes (A) to (F):

(A) a process of forming and heating a top clear coating film by applying a clear coating material thereto, and heating the formed top clear coating film;

(B) a process of forming and heating a glittering clear coating film by applying thereto a glittering clear coating material containing a glittering material, which is different from the noble metal or copper colloid particles;

(C) a process of forming and heating a glittering clear coating film by applying thereto a glittering clear coating material containing a glittering material, which is different from the noble metal or copper colloid particles, and then forming and heating a top clear coating film by applying a clear coating material thereto;

(D) a process of forming and heating a matting clear coating film by applying thereto a matting clear coating material;

(E) a process of forming and heating a top color clear coating film by applying thereto a color clear coating material; and (F) a process of forming and heating a glittering clear coating film by applying thereto a glittering clear coating material containing a glittering material, which is different from the noble metal or copper colloid particles, and then applying a color clear coating material to form a top color clear coating film, and heating the resultant.

(2) A method for forming a glittering coating film as set forth in item (1), wherein a concentration of the noble metal or copper to a solid content in the noble or copper colloid particle liquid is not less than 83 mass % but less than 99 mass %.

(3) A method for forming a glittering coating film as set forth in item (1) or (2), wherein the noble or copper colloid particle liquid contains colloid particles of at least two kinds of metals selected from noble metal or copper.

(4) A method for forming a glittering coating film as set forth in any of items (1) to (3), wherein the glittering base coating material contains a colloid particle liquid containing metal colloid particles in which at least two kinds of metals selected from a group of noble metal, copper, nickel, bismuth, indium, cobalt, zinc, tungsten, chromium, iron, molybdenum, tantalum, manganese, tin, and titanium are combined.

(5) A method for forming a glittering coating film as set forth in any of items (1) to (3), wherein the glittering base coating material further contains at least one kind of metal selected from a group of nickel, bismuth, indium, cobalt, zinc, tungsten, chromium, iron, molybdenum, tantalum, manganese, tin, titanium, and aluminum or a metal compound containing the selected metal.

(6) A method for forming a glittering coating film as set forth in any of items (1) to (5), wherein the substrate to be coated is coated with an undercoating film a swelling ratio of which is within a range from more than 0% up to 5%.

(7) A method for forming a glittering coating film as set forth in item (6), wherein a crosslinking density of the undercoating film is selected to be not less than $1.1\times10^{-3}$ mol/cc but not exceeding $10\times10^{-3}$ mol/cc, whereby a swelling ratio of the undercoating film is within a range from more than 0% up to 5%.

(8) A method for forming a glittering coating film as set forth in any of items (1) to (7), wherein the glittering base coating material contains a vehicle.

(9) A method for forming a glittering coating film as set forth in item (8), wherein the vehicle contains, as a coating film forming resin, at least one of acrylic resin, polyester resin, alkyd resin, fluororesin, epoxy resin, polyurethane resin, and polyether resin, and if necessary, further contains, as a cross-linking agent, one of an amino resin and a block polyisocyanate compound.

(10) A method for forming a glittering coating film as set forth in item (9), wherein the coating film forming resin is formed by reacting a phosphoric-acid-group-containing monomer.

(11) A method for forming a glittering coating film as set forth in any of items (8) to (10), wherein a ratio of a solid content of the vehicle to a solid content in the metal colloid particle liquid is not less than 1/100 but not exceeding 30/100 (vehicle/metal colloid particle liquid=1/100 to 30/100).

(12) A method for forming a glittering coating film as set forth in any of items (1) to (11), wherein the glittering base coating material contains a vapor deposition metallic pigment obtained from aluminum and/or aluminum-titanium alloy.

(13) A method for forming a glittering coating film as set forth in any of items (1) to (12), wherein the glittering base coating material contain an ultraviolet absorber and/or a light stabilizer.

(14) A method for forming a glittering coating film as set forth in any of items (1) to (13), wherein the substrate to be coated is the following substrate (a) or (b):

(a) a substrate having an undercoating film, which is formed by spraying or electrodepositing a liquid coating material or by spraying a powder coating material;

(b) a substrate having an intermediate coating film, which is formed by spraying a liquid coating material or a powder coating material on an undercoating film which is formed by spraying or electrodepositing a liquid coating material or by spraying a powder coating material.

(15) A method for forming a glittering coating film as set forth in any of items (1) to (14), wherein the substrates to be coated are aluminum wheels, car bodies or plastic automobile parts.

(16) A glittering coating object formed by any of the methods for forming glittering coating films as set forth in any of items (1) to (15).

In a first method for forming a glittering coating film, which implements the present invention, a glittering base coating film is formed on a substrate to be coated by applying thereto a glittering base coating material containing a colloid particle liquid containing noble metal or copper colloid particles. Then, the glittering base coating film is heated or set, and a clear coating film is formed by applying a top clear coating material thereto. By the method, a glittering coating film can be obtained which has weathering resistance and high gloss, and develops a metal feeling giving rise to a less feeling of metal particles than by the plating-tone coating film. The glittering base coating film is formed on a substrate to be coated, and heated or set. Then, a glittering clear coating film is multiplexedly formed thereon by applying thereto a glittering clear coating material containing a glittering material, which is different from the noble metal or copper colloid particles. By the method, a glittering coating film can be formed which has weathering resistance and high gloss, and develops a metal feeling giving rise to a less feeling of metal particles than by the plating-tone coating film, and a high-grade metal feeling in which a glittering feeling is enhanced by light rays that pass through the glittering clear coating film and are reflected by the glittering base coating film.

In a second method for forming a glittering coating film, which implements the invention, a glittering base coating film is formed on a substrate to be coated applying thereto a glittering base coat material containing a colloid particle liquid of noble metal or copper colloid particles. Then, the glittering base coating film is heated or set, and a matting clear coating film is formed by applying a matting clear coating material thereto. By the second method, a glittering coating film can be obtained which has weathering resistance, and develops a metal feeling giving rise to a less feeling of metal particles than by the plating-tone coating film and a deep matte-feeling.

In a third method for forming a glittering coating film, which implements the invention, a glittering base coating film is formed on a substrate to be coated by applying thereto a glittery base coating material containing a colloid particle liquid containing noble metal or copper colloid particles. Then, the glittering base coating film is heated or set, and a top color clear coating film is formed by applying a color clear coating material thereto. By the method, a glittering coating film can be obtained which has weathering resistance and high gloss, and develops a coloring metal feeling giving rise to a less feeling of metal particles than by the plating-tone coating film. The glittering base coating film is formed on a substrate to be coated, and is heated or set. Then, a glittering clear coating film is formed thereon by applying thereto a glittering clear coating material containing a glittering material, which is different from the noble metal or copper colloid particles, and a top color clear coating film is formed by applying a color clear coating material thereto. Subsequently, a glittering coating film can be obtained which has weathering resistance and high gloss, and develops a colored metal feeling giving rise to a less feeling of metal particles than by the plating-tone coating film. Further, a glittering coating film can be formed which has a glittering feeling enhanced by light rays that pass through the glittering clear coating film and are reflected by the glittering base coating film.

In a fourth method for forming a glittering coating film, which implements the invention, a glittering base coating film is formed on a substrate to be coated by applying thereto a glittery base coating material containing a metal mixed colloid particle liquid containing metal colloid particles of at least two kinds of metals selected from noble metal or copper, for example, a gold-silver mixed colloid particle liquid containing gold and silver colloid particles. The glittering base coating film is heated or set, and a top color clear coating film is formed by applying a color clear coating material thereto. By the glittering coating film forming method, a glittering coating film can be formed which has weathering resistance and high gloss, and develops a metal feeling which gives rise to a less feeling of metal particles than by the plating-tone coating film and has a metal feeling with gold and silver hues caused by using the gold and silver. Then, a glittering clear coating film is multiplexedly formed by applying thereto a glittering clear coating material containing a glittering material, which is different from the gold and silver colloid particles, and a top color clear coating film is formed by applying a color clear coating material thereto. Subsequently, a glittering coating film can be obtained which has weathering resistance and high gloss, and develops a metal feeling which gives rise to a less feeling of metal particles than by the plating-tone coating film and has a metal feeling with gold and silver hues resulting from using the gold and silver. A glittering coating film can be formed which develops a metal feeling with gold and silver hues resulting from using the gold and silver in which a glittering feeling is enhanced by light rays that pass through the glittering clear coating film and are reflected by the glittering base coating film.

In a fifth method for forming a glittering coating film, which implements the invention, after an undercoating film is formed on a substrate to be coated a swelling ratio of which is within a range from more than 0% up to 5% by applying thereto a glittering base coating material containing a colloid particle liquid containing noble metal or copper colloid particles, the glittering base coating film is heated or set, and then a clear coating film is formed by executing any of the following processes (A) to (F). By the fifth method, a glittering coating film formed can be obtained which has weathering resistance and high gloss, and develops a high-grade metal feeling giving rise to a less feeling of metal particles than by the plating-tone coating film since a less amount of the glittering base coating material penetrates into the undercoating film. The processes (A) to (F) are:

(A) a process of forming and heating a top clear coating film by applying a clear coating material thereto, and heating the formed top clear coating film;

(B) a process of forming and heating a glittering clear coating film by applying thereto a glittering clear coating material, and heating the resultant a glittering clear coating film;

(C) a process of forming and heating a glittering clear coating film by applying thereto a glittering clear coating material, and then forming and heating a top clear coating film by applying a clear coating material thereto;

(D) a process of forming and heating a matting clear coating film by applying thereto a matting clear coating material;

(E) a process of forming and heating a top color clear coating film by applying thereto a color clear coating material; and (F) a process of forming and heating a glittering clear coating film by applying thereto a glittering clear coating material, and then forming and heating a top color clear coating film by applying a top color clear coating material thereto.

A sixth method for forming a glittering coating film of the invention, after a glittering base coating film is formed on a substrate to be coated by applying thereto a glittering base coating material containing a composite metal colloid particle or a mixed colloid particle, the glittering base coating film is heated or set, and then a clear coating film is formed by executing any of the above-mentioned processes, (A) to (F). By the method, a glittering coating film can be obtained which has weathering resistance and high gloss, and develops a coloring metal feeling giving rise to a less feeling of metal particles than by the plating-tone coating film since less impregnation of the glittering base coating film to the undercoating film is present. The composite metal colloid particle of the invention includes a composite metal colloid particle having a called core/shell structure. The glittering base coating film formed of the composite metal colloid particle having such a structure can develop an unprecedented variation of design properties. To the reflecting light, features of the metal colloid forming the shell part are developed, while to the transmitted light, features of the metal colloid forming the core part are developed. Such effects are remarkable particularly when the colloid particle of the core part is made of gold, the colloid particle of the shell part is made of silver or copper, and the shell part satisfactorily covers the core part. A material which develops different design properties to the reflecting light and the transmitted light has not existed. If a skeleton type substrate is coated with such a material, unprecedented design can be presented.

In a seventh glittering coating film forming method of the invention, a glittering base coating film is formed by using a glittering base coating material containing a coating film forming resin containing a phosphoric acid group. Then, a clear coating film is formed by executing any of the above-mentioned processes (A) to (F). The method brings about: a) to stabilize the metal colloid particles to prevent the flocculation of the metal colloid particles, b) to coat the metal colloid surface to prevent metal corrosion, and c) to increase its adhesiveness to the undercoating film.

In the eighth glittering coating film forming method of the invention, a glittering base-coating film is formed by using a glittering coating material further containing vapor deposition metallic pigments. Then, a clear coating film is formed by executing any of the above-mentioned processes (A) to (F). Accordingly, an uneven hue caused by a variation in value of a thickness of the glittering base-coating film is moderated thereby to form a glittering coating film being excellent in hue uniformity.

Various kinds of colloid particles having been described in the embodiment of the invention will be sometimes referred to as "metal colloid particles".

As described above, the glittering coating film that of the invention has design properties as stated above. Accordingly, it is believed that the invention will find preferable applications in the fields including exterior plates of automobiles and two-wheeled vehicles, various types of parts, container outer surfaces, coil coating, and household electric appliances.

DESCRIPTION OF THE PREFERRED EMBODIMENTS

Embodiments of the present invention will be described in hereunder. Descriptions in embodiments other than first embodiment, which are equal or substantially equal to those corresponding ones in the first embodiment will be omitted for simplicity of explanation.

<First Embodiment>

[Glittering Coating Film Having a Top Clear Coating Film]

In a first mode of a method for forming a glittering coating film of the present embodiment, a glittering base coating film is formed on a substrate to be coated by applying thereto a glittering base coating material containing a colloid particle liquid containing noble metal or copper colloid particles. Then, the glittering base coating film is heated or set, and, a top clear coating film is formed thereon by using a clear coating material.

In a second embodiment of the method for forming a glittering coating film, a glittering base coating film is formed on a substrate to be coated by applying thereto a glittering base coating material containing a colloid particle liquid containing noble metal or copper colloid particles. Then, the glittering base coating film is heated or set., and, a glittering clear coating film is formed thereon by applying thereto a glittering clear coating material containing a glittering material, which is different from the noble metal or copper colloid particles.

In a third embodiment of the method for forming a glittering coating film, top clear coating film is formed on the glittering clear coating film formed by the method of the second embodiment by using a clear coating material.

[Substrate to be Coated]

A material of the substrate to be coated is not limited to a specific material or materials in particular. The substrate material may be any of metal materials, inorganic materials, plastic materials, and natural or synthetic materials. Those metal materials include iron, aluminum, copper and alloys of those materials. The inorganic materials include glass, cement and concrete. The plastic materials include resins of polyethylene, polypropylene resin, ethylene-polyvinyl acetate resin, polyamide resin, acrylic resin, vinylidene chloride resin, polycarbonate resin, polyurethane resin, and epoxy resin, and various kinds of FRP. The natural materials include fibrous materials such as wood, paper and cloth.

In the glittering coating film forming method of the embodiment, the substrate to be coated is a substrate having an undercoating film or an undercoating film and an intermediate coating film, which is or are directly formed thereon. (a) The substrate may be a substrate having an undercoating film, which is formed thereon by spraying or electrodepositing thereon a liquid coating material (organic solvent type or aqueous type coating material), or by spraying thereon a powder coating material. (b) The substrate may also be a substrate having an intermediate coating film, which is formed thereon by spraying or electrodepositing thereon a liquid coating material (organic solvent type or aqueous type coating material) or an intermediate coating film formed by spraying a liquid coating material (organic solvent type or aqueous type coating material) or the powder coating material on the undercoating film formed by spraying the powder coating material. In a case where the coating substrate is an automobile body or an automobile part, it is preferable that the coating substrate is subject in advance to a chemical treatment or a degreasing treatment or that an undercoating film as an electrodepositing film is formed on the coating substrate in advance. In a case where the automobile part is aluminum wheel, it is preferable to form in advance an undercoating film on the coating substrate by using a clear powder coating material.

In the glittering coating film forming method, an intermediate coating film may, if necessary, be formed on a coating substrate having an undercoating film or an electrodeposition coating film by a wet-on-wet (W/W) method or a wet-on-dry (W/D) method. The W/W method is a coating method in which following an undercoating process, the coated film is dried by air to be put in an unhardened state or a semi-hardened state. The W/D method is a method in which a coating film having been hardened by baking is coated by a coating material.

An intermediate coating material for forming an intermediate coating film, which is formed if necessary, is preferably a clear coating material for an aluminum wheel, and a color pigment is preferably used for the automobile body and parts. The color pigments are as follows:

A) Organic Pigments:

Azo lake pigments, insoluble azoic organic pigments, condensed azoic organic pigments, phthalocyanine pigments, indigo pigments, perinone pigments, perylene pigments, phthalone pigments, diaxozine pigments, quinacridone pigments, isoindolinone pigments, metal complex pigments, etc.

B) Inorganic Pigments:

Yellow iron oxide pigment, red iron oxide, carbon black, and titanium dioxide, etc.

If necessary, various extender pigments, such as talc, calcium carbonate, precipitated barium sulfate, and silica, may be used in addition to the above pigments.

A vehicle, which is contained in the intermediate coating material used for forming an intermediate coating film, contains a coating film-forming resin and if necessary, a cross-linking agent. For the coating film-forming resin, the following resins may be described in detail (a) an acrylic resin (b) a polyester resin, and (c) an alkyd resin, preferably the acrylic resin or the polyester resin.

In a case where the vehicle contains a cross-linking agent of any of an amino resin, a (blocked) polyisocyanate compound, amine-based materials, polyimide-based materials, imidazoles, imidazolines, polybasic carboxylic acids, the vehicle contains 90 to 50 mass % (in terms of solid) coating film forming resin and 10 to 50 mass % cross-linking agent, preferably 85 to 60 mass % (in terms of solid) coating film forming resin and 15 to 40 mass % cross-linking agent. When the content of the cross-linking agent is less than 10 mass % (the coating film forming resin exceeds 90 mass %), the cross-linking in the coating film is insufficient. When the content of the cross-linking agent exceeds 50 mass % (when the content of the coating film forming resin is less than 50 mass %), a storage stability of the coating material lowers and a curing rate increase. This results in degradation of external appearances of the coating film.

The intermediate coating material may be of the solvent type, aqueous type, powder type or any other suitable type. For the solvent coating material or the aqueous coating material, one-component coating material or two-component resin, e.g., a two-component urethane resin coating material may be used.

A dry film thickness of the intermediate coating film is preferably 10 to 100 μm, more preferably 10 to 50 μm. If the thickness of the dried coating film is less than 10 μm, it is difficult to hide the foundation layer. If it exceeds 100 μm, there is a risk that the coating film may have a poor external appearance.

[Forming of a Glittering Base Coating Film]

The glittering base coating film in the glittering coating film forming method of the embodiment is formed preferably by a W/D method after the undercoating film or the intermediate coating film is formed. The glittering base coating film in the invention is formed of a glittering base coating material containing a noble metal or copper colloid particle liquid (referred to as "colloid particle liquid"), which contains noble metal or copper colloid particles.

The colloid particle liquid may be prepared by a known method, for example, a liquid phase growth or a vapor phase growth method. The colloid particle liquid is prepared through execution of a process for producing a noble metal or copper colloid particle liquid by reducing a noble metal or copper compound in the presence of a polymeric pigment dispersing agent, and a concentrating process for ultrafiltering the noble metal or copper colloid particle liquid produced in the producing process. A concentration of the noble metal or copper within a solid content in the colloid particle liquid is preferably not less than 83 mass % but less than 99 mass %.

The noble metal or copper compound, which is used for the colloid particle liquid, is dissolved in a solvent to produce metal ions or copper ions. Those ions are reduced to yield noble metal or copper colloid particles. Examples of the noble metal, which becomes the metal colloid particles, are gold, silver, ruthenium, rhodium, palladium, osmium, iridium, and platinum, though it is not limited in particular. Among those metals, gold, silver, platinum, palladium are preferable for that noble metal. Gold, silver, platinum, or palladium is especially preferable since it can develop a metal feeling having high gloss and giving rise to a less feeling of metal particles than by the plating-tone coating film.

The noble metal or copper compound is not limited in particular if it contains noble metal or copper. Examples of it are tetrachloroaurate (III) tetra-hydrate (chlorauric acid), silver nitrate, silver acetate, silver (IV) perchlorate, hexachloro platinic (IV) acid hexa-hydrate (chloroplatinic acid), potassium chloroplatinate, copper (II) chloride di-hydrate, copper acetate (II) mono-hydrate, copper (II) sulfate, palladium (II) chloride di-hydrate, and rhodium trichloride trihydrate.

Those metal compounds may be used alone or in combination with two or more kinds.

The noble metal or copper compound is preferably such that molarity of the noble metal or copper in the solvent is equal to or higher than 0.01 mol/l. Where it is less than 0.01 mol/l, molarity of the noble metal or copper in the resultant noble metal or copper colloid particle liquid is too low and no adequate efficiency can be expected. For this reason, its value is preferably equal to or higher than 0.05 mol/l, more preferably equal to or higher than 0.1 mol/l.

The solvent may be any kind of solvent if it is capable of dissolving the noble metal or copper compound. Water and organic solvent may be enumerated for the solvent. Examples of the organic solvent are 1-4 C alcohol, such as ethanol and ethylene glycol, ketones, e.g., acetone, and esters, e.g., ethyl acetate. Any of these may be used alone or in combination of two or more kinds. In a case where the solvent is a mixture of water and organic solvent, it is preferably of the water soluble type. Examples of such a solvent are acetone, methanol, ethanol, and ethylene glycol. In the invention, a liquid of water, alcohol or a mixture of water and alcohol is preferable since it is compatible with an ultrafiltering process in a posterior concentrating stage.

The polymeric pigment dispersing agent is an amphiphilic copolymer in which a functional group having high affinity to a pigment surface is introduced to a high molecular weight polymer, and has a structure including solvated part. Usually, it is used as a pigment dispersing agent in the manufacturing stage of pigment paste.

The polymeric pigment dispersing agent coexists with the noble metal or copper colloid particle. It is estimated that the polymeric pigment dispersing agent stabilizes the dispersing of the noble metal or copper colloid particles in the solvent A number-average molecular weight of the polymeric pigment dispersing agent is preferably within a range from 1,000 to 1,000,000. If it is less than 1,000, its dispersion stabilizing function unsatisfactorily works sometimes. If it exceeds 1,000,000, a viscosity of the colloid particle liquid is too high, and sometimes its handling is difficult. The number-average molecular weight of the polymeric pigment dispersing agent is preferably within a range from 2000 to 500,000, more preferably 4,000 to 500,000.

For the polymeric pigment dispersing agent, any type of polymeric pigment dispersing agent may be used if it has the properties mentioned above. An example of such a dispersing agent is the polymeric pigment dispersing agent described in Japanese Patent Application Laid-Open No. Hei 11-80647. The polymeric pigment dispersing agents commercially available may also be used. Examples of such dispersing agents are:

1) Polymeric Pigment Dispersing Agents by Lubrizol Corporation

Solsperse20000, Solsperse24000, Solsperse26000, Solsperse27000, Solsperse28000, Solsperse32550, Solsperse35100, Solsperse37500, Solsperse41090 (all of these are trade names)

2) Polymeric Pigment Dispersing Agents by BYK-Chemie GmbH

Disperbyk 160, Disperbyk 161, Disperbyk 162, Disperbyk 163, Disperbyk 166, Disperbyk 170, Disperbyk 180, Disperbyk 181, Disperbyk 182, Disperbyk 183, Disperbyk 184, Disperbyk 190, Disperbyk 191, Disperbyk 192, Disperbyk 2000, Disperbyk 2001 (all of these are trade names)

3) Polymeric Pigment Dispersing Agents by EFKA Additives B.V.

Polymer 100, Polymer 120, Polymer 150, Polymer 400, Polymer 401, Polymer 402, Polymer 403, Polymer 450, Polymer 451, Polymer 452, Polymer 453, EFKA-46, EFKA-47, EFKA-48, EFKA-49, EFKA-1501, EFKA-1502, EFKA-4540, EFKA-4550 (all of these are trade names)

4) Polymeric Pigment Dispersing Agents by Kyoeisha Chemical Co., Ltd.

FLOWLEN DOPA-158, FLOWLEN DOPA-22, FLOWLEN DOPA-17, FLOWLEN G-700, FLOWLEN TG-720W, FLOWLEN 730W, FLOWLEN 740W, FLOWLEN 745W (all of these are trade names)

5) Polymeric Pigment Dispersing Agents by Ajinomoto Co., Inc.

AJISPER PA111, AJISPER PB711, AJISPER PB811, AJISPER PB821, AJISPER PW911 (all of these are trade names)

6) Polymeric Pigment Dispersing Agents by Johnson Polymer Corporation

JONCRYL 678, JONCRYL 679, JONCRYL 62 (all of these are trade names)

These polymeric pigment dispersing agents may be used alone or in combination with two or more kinds.

A usage amount of the polymeric pigment dispersing agent is preferably 30 mass % or less of the total amount of the noble metal or copper in the noble metal or copper compound and the polymeric pigment dispersing agent. If it exceeds 30 mass %, there is a fear that a concentration of the noble metal or copper contained in the solid of the liquid cannot be increased to a desired concentration even if the ultrafiltering process in a posterior concentrating stage is carried out. The usage amount of the polymeric pigment dispersing agent is preferably 20 mass % or less, more preferably 10 mass % or less.

The noble metal or copper compound can be reduced to a noble metal or copper by using a reducing compound in the presence of the polymeric pigment dispersing agent. The reducing compound is preferably an amine. For example, an amine is added to a liquid containing the noble metal or copper compound and the polymeric pigment dispersing agent, and agitated to mix them, whereby the noble metal ions or the copper ions are reduced into a noble metal or copper. By using the amine, the noble metal or copper compound can be reduced at a reaction temperature of about 5 to 100° C., preferably 20 to 80° C. without any necessity of using a reducer that is highly dangerous and hazardous, and without heating and without using a special light irradiation device.

The amine is not limited to a specific one or ones in particular. For example, chemical substances exemplarily listed in Japanese Patent Application Laid-Open No. Hei 11-80647 may be used for the amine.

A) Aliphatic Amine

Propylamine, butylamine, hexylamine, diethylamine, dipropylamine, diethylmethylamine, dimethylethylamine, triethylamine, ethylenediamine, N,N, N', N'-tetramethylethylenediamine, 1,3-diaminopropane, N,N,N',N'-tetramethyl-1,3-diaminopropane, triethylenetetramine, tetraethylenepentamine, etc.

B) Cycloaliphatic Amine

Piperidine, N-methylpiperidin, piperazine, N,N'-dimethylpiperazine, pyrrolidine, N-methylpyrrolidine, morpholine, etc.

C) Aromatic Amine

Aniline, N-Methylaniline, N,N-dimethylaniline, toluidine, anisidin, phenetidine, etc.

D) Aralkylamine

Benzylamine, N-methylbenzylamine, N,N-dimethylbenzylamine, phenethylamine, xylylenediamine, N,N,N',N'-tetramethylxylylenediamine, etc. For the amine, the following alkanolamine may also be enumerated: Methylaminoethanol, dimethylaminoethanol, triethanolamine, ethanolamine, diethanolamine, methyldiethanolamine, propanolamine, 2-(3-aminopropylamino)ethanol, butanolamine, hexanolamine, and dimethylaminopropanol, etc.

Those materials may be used alone or in combination with two or more kinds.

Of those substances, alkanolamine is preferable, and dimethylaminoethanol is more preferable.

The following materials may be used in addition to the amine: alkali metal borohydride salt used as a reducing agent, such as sodium borohydride, hydrazine compound, hydroxylamine, citric acid, tartaric acid, ascorbic acid, formic acid, formaldehyde, dithionite, and sulfoxylate derivative. Among those materials, citric acid, tartaric acid and ascorbic acid are preferable in use since those materials are readily available. Any of those materials may be used alone or in combination with the amine. When the citric acid, tartaric acid and ascorbic acid are combined with the amine, it is preferable to use the citric acid, tartaric acid and ascorbic acid in the form of the salt thereof. When the citric acid or the sulfoxylate derivative is combined in use with iron (II) ion, their oxidation reduction potential can be improved.

An addition quantity of the reducing compound is preferably in excess of a quantity necessary for reducing the noble metal or copper contained in the noble metal or copper compound. If the addition quantity is less than the quantity necessary for reducing the noble metal or copper, there is a possibility that the reducing of it is inadequate. The upper limit of the addition quantity of the reducing compound is preferably equal to or less than 30 times of the quantity necessary for reducing the noble metal or copper contained in the noble metal or copper compound, though it is not limited to a specific value or values in particular. More preferably, it is equal to or less than 10 times of the necessary quantity. To reduce the noble metal or copper compound, a light irradiation method using a high pressure mercury lamp may be used, in addition to the chemical reducing method by adding any of the reducing compounds referred to above.

The method for adding the reducing compound is not limited to a specific one or ones. For example, the reducing compound may be added after the polymeric pigment dispersing agent is added. In this case, the polymeric pigment dispersing agent is dissolved into a solvent, and a liquid into which the reducing compound, or the noble metal or copper compound have been dissolved is added and further, the noble or copper compound, or reducing compound is added, respectively, whereby a reducing process is promoted. Also in another reducing compound adding method, can take on a form of mixing the polymeric pigment dispersing agent and the reducing compound in advance, and the resultant mixture is added to a liquid containing the noble metal or copper compound.

By the reducing process, a liquid is obtained which contains noble metal or copper colloid particles an average particle diameter of which is 1 nm to 100 nm. The liquid having undergone the reducing process contains the noble metal or copper colloid particles and the polymeric pigment dispersing agent, and it is a noble metal or copper colloid particle liquid. The "noble metal or copper colloid particle liquid" means a liquid in which fine particles of noble metal or copper are dispersed in a solvent and which can visually be recognized. A concentration of the noble metal or copper in the noble metal or copper colloid particle liquid, which is obtained in the producing process, can be determined through a measurement by TG-DTA, for example. When the measurement is not employed, it may be specified by a value calculated from the formulation amount used in the preparation.

A concentrating process for ultrafiltering the colloid particle liquid having undergone the reducing process is carried out. The noble metal or copper colloid particle liquid having undergone the reducing process contains miscellaneous ions, for example, chloride ions, salt produced in the reducing process, and sometimes amine, in addition to the noble metal or copper colloid particles and the polymeric pigment dispersing agent. It is desirable to remove the salt and the amine since those may adversely affect a stability of the noble metal or copper colloid particle liquid, which is produced in the concentration process. To remove them, any of electrodialysis, centrifugation, ultrafiltering and decantation methods may be used. It is suggested to use the ultrafiltering method since a concentration of the noble metal or copper is increased simultaneously with the removal of them.

A concentrated metal colloid particle liquid of the invention is formed by ultrafiltering the noble metal or copper colloid particle liquid obtained by the reducing process. In the invention, the miscellaneous ions, salt and amine in the noble metal or copper colloid particle liquid are removed, and further part of the polymeric pigment dispersing agent is removed by ultrafiltering the noble metal or copper colloid particle liquid.

The colloid particle liquid from which part of the polymeric pigment dispersing agent is removed, A solid content formed of the noble metal or copper colloid particles and the polymeric pigment dispersing agent is preferably is, in terms of mass %, 0.05 to 50%. If it is less than 0.05%, a molarity of the noble metal or copper is too low, and it is inefficient. If it exceeds 50%, it is difficult to remove part of the polymeric pigment dispersing agent.

A filter film used for the ultrafiltration UF has a sieve mesh that is finer than that for a microfilteration MF. The ultrafiltration is usually used for separating a high-molecular material and a colloid material. In the invention, it is used for increasing a concentration of the noble metal or copper in the solid content of the noble metal or copper colloid particle liquid.

In the ultrafiltration, a diameter of a substance to be separated is usually within 1 nm to 5 μm. By so selecting the diameter of the substance, the polymeric pigment dispersing agent is removed together with the unnecessary miscellaneous ions, salt and amine. A concentration of the noble metal or copper of the solid content in the noble metal or copper colloid particle liquid, which is produced in the concentration process, is increased. If it is less than 1 nm, sometimes the unnecessary components cannot be removed since the components cannot pass through the filter film. If it exceeds 5 μm, most of metal colloid particles pass through the filter film. This often results in failure of producing a highly concentrated noble metal or copper colloid particle liquid.

The filter film for the ultrafiltration is not limited in particular. The filter film usually used is made of resin of polyacrylonitrile, vinyl chloride/polyacrylonitrile, polysulfone, polyimide, polyamide or the like. Of those materials, the polyacrylonitrile and polysulfone are preferable, and the polyacrylonitrile is more preferable. For the filter film for the ultrafiltration, a filter film that can be reversely cleaned is preferably used in order to efficiently perform the cleaning of the filter film that is usually performed after the ultrafiltration ends.

A filter film for an ultrafiltering has preferably a molecular weight cut off of 3000 to 80000. If it is less than 3000, it is difficult to sufficiently remove unnecessary polymeric pigment dispersing agent and the like. If it exceeds 80000, the noble metal or copper colloid particles easily pass through the membrane. It is impossible to produce a noble metal or copper colloid particle liquid as desired, sometimes. Accordingly, a range of 10000 to 60000 is more preferable. The "molecular weight cut-off" follows. When the high polymer liquid is passed through the filtration membrane, a high polymer molecule passes through the perforations of the filtration membrane and is discharged to outside. The term molecular weight cut-off is a molecular weight of a high polymer molecule that is discharged to outside. The molecular weight cut-off is used for evaluating a diameter of the perforation of the filtration membrane. A value of the molecular weight cut-off indicates a size of the perforation. When its value is large, the perforation diameter is large.

As to a form of a filter module for the ultrafiltration, is not particularly limited. Examples of the filter modules that may preferably be used for the invention are a hollow fiber module (called also as a capillary module), a spiral module, a tubular module, and a plate module. As a film area become larger, a time require for the filtering become shorter. In this respect, the hollow fiber module that is compact for its filtering area size is preferably used. In a case where an amount of the noble metal or copper colloid particle liquid to be processed is large, it is preferable to use a filter film module having a large number of the filter films.

Ultrafiltration method is not particularly limited. For example, a conventional method is used. Usually, the ultrafiltration is carried out by passing the noble metal or copper colloid particle liquid produced in the manufacturing process through the ultrafiltration filter film. The ultrafiltering process is repeated till the miscellaneous ions in the filtrate reaches a predetermined concentration or lower. At this time, to keep constant a concentration of the noble metal or copper colloid particle liquid to be processed, it is preferable to add a solvent equal in amount to the discharge filtrate thereto. Also at this time, if another solvent that is different from that used in the reducing process is used, the solvent of the noble metal or copper colloid particle liquid is substituted by such a solvent. In a case where the solvent of the noble metal or copper colloid particle liquid to be processed is water, it is replaced with alcohol such as methanol and its drying property and wettability to the substrate and the like are improved to be excellent. In a case where the solvent is alcohol such as ethanol, it is replaced with water and excellent environmental performances thereof are ensured.

The ultrafiltration may be carried out by a normal operation, for example, a called batch method. In the batch method, the noble metal or copper colloid particle liquid to be processed is progressively added as the ultrafiltration progresses. To increase a concentration of the solid, an additional ultrafiltration process may be carried out after the miscellaneous ions is removed to a desired level of concentration A concentration of the noble metal or copper colloid particle liquid, which is produced by the concentrating process for carrying out the ultrafiltration, has a value increased relative to that of the liquid before it is subject to the concentrating process, although its specific value depends on a concentration value of the noble metal or copper of the noble metal or copper colloid particle liquid produced in the producing process. A difference between the concentration values of the noble metal or copper before and after the concentrating process is preferably within 0.5 to 10 mass %, more preferably 1 to 5 mass %.

A concentration of the noble metal or copper to a slid content in the noble metal or copper colloid particle liquid produced in the concentrating process is preferably within a range from 83 mass % to less than 99 mass %, more preferably 90 mass % to less than 98 mass %, much more preferably 93 mass % to less than 98 mass %. If it is less than 83 mass %, when the heating condition is mild, there is a fear that one may not form such a coating film that has substantially high gloss, and develops a metal feeling giving rise to a less feeling of metal particles than by the plating-tone coating film. If it is 99 mass % or higher, there is a fear of degrading particle dispersion stability.

Part of the polymeric pigment dispersing agent is removed from the noble metal or copper colloid particle liquid by ultrafiltering the noble metal or copper colloid particle liquid. As a result, a concentration of the noble metal or copper in the noble metal or copper colloid particle liquid is increased than that of the same before it is ultrafiltered. Accordingly, a concentration of the noble metal or copper in the noble metal or copper colloid particle liquid is higher than that in the conventional one. Also when a coating substrate is coated with the noble metal or copper colloid particle liquid thus obtained, and the heating conditions are milder than the conventional ones, a coating film can be obtained which has substantially high gloss, and develops a metal feeling giving rise to a less feeling of metal particles than by the plating-tone coating film. For this reason, even when a coating substrate having a relatively low heat-resistance temperature, such as plastic and paper, is coated with the liquid, a coating film can be formed which has substantially high gloss, and develops a metal feeling giving rise to a less feeling of metal particles than by the plating-tone coating film.

In the method for forming a glittering coating film according to the present invention, a glittering base coating material used for forming a glittering base coating film contains the metal colloid particle liquid. Preferably, a vehicle further contained therein contains a coating film-forming resin and, if necessary, a cross-linking agent. For the coating film-forming resin, the following resins may be enumerated: (a) acrylic resin, (b) polyester resin, (c) alkyd resin, (d) fluorine resin, (e) epoxy resin, (e polyurethane resin, and (g) polyether resin. Any of those resins may be used alone or in combination of two or more kinds. It is preferable to use at least one kind of the acrylic resin, the polyester resin and the fluorine resin.

The (a) acrylic resin may be a copolymer of acrylic monomer and another ethylene unsaturated monomer.

The acrylic monomer that may be used for the copolymer includes:

A) Esterified compounds of methyl, ethyl, propyl, n-Butyl, i-butyl, t-butyl, 2-ethylhexyl, lauryl, phenyl, benzyl, 2-hydroxyethyl, 2-hydroxypropyl, etc., acrylates or methacrylates B) Ring-opening addition products of caprolactone to 2-hydroxyethyl acrylate or methacrylate.

C) Glycidyl acrylic acid, glycidyl methacrylate, acrylamide, methacrylamide and N-methylol acrylamide, (meth) acrylic esters of polyhydric alcohol, etc.

The other ethylene unsaturated monomer that is polymerizable with those substances may include styrene, a-methylstyrene, itaconic acid, maleic acid, vinyl acetate, etc.

The (b) polyester resin may be saturated polyester resin or unsaturated polyester resin. An example of such a resin is a condensation product, which is formed by heating and condensating a polybasic acid and a polyhydric alcohol.

For the polybacic acid, the following acids may be enumerated: saturated polybacic acid such as phthalic anhydride, terephthalic acid, and, succinic acid, and unsaturated polybacic acid such as maleic acid, maleic anhydride, and fumaric acid. For the polyhydric alcohol, the following may be enumerated: dihydric alcohol such as ethylene glycol and diethylene glycol, and trihydric alcohol such as glycerine, and trimethylolpropane.

The (c) alkyd resin may be an alkyd resin formed by reacting polybasic acid with polyhydric alcohol and further a modifying agent, such as oils and fats, and fat and fatty acid (soybean oil, linseed oil, coconut oil, stearic acid, etc.), natural resin (rosin, succinic, etc.).

Examples of the (d) fluorine resin may be polyvinylidenefluoride, polytetrafluoroethylene or mixture of them, resins of fluoro copolymers formed by copolymerizing a monomer mixture of a polymerizable compound containing a fluoroolefin and a hydroxy group and a monomer isomer containing a co-polymerizable vinyl compound, An example of the (e) epoxy resin is a resin formed through a reaction of bisphenol with an epichlorohydrin. Examples of the bisphenol are bisphenol A and F. Examples of the a bisphenol-type phenoxy resin are Epikote 828, Epikote 1001, Epikote 1004, Epikote 1007, and Epikote 1009 (those are trade names, manufactured by Shell Chemical Corporation). Each of those resins that are chain elongated by using an appropriate chain elongator may also be used.

The (f) polyurethane resin may be a resin having a urethane linkage obtained by a reaction of various kinds of polyol ingredients, such as acryl, polyester, polyether, and polycarbonate, with a polyisocyanate compound. The polyisocynate compound includes 2,4-tolylene diisocyanate (2,4-TDI), 2,6-tolylene diisocyanate (2,6-TDI) and a mixture (TDI) of them, diphenylmethane-4,4'-diisocyanate(4,4'-MDI), diphenylmethane-2,4'-diisocyanate(2,4'-MDI) and their mixture (MDI), naphthalene-1,5-diisocyanate(NDI), 3,3'-dimethyl-4,4'-biphenylene diisocyanate, xylylene diisocyanate(XDI), dicyclohexylmethane-diisocyanate (hydrated HDI), isophorone diisocyanate (IPDI), hexamethylene diisocyanate (HDI), and xylylene diisocyanate hydrated (HXDI).

The (g) polyether resin is a polymer or copolymer having an ether linkage, and is polyether resin having two hydroxy groups per molecule, such as polyoxyethylene polyether, polyoxypropylene polyether or polyoxybutylene polyether, or polyether derived from aromatic polyhydroxy compound, e.g., bisphenol A or bisphenol F. Its additional example is carboxyl group-containing polyether resin, which is formed by reacting the polyether resin with polybasic carboxylic acids, such as succinic acid, adipic acid, sebacic acid, phthalic acid, isophthalic acid, terephthalic acid, and trimellitic acid or a reaction derivative, e.g. an acetic anhydride thereof.

The coating film forming resin is classified into a resin of the type having curability and a resin of a lacquer type. Usually, the resin having curability is used. The resin having curability is mixed, in use, with a crosslinking agent, such as amino resin, (blocked) polyisocyanate compound, amine, polyamide, imidazoles, imidazolines, and polybasic carboxylic acid. Its curing reaction can be caused to progress by heating or at normal temperature. The resin not having curability (lacquer type) and the resin having curability may be used together. The crosslinking agent is preferably at least one of amino resin and (blocked) polyisocyanate compound.

In a case when the vehicle contains a cross-linking agent, the vehicle contains 90 to 50 mass % (in terms of solid) coating film forming resin and 10 to 50 mass % cross-linking agent, preferably 85 to 60 mass % (in terms of solid) coating film forming resin and 15 to 40 mass % cross-linking agent. When the content of the cross-linking agent is less than 10 mass % (when the coating film forming resin exceeds 90 mass %), the cross-linking in the coating film is not sufficient. When the content of the cross-linking agent exceeds 50 mass % (when the content of the coating film forming resin is less than 50 mass %), a storage stability of the coating material lowers and a curing rate of it is large. This results in degradation of external appearances of the coating film.

A preferable mass ratio of the solids between the vehicle and the metal colloid particle liquid is: vehicle/metal colloid particle liquid=1/100 to 30/100. If the vehicle/metal colloid particle liquid is less than 1/100, the weathering resistance is insufficient, and there is a fear that an adhesiveness to the glittering clear coating film as a coating film coated over the glittering base coating film or the top clear coating film lowers. If it exceeds 30/100, a metal feeling free from a feeling of metal particles may not be obtained in a satisfactory level. For this reason, the vehicle/metal colloid particle liquid is selected to be preferably within a range from 10/100 to 25/100.

In addition to the components, the glittering base coating material contains a colloidal dispersion composed a polyamide wax as a lubricant dispersion of aliphatic amide, or oxidized polyethylene, and additively contains, in appropriate amounts, polyethylene wax, anti-settling agent, curing catalyst, ultraviolet absorber, light stabilizer, antioxidant, levelling agent, surface conditioner such as silicone and organic polymer, antisagging agent, thickening agent, defoaming agent, lubricant, crosslinkable polymer particle (microgel), and the like. The performances of the coating material and the coating film can be improved when, for example, 15 pts. mass or less each additive is added based on 100 pts. mass (in terms of solid) of the vehicle, usually.

It is preferable that the glittering base coating material contains ultraviolet absorber and/or light stabilizer from a weathering resistance point of view.

For the ultraviolet absorber, the following chemical substances may be enumerated:

A) Salicylate Ultraviolet Absorber:

Phenyl-salicylate, 4-t-butyl phenyl-salicylate, 2,4-di-t-butyl phenyl-3, 5'-di-t-butyl-4'-hydroxyl benzoate, and 4-t-octyl pheny salicylate, B) Benzophenon Ultraviolet Absorber:

2,4-dihydroxybenzophenone, 2-hydroxy-4-methoxybenzophenone,
2-hydroxy-4-methoxybenzophenone-5-sulphonic acid,
2-hydroxy-4-n-octoxybenzophenone,
2-hydroxy-4-n-4-dodecyloxybenzophenone,
2-hydroxy-4-benzyloxybenzophenone,
bis(5-benzoyl-4-hydroxy-2-methoxyphenyl)methane,
2,2'-dihydroxy-4-methoxybenzophenone,
2,2'-dihydroxy-4,4'-dimethoxybenzophenone,
2,2',4,4'-tetrahydroxybenzophenone,
4-dodecyloxy-2-hydroxybenzophenone,
2-hydroxy-4-methoxy-2'-carboxybenzophenone, and
2-hydroxy-4-(2--methacryloyloxyethoxy)benzophenone.

Additional ultraviolet absorber is a benzotriazol ultraviolet absorber as given below:

2-(2'-hydroxy-5'-methylphenyl)benzotriazole,
2-[2'-hydroxy-3',5'-bis(α,α-dimethylbenzyl)phenyl]benzotriazole,
2-(2'-hydroxy-3',5'-di-t-butyl phenyl)benzotriazol,
2-(2'-hydroxy-3'-t-butyl-5'-methylphenyl)-5-chlorobenzotriazole,
2-(2'-hydroxy-3',5'-di-t-butyl phenyl)-5-chlorobenzotriazole,
2-(2'-hydroxy-3',5'-di-t-amyl))benzotriazol,
2-(2'-hydroxy-5'-t-octyl phenyl)benzotriazol,
2,2'-methylenebis[4-(1,1,3,3-tetramethylbutyl)-6-(2N-benzotriazol-2-yl)phenol].

Any of those substances may be used alone or a combination of two or more kinds of them may be used. The content of the ultraviolet absorber is preferably 2 to 20 pts. mass its solid content, based on 100 pts. mass solid content of the vehicle. If the content is less than 2 pts. mass, crack possibly occurs in the product at the time of weathering resistance test. If its content exceeds 20 pts. mass, hardenability of the product is possibly deteriorated. A preferable content of the ultraviolet absorber is within a range from 10 to 15 pts. mass.

For the light stabilizer, the following cyanoacrylate light stabilizer may be used:

A) Hindered Amine Light Stabilizer:

Phenyl-4-piperidinyl carbonate,
bis-(2,2,6,6-tetramethyl-4-piperidinyl)sebacate,
bis-(N-methyl-2,2,6,6-tetramethyl-4-pieridinyl)sebacate,
bis-(1,2,2,6,6-pentamethyl-4-piperidyl)-2-(3,5-di-t-butyl-4-hydroxybenzyl)-2-n-butylmalonate,
1,2,2,6,6-pentamethyl-4-piperidylmethacrylate, and
2,2,6,6-tetramethyl-4-piperidylmethacrylate, B) Cyanoacrylate Light Stabilizer:

Ethyl-2-cyano-3,3-Diphenylacrylate,
2-Ethylhexyl-2-cyano-3,3'-Diphenylacrylate, and
Butyl-2-cyano-3-methyl-3-(p-methoxyphenyl)acrylate.

Of those stabilizers, use of the hindered amine light stabilizer which has great effect at a small amount thereof is preferable. The content of the light stabilizer is preferably 0.5 to 10 pts. mass its solid content, based on 100 pts. mass solid content of the vehicle. If it is less than 0.5 pts. mass, crack possibly occurs in the product at the time of weathering resistance test. If it exceeds 10 pts. mass, hardenability of the product is possibly deteriorated. A preferable content of the light stabilizer is within a range from 1 to 5 pts. mass.

The glittering base coating material may be of the solvent type, aqueous type, powder type or any other suitable type. For the solvent coating material or the aqueous coating material, one-component coating material or two-component resin, e.g., two-component urethane coating material may be used.

(1) The glittering base coating material was applied to the coating substrate, the resultant glittering base coating film was thermally cured or set, and then the top clear coating film was heated. The resultant glittering coating film was good in weathering resistance and gloss, and developed a metal feeling giving rise to a less feeling of metal particles than by the plating-tone coating film. (2) The glittering base coating material was applied to the coating substrate, the resultant glittering base coating film was thermally cured or set, and then the glittering clear coating film and, if necessary, the top clear coating film were heated. By the method, a glittering coating film can be formed which develops a high-grade metal feeling in which a glittering feeling is enhanced by light rays that pass through the glittering clear coating film and are reflected by the glittering base coating film.

The method for coating the glittering base coating material is not particularly limited coating machines, such as spray, spin coater, roll coater, silk screen, and ink jet may be used for executing the method. Dip coating or electrophoresis may also be used for the same purpose. An amount of coating may be varied in accordance with a concentration of the noble metal or copper colloid particle liquid, a coating method and the like, and may be set at a desired value in accordance with uses.

The heating method is not particularly limited, for example, heating oven in the heating method such as a gas oven, an electric oven, IR oven, and the like. In a case where the heating time is relatively short, it is preferable to use a system in which the heating oven is located on a production line. By so doing, the glittering base coating film can be efficiently formed. If necessary, it may be dried at ordinary temperature or be forcibly dried.

A dry film thickness of the glittering base coating film formed by the glittering base coating material is not limited to a specific one or ones in particular.

Since the coating material contains noble metal or copper colloid particles having an extremely small particle diameter, it is suitable particularly for the forming of a thin film having a thickness of approximately 0.05 to 3 μm.

[Forming of Top Clear Coating Film and Glittering Clear Coating Film]

In a method for forming a glittering coating film according to the present invention, (1) at least one layer of a top clear coating film is formed on the glittering base coating film or (2) at least one layer of a top clear coating film, which is formed if necessary, is formed on a coating film that is formed by overcoating a glittering clear coating film on the glittering base coating film.

The top clear coating film is a transparent and colorless clear film, which does not hide an undercoating layer. The top clear coating film that is formed on the glittering base coating film enhances the glitter of the coating film, and protects the noble metal or copper colloid particles. The top clear coating film is formed of the top clear coating material, and this coating material may be a coating material usually used for the overcoating. An example of such a material is a mixture of the cross-linking agent and at least one kind of thermosetting resin selected from among acrylic resin, polyester resin, fluororesin, epoxy resin, polyurethane resin, and polyether resin, and a modified resin thereof. Atop clear coating material containing a carboxyl group-containing polymer and an epoxy group-containing polymer, disclosed in Japanese Patent Publication No. Hei 08-19315 is preferably used for the top clear coating film from the point of view of a countermeasure for acid rain. The top clear coating material may be of the solvent type, aqueous type, powder type or any other various types. For the solvent type coating material or the aqueous type coating material, one-component coating material or two-component resin, e.g., a two-component urethane resin coating material, may be used.

The top clear coating material may, if necessary, contain an additive agent, such as a modifier, an ultraviolet absorber, a levelling agent, a dispersing agent, and a defoaming agent. In this case, an amount of the additive agent is within such a range of the amounts of the additive agent as not to deteriorate a transparency of the top clear coating material.

A dry film thickness of the top clear coating film is preferably 10 to 80 μm. If it is out of this range, there is a danger that the coating film may have a poor external appearance. The dry film thickness is more preferably 20 to 50 μm.

In the glittering coating film forming method of the invention, a glittering clear coating film is layered over the glittering base coating film, and if necessary, at least one layer of the top clear coating film is layered thereover. In order to form glittering coating film can be formed which develops a high-grade metal feeling in which a glittering feeling is enhanced by light rays that pass through the glittering clear coating film and are reflected by the glittering base coating film, a glittering clear coating film containing a glittering material not including noble metal or copper colloid particles, which is formed if required, is formed on the glittering base coating film after the glittering base coating film is thermally cured or set. The glittering clear coating film is formed by a glittering clear coating material containing an amount of a bright pigment within such a range of the amounts of the glittering pigment as not to deteriorate a transparency of the coating film.

"Such a range of the amounts of the glittering pigment as not to deteriorate a transparency of the coating film" is a range of amounts of the glittering pigment within which one can recognize a boundary between a white area and a black area on a contrast ratio test paper at a predetermined dry film thickness of the coating film, although it varies depending on a kind of the glittering pigment.

A vehicle for the glittering clear coating material, which contains an amount of a glittering material not including noble metal or copper colloid particles, within such a range of the glittering material as not to deteriorate a transparency of the coating film may be a vehicle usually used for the ordinary overcoating. An example of such a vehicle is a mixture of the cross-linking agent and at least one kind of thermosetting resin selected from among acrylic resin, polyester resin, fluororesin, epoxy resin, polyurethane resin, and polyether resin, and a modified resin thereof. Carboxyl group-containing polymer combined with an epoxy group-containing polymer, disclosed in Japanese Patent Publication No. Hei 08-19315 is preferably used for the top clear coating film from the point of view of a countermeasure for acid rain. The coating material may be of the solvent type, aqueous type, powder type or any other various types. For the solvent type coating material or the aqueous type coating material, one-component coating material or two-component resin, e.g., a two-component urethane resin coating material may be used.

For the a glittering material not including noble metal or copper colloid particles, any of the following pigments is preferably used: aluminum flake pigment, colored aluminum flake pigment, an aluminum flake pigment coated with a metal oxide, a metal oxide-coated silica flake pigment, graphite pigment, interferential mica pigment, colored mica pigment, metallic titanium flake, stainless steel flake pigment, plate-like iron oxide pigment, phthalocyanine flake pigment, metal-plating glass flake pigment, a glass flake pigment coated with a metal oxide, and hologram pigment.

A dry film thickness of the glittering clear coating film is preferably 5 to 50 μm. If it is less than 5 μm, a glittering feeling with chroma can not sufficiently be developed. If it exceeds 50 μm, the coating film may have an unsatisfactory external appearance. Accordingly, the dry film thickness of the glittering clear coating film is more preferably within the range of 5 to 30 μm.

The top clear coating is preferably performed in a manner (1) that at least one layer of a top clear coating film is formed on the glittering base coating film preferably by a W/D method or in another manner (2) that a glittering clear coating film is coated over the glittering base coating film preferably by the W/D method, and if necessary, at least one layer of a top clear coating film is further formed preferably by a WAN method, and those films formed are simultaneously baked and hardened. In a case where the top clear coating material is applied plural times, it suffices that after the final coating of the top clear coating material is performed, the coating films formed are simultaneously baked, and there is no need of completely hardening the formed coating film(s) at an initial stage. Thus, a top clear coating film of the top clear coating material that is formed by the WAN method, together with the glittering base coating film and if necessary, the glittering clear coating film, is baked at a temperature of 80 to 180° C. for a predetermined time to thereby form a coating film.

<Second Embodiment>

[Glittering Coating Film with a Matting Clear Coating Film]

A glittering coating film of the present embodiment has a matting clear coating film in lieu of the top clear coating film in the first embodiment. In a preferred mode of the glittering coating film forming method of the embodiment, a glittering base coating film is formed on a substrate to be coated by using a noble metal or copper colloid particle liquid containing noble metal or copper colloid particles, and the glittering base coating film formed is heated or set, and then a matting clear coating film is formed by using a matting clear coating material.

In the embodiment, the glittering base coating material is applied to the substrate to be coated to thereby form a glittering base coating film, the resultant coating film is thermally cured or set, and then the matting clear coating film is thermally cured or set, whereby a glittering coating film is formed which has weathering resistance, and develops a metal feeling giving rise to a less feeling of metal particles than by the plating-tone coating film and a deep matte-feeling.

[Forming of a Matting Clear Coating Film]

In the glittering coating film forming method of the embodiment, at least one layer of a matting clear coating film is formed on the glittering base coating film.

The matting clear coating film is a clear coating film which contains a matting agent and does not hide the undercoating layer. As the result of forming the matting clear coating film on the glittering base coating film, the glittering coating film formed develops a metal feeling giving rise to a less feeling of metal particles than by the plating-tone coating film and a deep matte-feeling. The matting clear coating film is formed of the matting clear coating material, and this coating material contains a vehicle and a matting agent. The vehicle may be the one usually used for the overcoating. An example of it is a mixture of the cross-linking agent and at least one kind of thermosetting resin selected from among acrylic resin, polyester resin, fluororesin, epoxy resin, polyurethane resin, and polyether resin, and a modified resin thereof. A combination containing a carboxyl group-containing polymer and an epoxy group-containing polymer, disclosed in Japanese Patent Publication No. Hei 08-19315 is preferably used for the top clear coating film from the point of view of a countermeasure for acid rain.

A dry film thickness of the matting clear coating film is preferably 10 to 50 μm. If it is less than 10 μm, it is difficult to develop a deep matte-feeling. If it exceeds 50 μm, an unpleasant external appearance of the coating film may occur. Accordingly, the dry film thickness of the matting clear coating film is preferably within the range of 20 to 40 μm.

Various kinds of matting agents may be used for the matting agent used for matting clear coating material. It is preferably at least one kind of resin microparticle or one kind of inorganic microparticle. For the resin microparticle, those materials may be enumerated: acrylic resin, polyacrylonitrile, polyurethane, polyamide, polyimide, and the like. An average particle diameter of the resin microparticle is preferably 10 to 25 μm. If it is less than 10 μm, the matting clear coating film formed unsatisfactorily develops a deep matte-feeling, and gives a feel that is too smooth. If it exceeds 25 μm, a surface of the matting clear coating film is rough and gives a visual feel that is sandy.

The inorganic microparticle includes silica microparticle, clay, talc, mica, and the like. An average particle diameter of the inorganic microparticle is preferably 1 to 5 μm. If it is less than 1 μm, the matting clear coating film formed unsatisfactorily develops a deep matte-feeling, and gives a feel that is too smooth. If it exceeds 5 μm, a surface irregularity of the matting clear coating film is large, and the coating film visually gives a sandy feel. The resin microparticle and the inorganic microparticle may be used together. A mass formulation ratio of the inorganic microparticle to the resin microparticle is preferably 1:0.001 to 100, more preferably 1:0.1 to 10.

In the matting clear coating material, combination of several kinds of the resin microparticle and inorganic microparticle may be effective in design respect. It is preferred that the matting clear coating material contains 10 to 60 mass %, based on the solid content of the coating material, of the matting agent. If its content is less than 10 mass % (expressed in terms of solid), there is a fear that the film fails to develop a deep matte-feeling. If it exceeds 60 mass %, there is a fear that a strength of the coating film is insufficient. Accordingly, it is more preferable 20 to 50 mass % (in terms of solid).

The matting clear coating material may, if necessary, contain the color pigment, extender pigment, an additive agent, such as modifier, ultraviolet absorber, levelling agent, dispersing agent, and defoaming agent.

The matting clear coating material may be of the organic solvent type, the aqueous type or the powder type. The organic solvent type coating material and the aqueous type coating material may be of the one-component type or of the two-component type as of a two-component urethane resin coating material. Thus, a matting clear coating film formed by using the matting clear coating material is baked at a temperature from 120 to 160° C. for a predetermined time to thereby form a coating-film.

<Third Embodiment>

[Glittering Coating Film with a Top Color Clear Coating Film]

A glittering coating film of the embodiment includes a top color clear coating film in lieu of the top clear coating film of the first embodiment. Specifically, in a first mode of the glittering coating film forming method of the embodiment, a glittering base coating material, which contains a noble metal or copper colloid particle liquid containing noble metal or copper colloid particles is coated over a coated substrate on which an undercoating film is formed, to thereby form a glittering base coating film. Then, the glittering base coating film is heated or set and a top color clear coating film is formed by applying a color clear coating material thereto.

In a second mode of the glittering coating film forming method of the embodiment, a glittering base coating material, which contains a noble metal or copper colloid particle liquid containing noble metal or copper colloid particles is coated over a coated substrate on which an undercoating film is formed, to thereby form a glittering base coating film. Then, the glittering base coating film is heated or set. Then, a glittering clear coating film is formed thereon by applying thereto a glittering clear coating material containing a glittering material, which is different from said noble metal or copper colloid particles, and a top color clear coating film is formed by applying a color clear coating material on a glittering clear coating film.

In the embodiment, the glittering base coating material is applied to the coating substrate to form a glittering base coating film, and then the glittering base coating film is thermally cured or set. A top color clear coating film is formed, and then heated. As a result, a glittering coating film thus formed can be obtained which has weathering resistance and high gloss, and develops a coloring metal feeling giving rise to a less feeling of metal particles than by the plating-tone coating film. Then, a top color clear coating film is formed and heated, whereby a coloring glittering coating film can be formed which develops a high-grade coloring metal feeling in which a glittering feeling is enhanced by light rays that pass through the glittering clear coating film and are reflected by the glittering base coating film.

[Formation of a Top Color Clear Coating Film and a Glittering Clear Coating Film]

In a glittering coating film forming method of the embodiment, at least one layer of a top color clear coating film is formed on the glittering base coating film. Alternatively, at least one layer of a top clear coating film is formed on a coating film in which a glittering clear coating film is coated over the glittering base coating film.

The top color clear coating film does not hide the undercoating layer, and is a coloring and transparent clear coating film. "Such a range of the amounts of the color pigment as not to deteriorate a transparency of the coating film" is preferably 0.01–20% in terms of PWC, and a range of amounts of the color pigment within which one can recognize a boundary between a white area and a black area on a contrast ratio test paper at a predetermined dry film thickness of the coating film, although it varies depending on a kind of the color pigment. If PWC is less than 0.01%, there is fear that a coloring metal feeling cannot be produced. If PWC exceeds 20%, there is fear that a metal feeling cannot be produced. By forming a top color clear coating film on the glittering base coating film, coloring glittering feeling is produced and noble metal or copper colloid particles are protected. The top color clear coating film is formed by the top color clear coating material and this coating material contains vehicle and color pigments. The vehicle may be a material usually used for overcoating. For example, a mixture of at least one kind of thermosetting resin selected from acrylic resin, polyester resin, fluororesin, epoxy resin, polyurethane resin, and polyether resin, and a modified resin thereof, and the crosslinking agent stated above. A top color clear coating material containing a carboxyl group-containing polymer and an epoxy group-containing polymer, disclosed in Japanese Patent Publication No. Hei 08-19315 is preferably used for the top clear coating film from the point of view of a countermeasure for acid rain. The top color clear coating material may be of the solvent type, aqueous type, powder type or any other suitable type. For the solvent coating material or the aqueous coating material, one-component coating material or two-component resin, e.g., a two-component urethane resin coating material may be used.

Those top color coating pigments are as follows:

A) Organic Pigments:

Azo lake pigments, insoluble azoic organic pigments, condensed azoic pigments, phthalocyanine pigments, indigo pigments, perinone pigments, perylene pigments, phthalone pigments, dioxazine pigments, quinacridone pigments, isoindolinone pigments, metal complex pigment B) Inorganic Pigments:

Yellow iron oxide pigment, red iron oxide, carbon black, and titanium dioxide. If necessary, extender pigments, such as talc, calcium carbonate, precipitated barium sulfate, and silica, may be used together in addition to the above pigments.

The top color clear coating material may, if necessary, contain an additive agent, such as a modifier, an ultraviolet absorber, a levelling agent, a dispersing agent, and a defoaming agent. In this case, an amount of the additive agent is within such a range of the amounts of the additive agent as not to deteriorate a transparency of the top clear coating material.

A dry film thickness of the top color clear coating film is preferably 10 to 80 μm. If it is out of this range, there is a danger that the coating film may have a poor external appearance. The dry film thickness is more preferably 20 to 50 μm. In the glittering coating film forming method of the invention, at least one layer of the top color clear coating film is formed over a coating film that is formed by overcoating a glittering clear coating film over the glittering base coating film. A coloring glittering coating film can be formed which develops a high-grade coloring metal feeling in which a glittering feeling is enhanced by light rays that pass through the glittering clear coating film and are reflected by the glittering base coating film. A glittering clear coating film containing a glittering material not including noble metal or copper colloid particles is formed on the glittering base coating film after the glittering base coating film is thermally cured or set.

<Fourth Embodiment>

[Glittering Coating Film Using a Metal Mixed Colloid Particle Liquid Containing Two or More Kinds of Metals Selected from Noble Metal or Copper]

In the present embodiment, a glittering base coating film is formed by a glittering base coating material containing a metal mixed colloid particle liquid containing two or more kinds of metals selected from noble metal or copper in lieu of the glittering base coating material containing the noble or copper colloid particle liquid in the first embodiment. Specifically, in a first mode of the glittering coating film forming method of the embodiment, a glittering base coating film is formed on a substrate to be coated by applying thereto a glittering base coating material which contains a metal mixed colloid particle liquid containing metal colloid particles of at least two kinds of metals selected from noble metal or copper, for example, a mixed colloid particle liquid (referred also to "a gold-silver mixed colloid particle liquid") containing gold and silver colloid particles. The glittering base coating film is heated or set, and then a top color clear coating film is formed by applying a color clear coating material thereto.

In a second mode of the embodiment, a glittering base coating film is formed on a substrate to be coated by applying thereto a glittering base coating material which contains a metal mixed colloid particle liquid containing at least two kinds of metals selected from noble metal or copper. Then, the glittering base coating film is heated or set, and a glittering clear coating film is formed by applying a glittering clear coating material containing a glittering material being different from metal colloid particles of at least two kinds of metals selected from the noble metal or copper. Finally, a top color clear coating film or a top clear coating film is formed applying a color clear coating material or a clear coating material on the glittering clear coating film.

[Metal Mixed Colloid Glittering Base Coating Film Containing at Least Two Kinds of Metals Selected from Noble Metal or Copper]

A metal mixed colloid glittering base coating film containing at least two kinds of metals selected from noble metal or copper in the glittering coating film forming method of the embodiment is formed on the undercoating film or the intermediate coating film by a W/D method after the undercoating film or the intermediate coating film is formed. The glittering base coating film in the invention is formed by applying a glittering base coating material which contains a metal mixed colloid particle liquid containing at least two kinds of metals selected from noble metal or copper.

In a case where the metal mixed colloid particle liquid containing two or more kinds of metals selected from the noble metal or copper is a gold-silver mixed colloid particle liquid, for example, the liquid is a liquid where a gold colloid particle liquid is mixed with a silver colloid particle liquid, and a mass formulation ratio of the silver colloid particle to the gold colloid particle in the, gold-silver mixed colloid particle liquid is preferably 1/99 to 99/1. If the mass formulation ratio is out of this range, there is a fear that a glittering coating film cannot be produced has a metal feeling with gold and silver hues resulting from using together the gold and silver metals.

The metal mixed colloid particle liquid containing two or more kinds of metals selected from noble metal or copper may be prepared in a similar manner to that for forming the noble metal or copper colloid particles according to the first embodiment.

In a case where the metal mixed colloid particle liquid containing two or more kinds of metals selected from noble metal or copper contains a vehicle, a mass ratio of the solid content between the vehicle and the metal mixed colloid particle liquid is preferably 1/100 to 30/100. If it is less than 1/100, an insufficient weathering resistance is obtained, and there is a danger that adhesiveness to the glittering clear coating film as a coating film overcoated on the glittering base coating film or to the top clear coating film may lower If it exceeds 30/100, an insufficient metal feeling free from a metal particle feeling is possibly produced. Accordingly, it is more preferable that the mass ratio is selected to be within a range from 10/100 to 25/100.

The glittering base coating material containing the metal mixed colloid particle liquid containing two or more kinds of metals selected from the noble metal or copper is applied onto the coating substrate to form a glittering base coating film. Then, the formed glittering base coating film is thermally cured or set and a top color clear coating film is formed and heated. By the method, a glittering coating film thus formed can be obtained which has weathering resistance and high gloss, and develops a coloring metal feeling giving rise to a less feeling of metal particles than by the plating-tone coating film. Also, the glittering base coating material is applied to the coating substrate to form a glittering base coating film, and the formed coating film is thermally cured or set. Then, a glittering clear coating film is formed, and subsequently a top color clear coating film or a top clear coating film is formed and heated. A glittering coating film can be formed which develops a high-grade coloring metal feeling in which a glittering feeling is enhanced by light rays that pass through the glittering clear coating film and are reflected by the glittering base coating film. A method for applying the glittering base coating material containing the metal mixed colloid particle liquid containing two or more kinds of metals selected from the noble metal or copper is not limited to a specific one or ones in particular. A coating method similar to that for coating the glittering base coating film in the first embodiment may be used.

[Forming of Top Clear Coating Film, Top Color Clear Coating Film and Glittering Clear Coating Film]

In the glittering coating film forming method of the embodiment, at least one layer of a top color clear coating film is formed on the glittering base coating film, or at least one layer of a top color clear coating film is formed on a coating film that is formed by overcoating a glittering clear coating film on the glittering base coating film, or at least one layer of a top clear coating film is formed on a coating film that is formed by overcoating a glittering clear coating film on the glittering base coating film.

The top color clear coating film can be obtained by using a top color clear coating material similar to that in the third embodiment.

In the glittering coating film forming method of the embodiment, at least one layer of the top color clear coating film is formed on a coating film that is formed by overcoating a glittering clear coating film on the glittering base coating film. By the method, a glittering coating film can be formed which develops a high-grade coloring metal feeling in which a glittering feeling is enhanced by light rays that pass through the glittering clear coating film and are reflected by the glittering base coating film. The glittering clear coating film containing a glittering material not including noble metal or copper colloid particles of at least two kinds of metals selected from noble metal or copper, and it is formed on a glittering base coating film after the glittering base coating film is thermally cured or set.

The top clear coating film is formed by coating a clear coating material not including a color pigment contained in the top color clear coating film.

The glittering clear coating material containing a glittering material, which is different from the metal colloid particles of two or more kinds of metals selected from the noble metal or copper, may be of the solvent type, aqueous type, powder type or any other suitable type. For the solvent coating material or the aqueous coating material, one-component coating material or two-component resin, e.g., a two-component urethane resin coating material may be used.

The glittering material according to the first embodiment, which is different from the metal colloid particles of two or more kinds of metals selected from the noble metal or copper, may be of the bright pigments similar to that in the first embodiment.

<Fifth Embodiment>

[Glittering Coating Film Using an Undercoating Film of Which Solvent Swelling Ratio is within a Range from 0% to 5%]

In a preferable mode of a glittering coating film forming method of the present embodiment, a glittering base coating material, which contains a noble metal or copper colloid particle liquid containing noble metal or copper colloid particles is coated over a coating substrate on which an undercoating film of which solvent swelling ratio is within a range from 0% to 5% is formed, to thereby form a glittering base coating film. Then, the glittering base coating film is heated or set, and a clear coating film is formed thereon by any of the following processes (A) to (F) to thereby form a glittering coating film.

(A) a process of forming and heating a top clear coating film by applying a clear coating material thereto, and heating the formed top clear coating film;

(B) a process of forming and heating a glittering clear coating film by applying thereto a glittering clear coating material, and heating the resultant glittering clear coating film;

(C) a process of forming and heating a glittering clear coating film by applying thereto a glittering clear coating material, and then forming and heating a top clear coating film by applying a clear coating material thereto;

(D) a process of forming and heating a matting clear coating film by applying thereto a matting clear coating material;

(E) a process of forming and heating a top color clear coating film by applying thereto a color clear coating material; and (F) a process of forming and heating a glittering clear coating film by applying thereto a glittering clear coating material, and then forming and heating a top color clear coating film by applying a top color clear coating material thereto.

In the glittering coating film forming method of the embodiment, the undercoating film of which solvent swelling ratio is within a range from 0% to 5% is formed. In a case where the undercoating film and the glittering base coating film are formed in this order on the coating substrate, a solvent swelling ratio of the undercoating film is set to be within a range from 0% to 5%. In a case where the undercoating film, the intermediate coating film and the glittering base coating film are formed in this order on the coating substrate, a solvent swelling ratio of the intermediate coating film is set to be within a range from 0% to 5%.

In the embodiment, the solvent swelling ratio is a value calculated by using an equation 1 when an intermediate coating film of W1 gram is dipped into toluene as the solvent to be swelled, and a weight of it reaches W2 gram. When the solvent swelling ratio exceeds 5%, an amount of the glittering base coating film impregnated into the undercoating film is large, thereby unable to form a glittering coating film having a high grade metal feeling. In order to set the solvent swelling ratio to be within 0 to 5%, it suffices that a coating film crosslinking density of the undercoating film is set to be $1.1\times10^{-3}$ to $10\times10^{-3}$ mol/cc.

[Equation 1]

$$\text{Solvent swelling ratio}=[(W1+W2)/W1]\times100(\%) \quad (1)$$

In the embodiment, a coating film crosslinking density (n) can be calculated by using an equation 2, through a dynamic viscoelasticity measurement in which an undercoating film is used as a test piece, and a viscoelasticity of the test piece is measured while microvibrating the test piece. In the equation 2, E' is dynamic Young's modulus, R is gas constant, and T is absolute temperature. A coating film crosslinking density is adjusted by appropriately adjusting a formulation amount of the crosslinking agent (when the formulation amount of the crosslinking agent is large, its crosslinking density is high, and when it is small, its crosslinking density is low), a molecular weight of polyol (when its molecular weight is low, the crosslinking density is high, and when it is high, the crosslinking density is low), a functional group number in one molecule of polyol or crosslinking agent (when the functional group number is large, the crosslinking density is high, and when it is small, the crosslinking density is low), baking temperature (when the baking temperature is high, the crosslinking density high, and when it is low, the crosslinking density is low), and the like. If the coating film crosslinking density is increasingly adjusted to be within the range referred to above, the solvent swelling ratio is decreased, impregnation of the glittering base coating film into the undercoating film is lessened, so that a glittering coating film having a high grade metal feeling can be formed.

[Equation 2]

$$n=3RT/E' \quad (2)$$

A vehicle contained in the intermediate coating material used for forming the intermediate coating film mainly determines the coating film crosslinking density and the solvent swelling ratio, and it contains a coating film forming resin and a crosslinking agent. Acrylic resin, polyester resin, and alkyd resin are preferably used for the coating film forming resin.

In a preferred mode of the embodiment, the glittering base coating material is applied to the coating substrate to form a glittering base coating film, and the formed glittering base coating film is thermally cured or set, and then a top color clear coating film is formed thereon and heated. By the method, a glittering coating film can be obtained which has weathering resistance and high gloss, and develops a coloring metal feeling giving rise to a less feeling of metal particles than by the plating-tone coating film. In another mode of the embodiment, the glittering base coating material is applied to the coating substrate to form the glittering base coating film, and the formed glittering base coating film is thermally cured or set, and then a glittering clear coating film and a top color clear coating film are formed and heated. A glittering coating film can be formed which develops a high-grade coloring metal feeling in which a glittering feeling is enhanced by light rays that pass through the glittering clear coating film and are reflected by the glittering base coating film. In still another mode of the embodiment, the glittering base coating material is applied to the coating substrate to form the glittering base coating film, and the formed glittering base coating film is thermally cured or set, and then a glittering clear coating film and a top clear coating film are formed and heated. A glittering coating film can be formed which develops a high-grade metal feeling in which a glittering feeling is enhanced by light rays that pass through the glittering clear coating film and are reflected by the glittering base coating film. A method for applying the glittering base coating material is not limited to a specific one or ones in particular. A coating method similar to that for coating the glittering base coating film in the first embodiment may be used.

[Top Clear Coating Film, Top Color Clear Coating Film and Glittering Clear Coating Film]

In the glittering coating film forming method of the embodiment, at least one layer of a top color clear coating film is formed on the glittering base coating film, or at least one layer of a top color clear coating film is formed on a coating film that is formed by overcoating a glittering clear coating film on the glittering base coating film, or at least one layer of a top clear coating film is formed on a coating film that is formed by overcoating a glittering clear coating film on the glittering base coating film.

The top color clear coating film can be obtained by using a top color clear coating material similar to that in the third embodiment.

In the glittering coating film forming method of the embodiment, at least one layer of the top color clear coating film is formed over a coating film that is formed by overcoating a glittering clear coating film over the glittering base coating film. A glittering coating film can be formed which develops a high-grade coloring metal feeling in which a glittering feeling is enhanced by light rays that pass through the glittering clear coating film and are reflected by the glittering base coating film. The glittering clear coating film containing a glittering material not including noble metal or copper colloid particles is formed on the glittering base coating film after the glittering base coating film is thermally cured or set.

The top clear coating film can be formed by using a coating material similar to the top clear coating material in the first embodiment. The glittering clear coating film can be formed by using a coating material similar to the glittering clear coating material in the first embodiment.

<Sixth Embodiment>

[Glittering Base Coating Film Using a Composite Metal Colloid or a Mixed Metal Colloid]

In the present embodiment, a glittering base coating film is formed by using a glittering base coating material containing a composite metal colloid particle liquid or a mixed metal colloid particle liquid, while a glittering base coating film is formed by using a glittering base coating material containing noble metal or copper colloid particle liquid.

The formed glittering base coating film is heated or set, and then, a clear coating film is formed by executing any of the above-mentioned processes (A) to (F), to thereby form a glittering coating film. The glittering base coating material in the present embodiment is similar to the glittering base coating material in the first embodiment except that it uses the composite metal colloid particle liquid or the mixed metal colloid particle liquid in lieu of the noble metal or copper colloid particle liquid. A preferable undercoating film in the embodiment is that in the fifth embodiment.

The mixed metal colloid may be defined as a glittering base coating material containing a noble metal or copper colloid particle liquid, which further contains at least one kind of the following metals or its metal compound: nickel, bismuth, indium, cobalt, zinc, tungsten, chromium, iron, molybdenum, tantalum, manganese, tin, titanium, and aluminum. The mixed metal colloid may be formed by mixing the noble metal or copper colloid particles with the metal or the metal compound.

Examples of the metal compound are: metal salt, an organic acid compound, metallic soap, metal oxide, metal hydroxide, and organometallic complex. Examples of the organic metal complex are: alkyl complex, carbonyl complex, olefin complex, allyl complex, acetylacetonate complex, porphyrin complex and crown ether.

The term "composite metal colloid" is a metal colloid that is formed by compounding noble metal or copper colloid particles with at least one kind of metal selected from a group consisting of noble metal, copper, nickel, bismuth, indium, cobalt, zinc, tungsten, chromium, iron, molybdenum, tantalum, manganese, tin, and titanium.

An average particle diameter of the composite metal colloid particle in the embodiment is preferably 5 to 100 nm, more preferably 10 to 50 nm. It is difficult to manufacture the composite metal colloid particle of which the average particle diameter is less than 5 nm. Further, the coating film using the composite metal colloid particle of such an average particle diameter unsatisfactorily develop design properties. If the particle average diameter exceeds 100 nm, a problem may occur in a particle stability.

In the embodiment, the term "to compound" means "to form colloid particles by using two or more kinds of metals". In the colloid particles of the composite metal colloid may be classified into: 1) colloid particles of a type having a called core-shell structure in which two kinds of metals are used, and one metal covers the other metal; 2) colloid particles of another type having a structure that two metals are alloyed in one colloid particle; and 3) a mixture of the colloid particles of the types 1) and 2). Similarly, applies to a case where three or more kinds of metals are used in the colloid particles of the composite metal colloid may be classified into: 1) colloid particles of a type having a multiple core-shell structure, 2) colloid particles of another type having a structure that three or more kinds of metals are alloyed in one colloid particle, and 3) a mixture of the colloid particles of the types 1) and 2).

An example of the colloid particles of the type having the core-shell structure where one metal covers the other metal in the case of using two kinds of metals is a composite metal colloid containing gold, silver and copper, disclosed in Japanese Patent Application Laid-Open No. 2004-256915. In the description of the publication, a composite metal colloid liquid is formed by reducing a second metal compound in a first metal colloid liquid containing a polymeric pigment dispersing agent. The first metal colloid liquid can be obtained in a manner that a first metal compound is reduced in the presence of the polymeric pigment dispersing agent. From a design point of view, it is preferable that when the first metal and second metal are selected from a group of gold, silver and copper, and the first metal is gold, the second metal is silver or copper, and when the first metal is silver, the second metal is gold.

In the composite metal colloid particle of the invention, a liquid containing particles of the type having a structure that two kinds of metals are used, and two metals is alloyed in one colloid particle (the particles will be referred to as nano-sized alloy particles, and such a liquid will be referred to as a nano-sized alloy particle-containing liquid), can be manufactured in a manner that metal hydroxides are deposited from a two-kind metal liquid containing metal M1 ions and metal M2 ions in the presence of a polymeric pigment dispersing agent, and then are reduced.

In the method of manufacturing the nano-sized alloy particle-containing liquid, preferably the metal hydroxides contain only one of the two metals M1 and M2.

In the method of manufacturing the nano-sized alloy particle-containing liquid, the metal hydroxides are preferably a composite hydroxide or a composite oxide containing both of the two metals M1 and M2.

In the method of manufacturing the nano-sized alloy particle-containing liquid, the term "alloy" means two kinds of metals which have been in a mixed state in micro level, such as in layer, granule or amorphous state, from in an atomic level. In a "mixed material", it is estimated that the material has a structure that the material is not entirely uniform in state, or varies from part to part such that some parts of the material are dominantly in the layer state, and other parts are in the amorphous state.

The method of manufacturing the nano-sized alloy particle-containing liquid includes a process for depositing metal hydroxides from a two-kind metal liquid containing the two metals M1 and M2 in the presence of polymeric pigment dispersing agent, and reducing the deposited one.

The polymeric pigment dispersing agent to which a functional group having a high affinity for a pigment surface of a high molecular weight polymer is introduced, is an amphiphilic copolymer having a structure including a solvent-affinity part, and is usually used as a pigment dispersing agent in a manufacturing stage of pigment paste.

It is considered that the polymeric pigment dispersing agent functions to stabilize a dispersion of the nano-sized alloy particles in the solvent during and after generation of those particles. A number-average molecular weight of the polymeric pigment dispersing agent is preferably 1000 to 1000000. If it is less than 1000, an insufficient dispersion stability possibly occurs. If it exceeds 1000000, viscosity become too high and difficult in handling may occur. More preferably, it is 2000 to 500000, and much more preferably it is 4000 to 500000.

The polymeric pigment dispersing agent may be any kind of polymeric pigment dispersing agent so long as having the properties mentioned above. Examples of such polymeric pigment dispersing agents are as referred to in Japanese Patent Application Laid-Open No. Hei 11-80647. Various kinds of polymeric pigment dispersing agents can be used, and those commercially available can be used as a matter of course. The polymeric pigment dispersing agent well compatible with a type of nano-sized alloy particle-containing liquid to be manufactured may be selected. When the solvent is aqueous, a polar polymeric pigment dispersing agent is selected, and when the solvent is non-polar, a non-polar polymeric pigment dispersing agent is selected accordingly.

The polar polymeric pigment dispersing agent is commercially available. Examples of the dispersing agent are:

1) Manufactured by BYK-Chemie GmbH)
Disperbyk R, Disperbyk 154, Disperbyk, 180, Disperbyk 187, Disperbyk 184, Disperbyk 190, Disperbyk 191, and Disperbyk 192 (all of those are trade names)

2) Manufactured by Lubrizol Corporation
SOLSPERSE 20000, SOLSPERSE 27000, SOLSPERSE 12000, SOLSPERSE 40000, SOLSPERSE 41090, and SOLSPERSE HPA34 (all of those are trade names)

3) Manufactured by EFKA Additives B.V.
EFKA-450, EFKA-451, EFKA-452, EFKA-453, EFKA-4540, EFKA-4550, EFKA-1501, and EFKA-1502 (all of those are trade names)

4) Manufactured by Kyoeisha Chemical Co., Ltd.
FLOWLEN TG-720W, FLOWLEN TG-730W, FLOWLEN TG-740W, AND FLOWLEN TG-745W, FLOWLEN TG-750W, FLOWLEN G-700DMEA, FLOWLEN G-WK-10, and FLOWLEN G-WK-13E (all of those are trade names)

5) Manufactured by Elementis PLC
DISPERAID W-30, and DISPERAID W-39 (those are trade names)

6) Manufactured by King Corporation
K-SPERSE XM2311 (trade name)

7) Manufactured by ZENECA Limited
Neolets BT-24 and Neolets BT-175 (trade names)

8) Manufactured by Atochem Corporation
SMA1440H (trade name)

9) Manufactured by Rohm & Haas Company
Orotan 731DP and Orotan 963 (trade names)

10) Manufactured by Yoneyama Chemical Industry Co., Ltd.
YONERIN (trade name)

11) Manufactured by Sanyo Chemical Industries, Ltd.
SANSPER PS-2 (trade name)

11) Manufactured by Union Carbide Corporation
TRYTON CF-10 (trade name)

12 Manufactured by Johnson Polymer Corporation)
JONCRYL 678, JONCRYL 679, JONCRYL683, JONCRYL 611, JONCRYL 680, JONCRYL 682, JONCRYL 52, JONCRYL 57, JONCRYL 60, JONCRYL 63, JONCRYL 70, JONCRYLHPD-71, and JONCRYL 62 (trade names)

12) Manufactured by Air Products and Chemicals, Inc.
Surfynol CT-111 (trade name)

The nonpolar polymeric pigment dispersing agents commercially available are:

1) Available from BYK-Chemie GmbH;
Disperbyk 110, DisperbykLP-6347, Disperbyk 170, Disperbyk 171, Disperbyk 174, Disperbyk 161, Disperbyk 166, Disperbyk 182, Disperbyk 183, Disperbyk 185, Disperbyk 2000, Disperbyk 2001, Disperbyk 2050, Disperbyk 2150, and Disperbyk 2070 (trade names)

2) Available from Lubrizol Corporation;
SOLSPERSE 24000, SOLSPERSE 28000, SOLSPERSE 32500, SOLSPERSE 32550, SOLSPERSE 31845, SOLSPERSE 26000, SOLSPERSE 36600, SOLSPERSE 37500, SOLSPERSE 35100, and SOLSPERSE 38500 (trade names)

3) Available from EFKA Additives B.V.;
EFKA-46, EFKA-47, EFKA-48, EFKA-4050, EFKA-4055, EFKA-4009, EFKA-4010, EFKA-400, EFKA-401, EFKA-402, and EFKA-403 ((trade names)

4) Available from Kyoeisha Chemical Co., Ltd.;
FLOWLEN DOPA-15B, FLOWLEN DOPA-17, and FLOWLEN DOPA-22 (trade names)

5) Available from Kusumoto Chemicals, Ltd.;
DISPARLON 2150 and DISPARLON1210 (trade names)

In the method of manufacturing the organic liquid containing nano-sized alloy particles, a metal M1 of the two kinds of metals to be nano-sized alloy particles is the noble metal or copper. A metal M2 is not limited to a specific one or ones in particular. Examples of the metal M2 are: gold, silver, platinum, palladium, iridium, rhodium, osmium, ruthenium, copper, nickel, bismuth, indium, cobalt, zinc, tungsten, chromium, iron, molybdenum, tantalum, manganese, tin, and titanium, etc.

The two metals liquid is obtained by dissolving a metal compound containing the metals M1 and M2 into a solvent to be described later. The metal compound containing the metals M1 and M2 may be any metal compound if it can be dissolved into the solvent, and in this state, is capable of generating metal M1 ions and metal M2 ions. Examples of the metal compound are: when the metal is gold, tetrachloroaurate (III) tetra-hydrate (chlorauric acid), when the metal is silver, silver nitrate, silver acetate, silver (IV) perchlorate, when the metal is platinum, hexachloro platinic (IV) acid hexa-hydrate (chloroplatinic acid), potassium chloroplatinate, when the metal is palladium, palladium (II) chloride di-hydrate, when the metal is rhodium, rhodium (III) trichloride trihydrate, when the metal is copper, copper (II) chloride di-hydrate, copper (II) acetate mono-hydrate, and copper (II) sulfate.

When the metal is nickel, examples of the metal compound are given below:

A) Halogenation Product;

Nickel (II) chloride, nickel (II) chloride hexahydrate, nickel (II) bromide, nickel (II) fluoride tetra-hydrate, nickel (II) iodide n-hydrate, etc.

B) Mineral Acid Compound;

Nickel (II) nitrate hexahydrate, nickel (II) perchlorate hexahydrate, nickel (II) sulfate hexahydrate, nickel (II) phosphate n-hydrate, basic nickel (II) carbonate, etc.

C) Nickel Inorganic Acid Compound;

Nickel (II) hydroxide, nickel (II) oxide, nickel (III) hydroxide, etc.

D) Nickel Organic Acid Compound,

Nickel (II) acetate tetra-hydrate, nickel (II) lactate, nickel (II) oxalate di-hydrate, nickel (II) tartaric acid trihydrate, citric acid nickel (II) n-hydrate, etc.

The nickel organic acid compound can be prepared from, for example, basic nickel carbonate and organic acid. Of those materials, nickel (II) acetate tetra-hydrate, nickel (II) chloride hexahydrate, and nickel (II) nitrate hexahydrate, having high solubility are preferably used.

When the metal is bismuth, examples of the metal compound are: Such inorganic bismuth-containing compound as bismuth chloride, bismuth oxychloride, bismuth bromide, bismuth silicate, bismuth hydroxide, bismuth trioxide, bismuth nitrate, bismuth subnitrate, bismuth oxycarbonate, etc., and further bismuth lactate, triphenyl bismuth, bismuth gallate, bismuth benzoate, bismuth citrate, bismuth methoxyacetic acid, bismuth acetate, bismuth formic acid, 2,2-bismuth dimethylolpropionic acid, etc., and additionally organic bismuth-containing compound, e.g., organic acid-modified bismuth, that can be manufactured by mixing and dispersing (basic) bismuth compound, such as bismuth oxide, bismuth hydroxide, and basic bismuth carbonate, and organic acid in an aqueous medium (see International Publication WO99/31187). Of those materials, when water is contained as a solvent, Bismuth chloride and bismuth nitrate are preferable from the point of view of the solubility to water.

Examples of the metal mentioned above and examples of metal compounds for each metal example are listed below:

Indium: Indium (III) chloride, indium (III) nitrate trihydrate, indium (I) iodide Cobalt: Cobalt (II) chloride hexahydrate, cobalt (II) acetate tetrahydrate, cobalt (II) perchlorate hexahydrate, cobalt (II) nitrate hexahydrate Zinc: Zinc (II) chloride, zinc (II) acetate di-hydrate, zinc (II) nitrate hexahydrate Tungsten: Sodium tungstate (IV) dihydrate, tungstic acid anhydride, tungstic acid Chromium: Chromium (II) chloride, chromium (III) chloride hexahydrate, chromium (III) nitrate enneahydrate Iron Iron (II) chloride tetrahydrate, iron (III) chloride hexahydrate, iron (III) nitrate enneahydrate, Iron (II) perchlorate hexahydrate Molybdenum: Sodium molybdate (VI) dihydrate, molybdic acid, molybdenum chloride Tantalum: Sodium tantalate (v), tantalate (v) chloride Manganese: Manganese (II) chloride tetrahydrate, manganese (II) acetate tetrahydrate, manganese (III) acetate dihydrate, manganese (II) acetate hexahydrate Tin: Tin (II) acetate, tin (II) chloride dihydrate In the method of manufacturing the nano-sized alloy particle-containing liquid, the nano-sized alloy particle-containing liquid can be prepared by using two kinds of metals that are selected in combination appropriately, not randomly. Specific combinations of the metals M1 and M2, which are effective for preparing the nano-sized alloy particle-containing liquid, will be described.

The ions of the metals mentioned above, for example, gold, silver, platinum, palladium, iridium, rhodium, osmium, ruthenium, copper, nickel, bismuth, and tin are metal ions generated in a manner that metal hydroxides are deposited by using a reducing agent in the presence of the polymeric pigment dispersing agent, and are reduced into metal (Those metal ions will be referred as "single reducing metal ions".). When such a metal ion is used for the metal M1 ion, the metal M2 ion is a single reducing metal ion of a metal different from the metal M1.

Of the single reducing metal ions, the ions of silver, platinum, palladium, iridium, rhodium, osmium, ruthenium, nickel, and cobalt operate such that the reduced metal functions as a catalyst in another reducing reaction (Those metal ions will be referred to as "single reducing/catalysting metal ions".). Silver, palladium and nickel ions among single reducing/catalysting metal ions have an especially excellent catalyst capability in the reducing reaction.

When the metal M1 ion is the single reducing/catalysting metal ion, the metal M2 ion may be the single reducing metal ion, and additionally the ions of indium, cobalt, zinc, tungsten, chromium, iron, molybdenum, tantalum, manganese, and titanium (Those metal ions will be referred to as other metal ions.).

Metal compounds (the metal compounds stated above) as sources for the metal M1 ion and the metal M2 ion, which are contained in the two-kind metal liquid are preferably used such that a metal molarity ratio (the total amount of the metals M1 and M2) is 0.01mol/l or higher in the two-kind metal liquid. If it is less than 0.01 mol/l, a metal molarity in the nano-sized alloy particle-containing liquid is too low, and no adequate efficiency can be expected. Preferabaly, it is 0.05 mol/l or higher, and more preferably 0.1 mol/l or higher.

The solvent in the two-kind metal liquid may be any kind of solvent if it is able to dissolve the metal compound. For example, water and organic solvent may be enumerated for the solvent. Examples of the organic solvent are 1-4 C alcohol, such as ethanol and ethylene glycol, ketones, e.g., acetone, and esters, e.g., ethyl acetate. Any of these may be used alone or in combination of two or more kinds. In a case where the solvent is a mixture of water and organic solvent, the organic solvent is preferably of the water soluble type. Examples of such a solvent are acetone, methanol, ethanol, and ethylene glycol.

An amount of the polymeric pigment dispersing agent is 90 mass % or less to the total amount of the metal (the total amount of the metals M1 and M2) in the metal compound and the polymeric pigment dispersing agent. If it exceeds 90 mass %, the effect for its increase cannot be expected. More preferably, it is 60 mass % or less, and much more preferably it is 40 mass % or less.

In the method of manufacturing the nano-sized alloy particle-containing liquid, a precipitant is added to the two-kind metal liquid thus prepared to cause metal hydroxides to be deposited. The metal hydroxides mean metal hydroxides, metallic oxyhydroxide, metal oxide, and a mixture of them, and their structure changes depending on the kinds of the metals M1 and M2 used.

When the metals M1 and M2 ions are both single reducing metal ions, addition of a precipitant to the liquid causes metal hydroxides containing the metals M1 and M2 to be deposited. When the metal M1 ion is the single reducing/catalysting metal ions and the metal M2 is another ion, metal hydroxides containing only the metal M1 is deposited.

A basic compound is used for the precipitant. It is estimated that by making the reaction system basic, the metal hydroxides that is hard to be dissolved into the solvent is produced. Examples of the precipitant are alkali metal hydroxides such as sodium hydroxide and potassium hydroxide, basic alkali metal salt such as sodium bicarbonate and sodium carbonate, and a water soluble organic base compound, such as amine, guanidine, and imidazole. From those substances, an appropriate one is selected according to the metals M1 and M2 being used. Especially aliphatic amine having a reducing operation is preferably used for the precipitant. An amount of the precipitant added is 0.1 to 10 times as high as a normality of metal salt to be precipitated.

In the method of manufacturing the nano-sized alloy particle-containing liquid, reduction is carried out in a state that the metal hydroxides are deposited. The reduction is carried out by adding a reducing agent. As already described, when the precipitation is the metal hydroxides containing the metals M1 and M2, nano-sized alloy particles are produced by reducing the precipitation. When the metal M1 ion is the single reducing/catalysting metal ion, and metal hydroxides containing only the metal M1 are deposited, nano-sized particles of the metal M1 are produced, and the metal M2 ions are reduced by reducing/catalyzing actions on the particle surfaces to thereby produce nano-sized alloy particles. This will be readily understood that under the same conditions as those under which the nano-sized particles are produced, the nano-sized alloy particles cannot be produced by using the metal M2 ion alone. Such an example is a combination of silver for the metal M1 and palladium for the metal M2.

Also when the metal M1 ion is the single reducing/catalysting metal ion, and the metal M2 ion is the single reducing metal ion, it is estimated that the reducing/catalyzing actions operate. Examples of such a case are a combination of silver for the metal M1 and nickel or bismuth for the metal M2 and another combination of a nickel for the metal M1 and cobalt for the metal M2.

Example of the reducing agent is an amine. When the amine is used, the metal compound can be reduced at a reaction temperature of about 5 to 100° C., preferably 20 to 80° C. without using heating or a specially designed light irradiation device.

The amine may be used which is used for manufacturing the noble metal or copper colloid particle liquid in the first embodiment.

In addition to amine, the following chemical substances may be enumerated for the reducing agent: alkali metal borohydride salt having been used as a reducing agent, e.g., sodium borohydride and lithium borohydride; hydrazine compound, e.g., hydrazine and hydrazine carbonate; hydroxylamine; citric acid; tartaric acid; malic acid; ascorbic acid; formic acid; formaldehyde; and sulfoxylate derivative, such as dithionous acid, sodium formaldehyde sulfoxylate (called rongalite) as a derivative of dithionous acid, dithionite, e.g., zinc formaldehydesulfoxylate. Additional examples of the reducing agent are thiourea dioxide, sodium aluminum hydride, dimethylamine-borane, hypophosphorous acid, and hydrosulfite. Those chemical substances may be used as a single substance or in combination with the amine. When the amine is combined with citric acid, tartaric acid, or ascorbic acid, it is preferable to use citric acid, tartaric acid, and or ascorbic acid as its salt. When citric acid or sulfoxylate derivative is combined with iron (II) ion, a reduction ability is improved. When another reducing agent than amine is used, it is preferable that the reducing agent used has a reducing power that is higher than that of amine, if necessary. Of those reducing agents having a higher reducing power than that of amine, sodium formaldehyde sulfoxylate (Rongalite) and hydrazine carbonate are preferable from safety and reaction efficiency points of view. From those reducing agents, appropriate ones are selected and combined in use.

An addition amount of the reducing agent is an amount of the reducing agent necessary for reducing the metal M1 ion and the metal M2 ion contained in the two-kind metal liquid or higher than its value. If it is less than the necessary amount, unsatisfactory reduction may be carried out. The upper limit of the necessary amount of the reducing agent is not limited in particular. However, it is preferably less than 30 times as low as the amount of the reducing agent necessary for reducing the metal M1 ion and the metal M2 ion contained in the metal liquid. More preferably, it is 10 times or lower. Another reducing method than the reducing method by adding the reducing agent may be used. An example of it is to irradiate the liquid with light by using a high-pressure mercury lamp.

Reducing agent adding methods follow. When the reducing reaction follows the deposition of the metal hydroxides containing the metal M1 iron and the metal M2, an reducing agent is added to a liquid prepared by dissolving a compound containing the metal M1, and a compound containing the metal M2 and a polymeric pigment dispersing agent. Alternatively, a liquid into which a compound containing the metal M1 and a compound containing the metal M2 are dissolved is added to a liquid into which a polymeric pigment dispersing agent and a reducing agent are dissolved. In another method, a polymeric pigment dispersing agent and a reducing agent are mixed in advance. The resultant mixture is added into a liquid into which a compound containing the metal M1 and a compound containing the metal M2 are dissolved. Incidentally, in manufacturing the nano-sized alloy particle-containing liquid, no problem arises if the mixture of the compounds containing the metals M1 and M2 and the polymeric pigment dispersing agent is turbid.

A further reducing agent adding method follows. The deposited metal hydroxides contain only one of the two metals M1 and M2, a liquid into which a compound containing the metal M1 is dissolved is added to a liquid into which a compound containing the metal M2, a polymeric pigment dispersing agent and a reducing agent are dissolved.

Deposition of the metal hydroxides and reduction reaction progress through the above process. As a result, nano-sized alloy particles of which average particle diameter is approximately 5 nm to 100 nm are produced. The liquid having undergone the process contains the nano-sized alloy particles and the polymeric pigment dispersing agent, that is, it is a nano-sized alloy particle-containing liquid. The nano-sized alloy particle-containing liquid is such that ultra fine particles containing the metals M1 and M2 is dispersed in the solvent, and it can visually be recognized as liquid. A metal concentration of the nano-sized alloy particle-containing liquid can be determined through a measurement by TG-DTA, and in case when measurement is not taken, the value derived from formulated amount used in preparation may be used The nano-sized alloy particle-containing liquid contains the nano-sized alloy particles and the polymeric pigment dispersing agent, and further miscellaneous ions, e.g., chloride ion originating from a raw material, salt produced through the reduction, and a reducing agent sometimes. It is desirable to remove the salt and the reducing agent by using the ultrafiltering process since those may adversely affect a stability of the nano-sized alloy particle-containing liquid. Ultrafiltering the nano-sized alloy particle-containing liquid removes the miscellaneous ions, salt, and the reducing agent in the nano-sized alloy particle-containing liquid, and additionally part of the polymeric pigment dispersing agent.

Usually, the ultrafiltering process is effective for substances having an average particle diameter of 1 nm to 5 μm, which are to be separated. Such an ultrafiltering process can remove the unnecessary miscellaneous ions, salt and reducing agent, and further the polymeric pigment dispersing agent. If the average particle diameter is less than 1 nm, sometimes the unnecessary substances cannot pass through the filter film and the ultrafiltering may fail in the removal of those substances. If it exceeds 5 μm, most of the nano-sized alloy particles pass through the filter film, and a desired nano-sized alloy particle-containing liquid may not be formed.

The ultrafiltering process is not limited in particular. The ultrafiltering process used in manufacturing the noble or copper colloid particle liquid may be used in the first embodiment.

The miscellaneous ion and the reducing agent are removed from the nano-sized alloy particle-containing liquid by the ultrafiltering process. Since part of the polymeric pigment dispersing agent is also removed in the ultrafiltering process, a concentration of the nano-sized alloy particles in a solid content in the nano-sized alloy particle-containing liquid is increased above than that before the ultrafiltering process is carried out. A centrifugation process, in lieu of the ultrafiltering process, may be used in order to remove the miscellaneous ions and the reducing agent. Also in this case, the nano-sized alloy particles concentration can be increased above than that before the process is carried out.

In another removal process other than the ultrafiltering process and the centrifugal process, a transparent and colorless supernatant liquid is removed by the decantation, and water is added to clean the nano-sized alloy particle-containing liquid, whereby the miscellaneous ions and the reducing agent are removed. An oily substance thus obtained contains the solvent used for the reaction, e.g., water. Accordingly, the substance is highly soluble to water. By adding methanol or ethanol being highly soluble to water and highly volatile and toluene forming an azeotrope with the water and drying, sol-like nano-sized alloy particles and a polymeric pigment dispersing agent are first obtained. Then, an organic solvent is added to them to dissolve, whereby a nano-sized alloy particle-containing liquid is obtained.

A glittering base coating film was formed at a dry film thickness of 0.05 to 0.5 μm by using the thus prepared glittering base coating material containing a composite metal colloid particle liquid or a mixed metal colloid particle liquid of the embodiment. A glittering base coating film formed by using a glittering base coating material of the embodiment has excellent design properties than cannot be obtained by other materials. When comparing with a glittering base coating film formed from a noble metal colloid liquid containing one kind of metal, the glittering base coating film of the embodiment has a color development based on the plasmon absorption. Further, the color developed by the coating film varies according to a view angle in the form of partial gloss and transmitted color.

<Seventh Embodiment>

[Glittering Base Coating Film Formed by a Coating Film Forming Resin Using a Phosphoric-Acid-Group-Containing Monomer]

In forming a glittering base coating film in any of the first to fourth embodiments and the sixth embodiment, after a glittering base coating film is formed by using a glittering base coating material using a phosphoric-acid-group-containing monomer as a coating film forming resin for a glittering base coating material, the resultant glittering base coating film is heated or set. Subsequently, a clear coating film is formed by executing any of the above-mentioned processes (A) to (F), whereby a glittering coating film is formed. For a preferable undercoating film, the glittering coating film formed in the fifth embodiment may be used. A specific example of the phosphoric-acid-group-containing monomer is given by the following general formula (I)

[Formula 1]

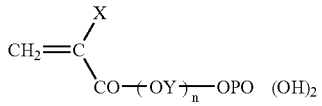

(I)

In the above formula, X: hydrogen atom or methyl group; Y: 2-4 C alkylene group; and n: integer of 3 to 30. A phosphoric-acid-group-containing acrylic resin is preferably used which is formed by copolymerizing the phosphoric-acid-group-containing monomer (1) and an ethylenically unsaturated monomer (2).

A number-average molecular weight of a phosphoric-acid-group-containing acrylic resin is preferably 1000 to 50000, more preferably 2000 to 20000. If the number-average molecular weight is less than 1000, hardenability of the resin degrades. If it exceeds 50000, its viscosity increases, resulting in difficult handling. An acid value of the resin is preferably 15 to 200 mgKOH/g, more preferably 30 to 180 mgKOH/g. Particularly, in the 15 to 200 mgKOH/g acid values, the acid value derived from the phosphate group ranges preferably from 10 to 150 mgKOH/g. More preferably, it is 15 to 100 mgKOH/g. The remaining acid value is preferably derived from a carboxylic acid group. If the acid value is less than 15 mgKOH/g, an unsatisfactory dispersing property is secured. If it exceeds 200 mgKOH/g, water resistance of the resin degrades sometimes. If an acid value of the phosphate group exceeds 150 mgKOH/g, the water resistance of the resin degrades. If it is less than 10, a secondary adhesiveness of the resin is not improved.

A hydroxy value of the resin is preferably 20 o 200, more preferably 30 to 150. If it is less than 20, its hardening is insufficient. If it exceeds 200, its hydrophilic group is much large, and problem arises in water resistance property.

The monomer contained in the phosphoric-acid-group-containing acrylic resin can readily be synthesized in a known method. In an exemplar synthesizing method, alkylene oxide is added to (metha) acrylic acid to be alkoxypolyalkylene glycol monoester. Subsequently, it is reacted with oxyphosphochloride to monoesterify phosphoric acid, and then the resultant product is hydrolyzed. Also when orthophosphoric acid, metaphosphoric acid, phosphoric anhydride, phosphorus trichloride, phosphorus pentachloride or the like is used in place of oxyphosphochloride, the monomer can be synthesized in a routine procedure.

In the addition reaction, a use amount of alkylene oxide may be n mol in a stoichiometric amount according to "n" in the formula (I). A specific example of its use amount is 3 to 60 mols to 1 mol of (metha) acrylic acid. The alkylene oxide has the carbon number of 2 to 4. Specifically, ethylene oxide, propylene oxide, and butylene oxide may be enumerated. A potassium hydroxide and sodium hydroxide are enumerated for the catalyst.

The solvent may be n-methyl pyrrolidine. In the reaction, a reaction temperature is in a range of 40 to 200° C., and a reaction time is in a range of 0.5 to 5 hours. Following the addition reaction, oxyphosphochloride is monoesterified. A routine procedure may be used for the monoesterifying process. In a specific example, the monoesterifying process is carried out at 0 to 100° C. for 0.5 to 5 hours. A use amount of the oxyphosphochloride may be a stoichiometric amount. In an example, it is 1 to 3 mols for 1 mol of the addition product. Subsequently, the resultant is hydrolyzed to produce a monomer (1).

A specific example of the monomer (1) is acidphosphorichexa (or dodeca) (oxypropylene) monomethacrylate. Another ethylene unsaturated monomer (2) is a monomer other than the monomer (1) and is an ethylenic monomer that is copolymerizable with the monomer (1). The obtained copolymer, i.e., phosphoric acid group-containing acrylic resin, can be cured by the curing agent. An example of such a monomer (2) is a monomer in which an acid group and a hydroxyl group are present in a molecule. Another example of it is a monomer consisting of a monomer mixture in which monomer species contain respectively their own groups.

An acid group of an ethylenic monomer having an group radial may be a carboxyl group or a sulfonic acid group. For examples of the ethylenic monomer having a carboxyl group, the following acids may be enumerated: acrylic acid, methacrylic acid, crotonic acid, etha-acrylic acid, proopyl acrylic acid, isoproopyl acrylic acid, Itaconic acid, maleic anhydride, and fumaric acids. The ethylenic monomer having a sulphonic acid may be a t-butyl acrylamide sulphonic acid. A part of the ethylenic monomer having an acid group is preferably a carboxyl group.

Examples of the ethylenic monomer having a hydroxyl group, the following substances may be enumerated: acrylic acid hydroxyethyl, acrylic acid hydroxypropyl, acrylic acid hydroxybutyl, methacrylic acid hydroxymethyl, methacrylic acid hydroxyethyl, methacrylic acid hydroxypropyl, methacrylic acid hydroxybutyl, and allyl alcohol Examples of ethylenic monomers other than those state above are: acrylic acid alkyl ester (methyl acrylate, ethyl acrylate, isopropyl acrylate, n-propyl acrylate, n-butyl acrylate, t-butyl acrylate, 2-ethylhexyl acrylate, n-octyl acrylate, lauryl acrylatek, etc.), alkylester methacrylate methacrylate (methyl methacrylate, ethyl methacrylate, isopropyl methacrylate, ethyl methacrylate, isopropyl methacrylate, n-propyl methacrylate, n-butyl methacrylate, isobutyl methacrylate, t-butyl methacrylate, 2-ethylhexyl methacrylate, n-octyl methacrylate, lauryl methacrylate, stearyl methacrylate, tridecyl methacrylate, etc.), styrene, α-Methylstyrene, o-Methylstyrene, m-Methylstyrene, p-Methylstyrene, p-tert-butylstyrene, benzyl acrylates, benzyl methacrylate, itaconic acid ester (itaconic acid dimethyl, etc,), maleic ester (maleic dimethyl, etc.), fumaric acid ester (fumaric acid dimethyl, etc.), acrylonitrile, methacrylonitrile, vinyl acetate, etc.

The monomers (1) and (2) are copolymerized in an ordinary method to form a phosphoric-acid-group-containing acrylic resin. Each monomer mixture is admixed to a known polymerization initiator (e.g., azobisisoblutyronitrile), and the resultant is dripped into a Kolben containing a solvent, which has been heated to a polymerizable temperature, and subject to aging, whereby a copolymer is formed.

In the polymerization reaction composition, an amount of the monomer (2) to be added is preferably within a range of 65 to 98 wt. %. If it is less than 65 wt. %, water resistance is poor and if it exceeds 98 wt. %, no effect by the phosphoric acid group is produced. Polymerization conditions are appropriately selected. In an example of such conditions, a polymerization temperature is 80 to 150° C., and a polymerization time is 1 to 8 hours.

The phosphoric-acid-group-containing acrylic resin (solid) to be added in the embodiment is preferably 30 to 100 pts. mass based on 100 pts. mass of the coating film forming resin in solid content. More preferably, it is 50 to 100 pts. mass. If the phosphoric-acid-group-containing acrylic resin to be added is less than 30 pts. mass, there is a risk that the corrosion resistance and water resistance of the glittering base coating film degrade, and its adhesiveness to the undercoating film lowers. If it exceeds 100 pts. mass, the color properties of the coating film may adversely be affected.

<Eighth Embodiment>

[Glittering Base Coating Film Containing a Deposition Metal Pigment]

In the present embodiment, a deposition metal pigment is additionally added to the glittering base coating material used for forming a glittering base coating film in each of the first to fourth embodiments, and sixth and seventh embodiments. After a glittering base coating film is formed by applying a glittering base coating material further containing the deposition metal pigment, the formed glittering base coating film is heated or set, and then a clear coating film is formed by executing any of the processes (A) to (F) stated above, whereby a glittering coating film is formed. A preferable undercoating film is that in the fifth embodiment.

A deposition metal pigment used in the embodiment is formed in a manner that a metal thin film is formed on a base film by vapor deposition process, the base film is separated from the metal thin film, and the deposition metal thin film is pulverized into flakes. The deposition metal pigment is used, in the form of flake, or being dispersed into a solvent by a known method. In the embodiment, the term "vapor deposition" involves vacuum deposition, sputtering, ion plating, and dry plating process by chemical vapor deposition (CVD) and others.

Examples of metals used for the deposition metal pigment are: noble metals, such as gold, silver, ruthenium, rhodium, palladium, osmium, iridium, and platinum; such metals as aluminum, indium, copper, titanium, nickel and tin; alloys, such as aluminum-titanium alloy, nickel alloy, and chromium alloy; and such metal oxides as indium-tin oxide and titanium dioxide. Aluminum and/or aluminum-titanium alloy is preferably used.

For the deposition metal pigment, a remover, if necessary, is coated over a base film, which is a plastic film made of, for example, oriented polypropylene, crystalline polypropylene, or polyethylene terephthalate, and a metal vapor deposition is carried out on the remover. After the metal vapor deposition process is carried out, a top coating agent may be coated over, for example, a deposition surface in order to prevent the resultant deposition metal thin film from being oxidized. For the remover and the top coating agent, the following resins may be used: acrylic resin, vinyl resin, nitrocellulose, cellulose resin, polyamide resin, polyester resin, ethylene-vinyl acetate copolymer resin, chlorinated polypropylene resin, chlorinated ethylene-polyvinyl acetate resin, petroleum resin, and others.

The deposition metal thin film is peeled off the base film and pulverized into a deposition metal pigment as flaked. By classifying the deposition metal pigment flake, if necessary, a particle size distribution is designed to have a specific profile. An average particle thickness of 0.01 to 0.10 μm and an average particle diameter of 5 to 30 μm are preferable. An average particle diameter of the deposition metal pigment is a 50% value of a particle diameter distribution measured by a laser-diffraction type particle size distribution measuring instrument. The average particle thickness (μm) is represented by a value that is measured by an expression [4000/water surface covering area ($cm^2/g$)]. For the measuring method, reference is made to "Aluminum Handbook" (on page 1243, Ninth edition, issued on Apr. 15, 1972 by Asakura Shoten Corporation, and edited by Keikinzoku Kyokai).

The glittering base coating material of the embodiment contains a metal colloid particle liquid and a deposition metal pigment. The glittering base coating material is prepared by adding a deposition metal pigment to a noble or copper colloid particle liquid containing noble metal or copper colloid particles.

In the glittering base coating film of the embodiment, a mass ratio of a metal solid content in the deposition metal pigment to that in the metal colloid particle liquid is in a range from 0.5/100 to 5/100. If the metal in the deposition metal pigment/metal of the metal colloid particle is less than 0.5/100 in terms of a metal solid content mass ratio, an uneven hue that arises from a variation of the thickness value of the coating film by the metal colloid particle liquid cannot be modified. As a result, a non-uniformity of hue is easy to occur. If the metal in the deposition metal pigment/metal of the metal colloid particle exceeds 5/100, it is difficult to cause the coating film to develop a metal feeling free from a metal particle feeling. The mass ratio of a metal solid content in the deposition metal pigment to that in the metal colloid particle liquid is preferably within the range from 1/100 to 40/100.

EXAMPLES

Examples of the invention and comparisons will be described hereunder in detail. It should be understood that the invention is not limited to those examples, and the "formulation amount" is the "pts. mass" unless otherwise stated.

Examples 1 to 256, Comparisons 1 to 6

Preparation of a Substrate to be Coated

A dull steel plate (300 mm in length, 100 mm in width, and 0.8 mm in thickness) was subject to a chemical treatment where a zinc-phosphating treatment agent ("SURFDINE SD2000", trade name, by Nippon Paint Co., Ltd.) was used. Following this process, a coating material-containing a cationic resin ("POWERTOP", trade name, by Nippon Paint Co., Ltd.) was applied to form an undercoating film a dry film thickness of which is 25 μm by an electrodepositing process. Then, the resultant was baked at 160° C. for 30 minutes to produce a coating substrate 1A.

A degreased aluminum alloy plate (AC4C, 300 mm in length, 100 mm in width, 1 mm in thickness) was subject to a chemical treatment where a chromating agent ("ALUSURF 1000", trade name, by Nippon Paint Co., Ltd.) was used. Following this process, an acrylic resin powder type clear coating material ("POWDAXA400 Clear", trade name, by Nippon Paint Co., Ltd.) was applied to form an undercoating film a dry film thickness of which is 70 μm. Then, the resultant was baked at 160° C. for 30 minutes to produce a coating substrate 1B.

A degreased aluminum alloy plate (AC4C, 300 mm in length, 100 mm in width, 1 mm in thickness) was subject to a chemical treatment where a chromating agent ("ALUSURF 1000", by Nippon Paint Co., Ltd.) was used. Following this process, an epoxy resin powder type gray coating material ("BIRYUSHIA HB-2000 Gray", trade name, by Nippon Paint Co., Ltd.) was applied to form an undercoating film a dry film thickness of which is 50 μm. Then, the resultant was baked at 160° C. for 30 minutes to produce a coating substrate 1C.

A degreased aluminum alloy plate (AC4C, 300 mm in length, 100 mm in width, 1 mm in thickness) was subject to a chemical treatment where a chromating agent ("ALUSURF 1000", by Nippon Paint Co., Ltd.) was used. Following this process, an acrylic resin powder type black coating material ("POWDAX A400 Black", trade name, by Nippon Paint Co., Ltd.) was applied to form an undercoating film a dry film thickness of which is 70 μm. Then, the resultant was baked at 160° C. for 30 minutes to produce a coating substrate 1D.

A polypropylene plate (automobile bumper member, 300 mm in length, 100 mm in width, and 5 mm in thickness) was degreased. Following this process, an acrylic alkyd urethane resin solvent type gray coating material ("RB-116 Primer", trade name, by Nippon Bee Chemical Co., Ltd.) was applied to form an undercoating film an average dry film thickness of which is 15 μm. Then, the resultant was baked at 80° C. for 30 minutes to produce a coating substrate 1E.

[Intermediate Coating Material]

By using combinations in Table 2, an intermediate coating material (dry film thickness=50 μm) is applied, and intermediate coating materials 2A and 2B were baked at 140° C. for 20 minutes, and an intermediate coating material 2C was baked at 80° C. for 20 minutes.

2A: Polyester resin solvent type black coating material ("ORGA G-65 Black", by Nippon Paint Co., Ltd., solvent swelling ratio=2%, film crosslinking density=$2.5\times10^{-3}$ mol/cc).

2B: Acrylic resin solvent type black coating material ("SUPERLAC M90 Black", by Nippon Paint Co., Ltd., solvent swelling ratio=1.5%, film crosslinking density=$1.9\times10^{-3}$ mol/cc).

2C: Intermediate coating material for plastic ("R-301 Black", by Nippon Bee Chemical Co., Ltd., solvent swelling ratio=1.7%, film crosslinking density=$2.3\times10^{-3}$ mol/cc).

[Measurement of Solvent Swelling Ratio]

The intermediate coating material was applied onto a tin plate by an electrostatic coating process, and the resultant was heated at 140° C. for 30 minutes, to thereby form an intermediate coating film having a thickness of 35 μm. In calculating a solvent swelling ratio, the intermediate coating film was immersed into a solvent of, for example, toluene, and then the solvent swelling ratio was calculated, by using the equation 1, based on a weight change of the swelled coating film.

[Measurement of Film Crosslinking Density]

The intermediate coating material was coated on a tin plate by an electrostatic coating process, and the resultant was heated at 140° C. for 30 minutes, to thereby form an intermediate coating film having a thickness of 35 μm. A coating film crosslinking density (n) was obtained by using the equation 2. A measuring instrument ("Vibron DDVII", manufactured by Toyo Baldwin Corporation) was used which measures a viscoelasticity of the intermediate coating film while microvibrating the intermediate coating film.

[Manufacturing of Colloid Particle Liquids]

[Manufacturing of Colloid Particle Liquid A (Silver)]

"Disperbyk 190" (trade name, BYK-Chemie GmbH) of 12 g as a polymeric pigment dispersing agent and ion exchange water of 420.5 g were put into a Kolben of 2 liters. The Kolben was placed in a water bath, and stirred at 50° C. till Disperbyk 190 was dissolved. Silver nitrate of 100 g having been dissolved into ion exchange water of 420.5 g was added thereto while being stirred, and stirred at 70° C. for 10 minutes. Then, dimethylaminoethanol of 262 g was added thereto. The liquid quickly changed its color to black, and liquid temperature rose to 76° C. The liquid was left as it was. When the liquid temperature decreased to 70° C., it was continuously stirred at that value of temperature for two hours. As a result, a silver colloid aqueous liquid colored dark yellow was obtained. The resultant reaction liquid was transferred to a plastic bottle of 1 liter, and the bottle was left standing in a constant temperature room at 60° C. for 18 hours. An ultrafiltering system was constructed such that an ultrafiltering module ("AHP1010", trade name; molecular weight cut off=50000, number of filters=400, manufactured by Asahi Kasei Corporation), a magnet pump, and a stainless cup of 3 liters having tube connection ports at the lower part were interconnected by use of silicone tube. The reaction liquid having been left standing in a constant temperature room at 60° C. for 18 hours was put into a stainless cup, and ion exchange water of 2 liters was added to the liquid. Then, the pump was operated to perform an ultrafiltering process. After about 40 minutes, a filtering liquid output from the ultrafiltering module reached 2 liters. At this time, ethanol of 2 liters was put into the stainless cup. Thereafter, it was confirmed that conductivity of the filtering liquid was 300 μS/cm or lower, and a concentration process was carried out till an amount of mother liquid reached 500 ml. Subsequently, another ultrafiltering system was constructed which includes a 500 ml stainless cup containing a mother liquid, an ultrafiltering module ("AHP0013", trade name; molecular weight=50000, number of filters=100, manufactur ed by Asahi Kasei Corporation), a tube pump, and an aspirator. The mother liquid previously prepared was put into the stainless cup, and was concentrated to increase a solid concentration. When the mother liquid reached about 100 ml, the tube pump was stopped in operation, and at the end of the concentrating operation, a silver colloid ethanol liquid having a 30% solid was obtained. An average particle diameter of the silver colloids in the liquid was 27 nm. The result of measurement by an instrument "TG-DTA" (trade name, Seiko Instrument Corporation) showed that a content of the silver in the solid was 96 mass % for 93 mass % of the charge.

[Manufacturing of Colloid Particle Liquid B (Silver)]

A 40 mass % silver nitrate aqueous liquid of 250.0 g was put into a Kolben, and diluted by acetone of 176.6 g, and then "SOLSPERSE 24000" (trade name, Lubrizol Corporation) of 11.2 g was dissolved thereinto. After "SOLSPERSE 24000" had been completely dissolved, dimethylaminoethanol of 262.0 g was added thereto. Afresh and highly concentrated silver colloid liquid was obtained. The silver colloid liquid thus obtained was heated at a reduced pressure to remove the acetone. "SOLSPERSE 24000" is insoluble to water. Then, with decrease of the acetone in amount, silver colloids protected by "SOLSPERSE 24000" was deposited and precipitated. A supernatant liquid was removed by decantation process, and the precipitate was washed and the silver colloids were completely dried, whereby silver solid sol was obtained. The solid sol obtained developed metallic gloss. The slid sol obtained is added to ethanol of 230 g and stirred to completely dissolve the solid sol. As a result, a highly concentrated silver colloid ethanol liquid having a 23% solid was obtained. An average particle diameter of the silver colloids in the liquid was 19 nm. The result of measurement by the instrument TG-DTA showed that a content of silver in the solid was 88 mass % for 85 mass % of the preparation.

[Manufacturing of Colloid Particle Liquid C (Copper)]

Iron (II) sulfate heptahydrate of 98.44 g and deionized water of 150.0 g were put into a Kolben, and heated to 70° C. in a bath water, to thereby be dissolved.

This was added with "SOLSPERSE 32550" (trade name, Butyl acetate liquid (effective content=50%), manufactured by Lubrizol Corporation) of 1.00 g and ethanol of 33.75 g, and the added one was stirred. As a result, a light bluish white turbid liquid was obtained. A 12.07 pats. mass copper chloride (II) di-hydrate and an 81.44 pats. mass, 2 mol/l hydrochloric acid aqueous liquid was put in another container, stirred to dissolve a copper chloride di-hydrate. A green aqueous liquid containing the copper (II) ion was put into the Kolben while being stirred, and was heated to 70° C. by using a bath water. A rongalite (sodium formaldehyde sulfoxylate di-hydrate) of 16.37 g and a deionized water of 16.5 g were put in another container, and were dissolved while being stirred in a bath water at 50° C. The obtained rongalite aqueous liquid is put into a Kolben in an instant, while being stirred. Thereafter, the liquid became dark red in color. As a result, an oily substance of dark brown formed of non-polar polymer protecting resin and copper colloid particles was deposited. From the result of measurement by "TG-DTA", it was confirmed that a content of the copper in the solid was 83.3 mass %.

[Manufacturing of Colloid Particle Liquid D (Gold)]

A gold colloid ethanol liquid having a 20% solid content was obtained in a similar manner to that for manufacturing the silver colloid particle liquid A, except that "Disperbyk 191" (trade name, manufactured by BYK-Chemie GmbH) is 13.8 g and chlorauric acid ethanol liquid is 1350 g. An average particle diameter of the gold colloid particles in the liquid was 18 nm. The result of measurement by the "TG-DTA" showed that a content of the gold in the solid was 90 mass % for 70 mass % of the charge.

[Manufacturing of Composite Metal Colloid Particle Liquid E (Ethanol-Silver/Palladium (97/3))]

"Disperbyk 190" of 24.8 g and deionized water of 400.0 g were put in a Kolben, and stirred to be dissolved. A palladium chloride acid ($H_2PdCl_4$) aqueous liquid (palladium content is 15.22 wt. %, by Tanaka Kinzoku Kogyou K.K.) of 7.83 g was added to it. 2-dimethylaminoethanol of 164.1 g was added to the liquid and well stirred. A mixed aqueous liquid obtained was heated to 70° C. in a bath water.

Silver (I) nitrate of 60.64 g and deionized water of 150.0 g were put in a container that is different from the Kolben, mentioned above and were stirred at 50° C. in a bath water to dissolve the silver nitrate. A silver nitrate aqueous liquid was put into the Kolben in an instant, while being stirred. The liquid rapidly changed its color to gray, and then became blackish color. When temperature of the liquid lowered to 70° C., the temperature was kept at this value, and stirred for 4 hours. Finally, an aqueous silver/palladium composite metal colloid liquid of blackish brown was formed.

The obtained reaction liquid was transferred to a plastic bottle of 1 liter, and was left standing at 60° C. for 18 hours in a constant temperature room.

Then, an ultrafiltering process and a concentration process were carried out as in the case of manufacturing the colloid particle liquid A. After the concentration process was completed, a silver/palladium composite metal colloid particle ethanol liquid containing a 30% solid content was formed. An average particle diameter of the silver/palladium composite metal colloid particles in the liquid was 27 nm. The measurement result by "TG-DTA" showed that in an ethanol-silver/palladium composite metal colloid particle paste, a metal content was 11.2 wt. %, "Disperbyk 190" was 1.6 wt. %, and ethanol was 87.2 wt. %.

[Manufacturing of a Composite Metal Colloid Particle Liquid F (Ethanol-Silver/Indium (95/5))]

"Disperbyk 190" of 24.8 g and deionized water of 200.0 g were poured into a Kolben and stirred to be dissolved. Silver nitrate (I) of 59.39 g and deionized water of 150.0 g were put in a container different from the Kolben mentioned above, and stirred in a bath water at 50° C. to dissolve the silver nitrate. Indium (III) nitrate trihydrate of 6.14 g and deionized water of 200.0 g were put into another container, and stirred in a bath water at 50° C. to dissolve the indium (III) nitrate trihydrate. The resultant silver nitrate aqueous liquid and indium nitrate aqueous liquid were put into the Kolben, while being stirred. As a result, a mixed aqueous liquid of "Disperbyk 190", silver nitrate, and indium nitrate was formed.

The obtained mixed aqueous liquid was heated to 70° C. in a bath water. After it was heated at 70° C. for 10 minutes, 2-dimethylaminoethanol of 163.6 g was quickly added to the Kolben while being stirred. The liquid changed its color to gray in an instant and liquid temperature rose to 76° C. And it became blackish. The liquid temperature lowered to 70° C. In turn, it was stirred continuously for 4 hours at that temperature. As a result, an aqueous silver/indium composite metal colloid liquid of black color was formed.

The obtained reaction liquid was transferred to a plastic bottle of 1 liter and was left standing for 18 hours in a constant temperature room at 60° C. Subsequently, an ultrafiltering process and a concentration process were carried out as in manufacturing the colloid particle liquid A, and the concentration process ended. As a result, a silver/indium composite metal colloid particle ethanol liquid was obtained. An average particle diameter of the silver/indium composite metal colloid particles was 27 nm. The result of measurement by using the "TG-DTA" showed that in an ethanol-silver/indium composite particle paste, a metal content was 17.0 wt. %, "Disperbyk 190" was 2.5 wt. %, and the ethanol was 80.5 wt. %.

[Manufacturing of a Composite Metal Colloid Particle Liquid G (ethanol-silver/indium (97/3))]

"Disperbyk 190" of 17.5 g and deionized water of 200.0 g were put in a Kolben and stirred to be dissolved. Silver (I) nitrate of 60.64 g and deionized water of 150.0 g were placed in a container which is different from the Kolben. This was stirred in a bath water at 50° C. to dissolve sliver nitrate. Indium (III) nitrate trihydrate of 3.68 g and deionized water of 200.0 g were put into another container, and stirred in a bath water at 50° C. to dissolve the indium (III) nitrate trihydrate. The resultant silver nitrate aqueous liquid and indium nitrate aqueous liquid were added to the Kolben, while being stirred. As a result, a mixed aqueous liquid of "Disperbyk 190", silver nitrate, and indium nitrate was formed.

The obtained mixed aqueous liquid was heated to 70° C. in a bath water. After it was heated at 70° C. for 10 minutes, 2-dimethylaminoethanol of 163.6 g was quickly applied to the Kolben while being stirred. The liquid changed its color to gray in an instant and liquid temperature rose to 76° C. And it became blackish. The liquid temperature lowered to 70° C. In turn, it was stirred continuously for 4 hours at that temperature. As a result, an aqueous silver/indium composite metal colloid liquid of greenish dark gray was formed.

The obtained reaction liquid was transferred to a plastic bottle of 1 liter and was left standing for 18 hours in a constant temperature room at 60° C. Then, an ultrafiltering process and a concentration process were carried out as in the case of manufacturing the colloid particle liquid A. After the concentration process was completed, a silver/palladium composite metal colloid particle ethanol liquid was formed. An average particle diameter of the silver/indium composite metal colloid particles was 27 nm. The result of measurement by using the "TG-DTA" showed that in an ethanol-silver/indium composite particle paste, a metal content was 11.0 wt. %, "Disperbyk 190" was 1.0 wt. %, and the ethanol was 88.0 wt. %.

[Manufacturing of a Composite Metal Colloid Particle Liquid (methoxypropanol silver/indium (99.5/0.5))]

"Disperbyk 190" of 17.5 g and deionized water of 200.0 g were put in a Kolben and stirred to be dissolved. Silver (I) nitrate of 62.2 g and deionized water of 150.0 g were placed in a container which is different from the Kolben. This was stirred in a bath water at 50° C. to dissolve sliver nitrate. Indium (III) nitrate trihydrate of 0.62 g and deionized water of 200.0 g were put into another container, and stirred in a bath water at 50° C. to dissolve the indium (III) nitrate trihydrate. The resultant silver nitrate aqueous liquid and indium nitrate aqueous liquid were added to the Kolben, while being stirred. As a result, a mixed aqueous liquid of "Disperbyk 190", silver nitrate, and indium nitrate was formed.

The obtained mixed aqueous liquid was heated to 70° C. in a bath water. After it was heated at 70° C. for 10 minutes, 2-dimethylaminoethanol of 163.6 g was quickly applied to the Kolben while being stirred. The liquid changed its color to gray in an instant and liquid temperature rose to 76° C. And it became blackish. The liquid temperature lowered to 70° C. In turn, it was stirred continuously for 4 hours at that temperature. As a result, an aqueous silver/indium nano-sized particle paste liquid of greenish dark gray was formed.

The obtained reaction liquid was transferred to a plastic bottle of 1 liter and was left standing for 18 hours in a constant temperature room at 60° C. Then, except that methoxypropanol is used instead of ethanol, an ultrafiltering process and a concentration process were carried out as in the case of manufacturing the colloid particle liquid A. After the concentration process was completed, a silver/palladium composite methoxypropanol liquid was formed. An average particle diameter of the silver/indium composite nano-sized particles was 27 nm. The result of measurement by using the "TG-DTA" showed that in a methoxypropanol-silver/indium composite particle paste, a metal content was 11.0 wt. %, "Disperbyk 190" was 1.0 wt. %, and the methoxypropanol was 88.0 wt. %.

[Preparation of a Composite Metal Colloid Particle Liquid I (Core: Gold/Shell: Silver (1/8))]

(Preparation of Gold Colloid Liquid (i))

Chlorauric acid ($HAuCl_4.4H_2O$) of 27 g was put into a Kolben containing ethanol of 230 g, and dissolved while being stirred. "Disperbyk 191" (trade name, manufactured by BYK-Chemie GmbH) of 19 g was added thereto as a polymeric pigment dispersing agent, and stirred. After the polymeric pigment dispersing agent was dissolved, it was heated in a water bath till liquid temperature was 50° C. Subsequently, dimethylaminoethanol of 29 g was quickly added thereto while being stirred. After the addition, it was stirred for 2 hours in a state that liquid temperature was kept at 50° C. A gold colloid ethanol liquid of fascinating and deep red was formed. The formed gold colloid ethanol liquid was processed by an ultrafiltering module "AHP0013" to remove residual ions. Ethanol was added to the produced filtrate to filter it again. A sequence of those filtering processes was repeated. In this way, a gold colloid ethanol liquid of 83 g was formed which contains gold colloid particles and a polymeric pigment dispersing agent and a 20 mass % solid content. An average particle diameter of the metal colloid particles in the liquid, which was obtained through the observation by using an electron microscope, was 15 nm. As the result of measurement by the "TG-DTA", a metal content in the solid was 70 mass %.

[Preparation of a Composite Metal Colloid Particle Liquid I (Gold/Silver)]

Silver nitrate of 60 g was dissolved into water of 120 g, and ethanol of 1666 g was added thereto to form a silver nitrate-water—ethanol aqueous liquid. This liquid was added to the formed gold colloid liquid (i) of 44 g, and stirred. The dimethylaminoethanol of 158 g was quickly added, and then stirred for two hours at room temperature, whereby a gold/silver composite colloid liquid of orange color was formed.

[Preparation of Silver Colloid Particle Liquid (j) (Core: Silver/Shell: Gold (1/8))]

Silver nitrate of 50 g was put into a Kolben containing water of 883 g and dissolved while being stirred. "Disperbyk 190" of 119 g was added as a polymeric pigment dispersing agent to a mixed solvent into which 1N silver nitric acid of 294 g and water 294 g, was stirred. After "Disperbyk 190" was dissolved, the liquid was heated up to 70° C. in a water bath. Subsequently, dimethylaminoethanol of 131 g was quickly added thereto while being stirred. After the addition, it was stirred for 2 hours. A silver colloid aqueous liquid of deep yellow was formed. The resultant was subject to an ultrafiltering process as in the case of the gold colloid liquid (i). As a result, a silver colloid aqueous liquid having a 30 mass % solid content was formed. The liquid was 192 g in weight. An average particle diameter of the silver colloid particle in the liquid was 11 nm. The result of measurement by "TG-DTA" showed that a content of metal in the solid was 55 mass %.

[Preparation of a Composite Metal Colloid Particle Liquid (Silver/Gold)]

Ethanol of 1997 g was added to the formed silver colloid liquid (j) of 40 g. Chlorauric acid of 201 g was dissolved into ethanol of 999 g, and dimethylaminoethanol of 217 g was dissolved into ethanol of 999 g, and those were each dripped at a rate of 0.2 ml/min. at room temperature. After dripped, those were continuously stirred for one hour at room temperature. Further, "Disperbyk 191" of 97 g was added thereto, and in this state, stirred continuously for one hour at room temperature. A silver/gold composite colloid liquid of purplish red was formed.

[Addives]

The following materials 1 to 6 were appropriately selected for additives.

1: Palladium (reagent, granular, Kishida Chemicals Co., Ltd.)
2: Silver oxide (reagent, $Ag_2O$, Wako Chemical Pure Industries, Ltd.)
3: Copper acetylacetonate complex (reagent, Copper (II) acetylacetonate, Do Jindo Laboratories)
4: Indium acetylacetonate complex (reagent, Indium (III) acetylacetonate, Sigma-Aldrich Co.)
5: Palladium acetylacetonate complex (reagent, Palladium (II) acetylacetonate, Sigma-Aldrich Co.)
6: Ethyl acetate dispersion of deposition aluminum pigment having an average thickness of 20 nm and an average particle diameter of 9 μm

[Manufacturing of Vehicle 1]

Acrylic resin A (copolymer of styrene/methacrylate/ethylmethacrylate/hydroxyethylmethacrylate/methacrylic acid, number-average molecular weight of about 20,000, hydroxy value; 45, acid value; 15, solid; 50 mass %) and melamine resin ("Uban 20SE" (trade name), Mitsui Chemicals Inc., Ltd., 60 mass % of a solid) were compounded at 80:20 in terms of a ratio by solids mass. to thereby form vehicle 1.

[Manufacturing of Vehicle 2]

(Synthesizing of Phosphoric Acid Group-Containing Acrylic Resin)

40 parts by weight of ethoxypropanol was supplied to a Kolben with an agitator, a temperature regulator and cooling pipes. 20 parts by weight of Acidphosphoxyhexa (oxypropylene) monomethacrylate (Phosmer PP, manufactured by Uni-Chemical Co., Ltd.) was dissolved into 4 parts by weight of styrene, 35.96 parts by weight of n-butyacrylate, 18.45 parts by weight of ethylhexylmethacrylate, 13.92 parts by weight of 2-hydroxyethylmethacrylate, 7.67 parts by weight of methacrylic acid and 20 by weight of ethoxypropanol. 40 parts by weight of the liquid and 121.7 parts by weight of monomer liquid containing 1.7 parts by weight of azobis isobutyronitrile were dripped at 120° C. for three hours, and then stirred continuously for one hour. By the process, phosphoric acid group-containing acrylic resin B was formed, and a non-volatile component was 63%. The resin B has an acid value of 105 mgKOH/g, an acid value of 50 mgKOH/g derived from phosphoric acid group, a hydroxyl value of 60, and a number-average molecular weight of 6000.

(Manufacturing of Vehicle 2)

Acrylic resin A (copolymer of styrene/methacrylate/ethylmethacrylate/hydroxyethylmethacrylate/methacrylic acid, number-average molecular weight of about 20,000, hydroxy value; 45, acid value; 15, solid; 50 mass %) and the phosphoric-acid-group-containing acrylic resin B were compounded at 3:7 in terms of a ratio by solids mass. to thereby form a phosphoric-acid-group-containing acrylic resin C. This phosphoric-acid-group-containing acrylic resin C and melamine resin ("Uban 20SE, trade name, manufactured by Mitsui Chemicals Inc., Ltd. 60 mass % of a solid) were compounded at 80:20 in terms of a ratio by solids mass to thereby form a vehicle 2.

[Manufacturing of Glittering Base Coating Material]

The following coating materials were used for manufacturing a glittering base coating film (dry film thickness: 0.1 μm).

[Manufacturing of a Glittering Base Coating Material Containing (Composite) Colloid Particle Liquid Using Vehicle 1]

The thus formed colloid particle liquids A to J, and if necessary, the vehicle 1 formed by the process mentioned above, additive, ultraviolet absorber, light stabilizer were compounded under the conditions shown in Table 1. Then, the resultant, together with an organic solvent (toluene/xylene/ethyl acetate/butyl acetate (mass ratio)=70/15/10/5), was stirred to have an adequate coating viscosity by an agitating machine. As a result, glittering base coating materials 1-1 to 10-1, 12-1 to 22-1, 24-1 to 45-1 and 47-1 were manufactured. The glittering base coating material 47-1 was used for comparison. The glittering base coating materials 11, 23 and 46 do not include vehicles.

[Manufacturing of a Glittering Base Coating Material Containing a (Composite) Colloid Particle Liquid Using the Vehicle 2]

The thus formed colloid particle liquids A to J, and if necessary, the vehicle 2 formed by the process mentioned above, additive, ultraviolet absorber, light stabilizer were compounded under the conditions shown in Table 1. Then, the resultant, together with an organic solvent (toluene/xylene/ethyl acetate/butyl acetate (mass ratio)=70/15/10/5), was stirred to have an adequate coating viscosity by an agitating machine. As a result, glittering base coating materials 1-2 to 10-2, 12-2 to 22-2, 24-2 to 45-2, and 47-2 were manufactured. The glittering base coating material 47-2 was used for comparison.

[Clear Coating Materials]

The following coating materials were used for the clear coating material.

4A: Clear coating material of the acrylic resin solvent type (SUPERLAC O-130 Clear, trade name, Nippon Paint Co. Ltd.)/dry film thickness=30 μm 4B: Clear coating material of the solvent type as a blend of carboxyl group-containing polymer and epoxy group-containing polymer ("MACFLOW O-520 Clear", trade name, Nippon Paint Co. Ltd.)/dry film thickness=30 μm 4C: Clear coating material of the acrylic resin powder type ("POWDAX A-400", trade name, Nippon Paint Co. Ltd.)/dry film thickness=100 μm 4D: Clear coating material of the two-component urethane solvent type ("nax SUPERIO clear", trade name, Nippon Paint Co. Ltd.)/dry film thickness=30 μm 4E: Clear coating material of the two-component urethane solvent type ("R-288 Clear", trade name, Nippon Bee Chemical Co., Ltd.)/dry film thickness=30 μm.

[Glittering Clear Coating Material]

The following coating materials were used for the glittering clear coating material (dry film thickness=30 μm).

5A: Glittering clear coating material containing 3 solid mass % (in terms of PWC) silver-plated glass flake pigment ("Metashine", trade name, manufactured by Nippon Sheet Glass Co., Ltd.) as a glittering material in a vehicle obtained by compounding acrylic resin (copolymer of styrene/methacrylate/ethylmethacrylate/hydroxyethylmethacrylate/methacryl acid: number-average molecular weight=about 20,000, hydroxy value=45, acid value=15, solid=50 mass %) and melamine resin ("Uban 20SE") at 80:20 in terms of a ratio by solid mass.

5B: Glittering clear coating material containing 0.5 solid mass % (in terms of PWC) aluminum flake pigment ("Aluminum paste GX-50A", trade name, manufactured by Asahi Kasei Corporation) as a glittering material in a vehicle obtained by compounding acrylic resin (copolymer of styrene/methacrylate/ethylmethacrylate/hydroxyethylmethacrylate/methacryl acid: number-average molecular weight=about 20,000, hydroxy value=45, acidity=15, solid=50 mass %) and melamine resin ("Uban 20SE") at 80:20 in terms of a ratio by solid mass.

5C: Glittering clear coating material containing 3 solid mass % (in terms of PWC) silver-plated glass flake pigment ("Metashine") as a glittering material in the clear coating material 4D.

5D: Glittering clear coating material containing 3 solid mass % (in terms of PWC) silver-plated glass flake pigment ("Metashine") as a glittering material in the clear coating material 4E.

[Matting Clear Coating Material]

The following coating materials were used for the matting clear coating material (dry material thickness=30 μm).

6A: Matting clear coating material containing 30 solid mass % (in terms of PWC) resin particle matting agent ("RUBCOULEUR 230F-20", trade name, Dainichiseika Color & Chemicals Mfg.Co., Ltd.) in the clear coating material 4A.

6B: Matting clear coating material containing 30 solid mass % (in terms of PWC) resin particle matting agent ("RUBCOULEUR 230F-20") in the clear coating material 4B.

6C: Matting clear coating material containing 10 solid mass % (in terms of PWC) inorganic microparticle matting agent ("Sylysia 350", trade name, Fuji Silysia Chemical Ltd. ) in the clear coating material 4A.

6D: Matting clear coating material containing 30 solid mass % (in terms of PWC) resin particle matting agent ("RUBCOULEUR 230F-20") in the clear coating material 4D.

6E: Matting clear coating material containing 30 solid mass % (in terms of PWC) resin particle matting agent ("RUBCOULEUR 230F-20") in the clear coating material 4E.

[Color Clear Coating Material]

The following coating materials were used for the color clear coating material (dry film thickness=30 μm).

7A: Color clear coating material containing 2.0 solid mass % (in terms of PWC) phthalocyanine blue ("Phthalocyanine Blue G314", trade name, Sanyo Color Works, Ltd.) as a coloring pigment in the clear coating material 4A.

7B: Color clear coating material containing 2.0 solid mass % (in terms of PWC) phthalocyanine blue ("Phthalocyanine Blue G314") as a coloring pigment in the clear coating material 4B.

7C: Color clear coating material containing 2.0 solid mass % (in terms of PWC) Perylene Red ("Paliogen red L3920", trade name, BASF) as a coloring pigment in the clear coating material 4A.

7D: Color clear coating material containing 2.0 solid mass % (in terms of PWC) phthalocyanine blue ("Phthalocyanine Blue G314") as a color pigment in the clear coating material 4D.

7E: Color clear coating material containing 2.0 solid mass % (in terms of PWC) phthalocyanine blue ("Phthalocyanine Blue G314") as a color pigment in the clear coating material 4E.

[Formation of Multilayer Coating Film]

Coating films shown in Table 2 [intermediate coating film, glittering coating film (coating material No. (1) or (2)), clear coating film] were successively coated over a coating surface of a coated substrate. Baking and drying conditions were as shown in Table 2. Metal feeling, gloss feeling, and weathering resistance of the coating films formed were evaluated according to the following evaluation method. The evaluation results are shown in Table 2.

[Evaluation Methods]

Metallic feeling (1): External appearance of a composite coating film formed was visually checked.

3 . . . Metallic feeling (plating tone) free from a metal particle feeling was developed and further a high-grade metal feeling in which a glittering feeling is enhanced by light rays that pass through a glittering clear coating film and reflected by a glittering base coating film, was developed.

2 . . . Metallic feeling free from metal particle feeling was developed.

1 . . . Metallic feeling free from metal particle feeling was not developed. Metallic particle feeling was produced, and a high-grade metal feeling in which a glittering feeling is enhanced by the light rays was not produced.

Metallic feeling (2): Matting metal feeling: Appearance of a composite coating film formed was visually evaluated (To check effects of the matting clear coating film)

3 . . . Matting metal feeling free from a metal particle feeling was remarkable.

2 . . . Matting metal feeling free from a metal particle feeling was developed.

1 . . . Matting metal feeling free from a metal particle feeling was not developed.

Metallic feeling (3): Composite metal feeling: Appearance of a composite coating film formed was visually evaluated.

3 . . . A high-grade metal feeling with different hues, caused by the composite metal or combined metals, which was free from a feeling of metal particles, was developed.

2 . . . A metal feeling free from metal particle feeling was produced.

1 . . . Metal particle feeling was produced, and a high-grade metal feeling in which a glittering feeling is enhanced by the light rays was not developed.

Hue uniformity: External appearance of a glittering coating object with a composite coating film formed is visually evaluated.

3 . . . Hue nonuniformity was not observed.

2 . . . A little hue nonuniformity was observed.

1 . . . Hue nonuniformity was observed.

Feeling of gloss (except a coating film using a matting clear coating film): feeling of mirror reflection gloss on composite coating film formed was visually evaluated.

3 . . . Feeling of mirror reflection gloss was strong.

2 . . . Feeling of mirror reflection gloss was normal.

1 . . . Feeling of mirror reflection gloss was not given.

Film performance: A coating film formed was dipped in pure water at 40° C. for 240 hours. (1) A cross-cut having 100 squares, 2 mm×1 mm, was formed on the coating film. A cellophane adhesive tape was applied on a surface of the cross-cut. The adhesive tape was peeled off, and the number of the squares left on the cross-cut was counted. (2) Oxidation levels of the colloid metal in a coating film formed were visually evaluated.

3 . . . "(1) is A and (2) is A.

2 . . . "(1) is A and (2) is B", "(1) is B and (2) is A" or "(1) is B and (2) is B"

1 . . . "(1) is A and (2) is C" or "(1) is B and (2) is C" or "(1) is C and (2) is A" or "(1) is C and (2) is B" or "(1) is C and (2) is C"

A . . . (1) Number of squares left on the coating surface=100/(2) No oxidation of the colloid metal was present.

B . . . (1) Number of squares left on the coating surface=90 to 99/(2) Little oxidation of the colloid metal was present.

C . . . (1) Number of squares left on the coating surface=0 to 89/(2) Oxidation of the colloid metal was present.

Weathering resistance; A composite coating film formed was tested by Sunshine Weather Meter (Suga Test Instrument Co., Ltd.). After 600 hours, a degree of color change (ΔE) of the coating film (reference: composite film before it is tested by Sunshine Weather Meter) was measured by using a hue color-difference meter (Type: CR-331 manufactured by Minolta Inc.)

3 . . . Degree of color change: less than 1

2 . . . Degree of color change: not less than 1 but less than 5

1 . . . Degree of color change: 5 or higher

TABLE 1

| | | Noble or copper colloid particle solution | | | | | | | | | | |
|---|---|---|---|---|---|---|---|---|---|---|---|---|
| | | Noble or copper colloid particle solution | | Gold colloid particle solution + copper colloid particle solution | | Composite colloid particle solution | | Additive | | Vehicle Vehicle 1 or Vehicle 2 | Ultraviolet absorber (benzotriazole) | Light stabilizer (hindered amine) |
| No. | | | Mass | | Mass | | Mass | | Mass | Mass | Mass | Mass |
| | Vehicle 1/ Vehicle 2 | No. | formulation ratio (solid) | No. | formulation ratio (solid) | No. | formulation ratio (solid) | No. | formulation ratio (solid) | formulation ratio (solid) | formulation ratio (solid) | formulation ratio (solid) |
| Paint | 1-1/1-2 | A | 100 | — | — | — | — | — | — | 15 | — | — |
| No. | 2-1/2-2 | B | 100 | — | — | — | — | — | — | 15 | — | — |
| | 3-1/3-2 | C | 100 | — | — | — | — | — | — | 15 | — | — |
| | 4-1/4-2 | D | 100 | — | — | — | — | — | — | 15 | — | — |
| | 5-1/5-2 | A | 100 | — | — | — | — | — | — | 15 | 1 | 1 |
| | 6-1/6-2 | B | 100 | — | — | — | — | — | — | 15 | 1 | 1 |
| | 7-1/7-2 | C | 100 | — | — | — | — | — | — | 15 | 1 | 1 |
| | 8-1/8-2 | D | 100 | — | — | — | — | — | — | 15 | 1 | 1 |

TABLE 1-continued

| No. | Noble or copper colloid particle solution | | | | | | | | | | |
|---|---|---|---|---|---|---|---|---|---|---|---|
| | Noble or copper colloid particle solution | | Gold colloid particle solution + copper colloid particle solution | | Composite colloid particle solution | | Additive | | Vehicle Vehicle 1 or Vehicle 2 | Ultraviolet absorber (benzotriazole) | Light stabilizer (hindered amine) |
| Vehicle 1/ Vehicle 2 | No. | Mass formulation ratio (solid) | No. | Mass formulation ratio (solid) | No. | Mass formulation ratio (solid) | No. | Mass formulation ratio (solid) | Mass formulation ratio (solid) | Mass formulation ratio (solid) | Mass formulation ratio (solid) |
| 9-1/9-2 | A | 100 | — | — | — | — | — | — | 5 | 1 | 1 |
| 10-1/10-2 | A | 100 | — | — | — | — | — | — | 30 | 1 | 1 |
| 11 | A | 100 | — | — | — | — | — | — | — | 1 | 1 |
| 12-1/12-2 | — | — | A/D | 90/10 | — | — | — | — | 15 | — | — |
| 13-1/13-2 | — | — | A/D | 50/50 | — | — | — | — | 15 | — | — |
| 14-1/14-2 | — | — | A/D | 10/90 | — | — | — | — | 15 | — | — |
| 15-1/15-2 | — | — | B/D | 50/50 | — | — | — | — | 15 | — | — |
| 16-1/16-2 | — | — | A/D | 90/10 | — | — | — | — | 15 | 1 | 1 |
| 17-1/17-2 | — | — | A/D | 50/50 | — | — | — | — | 15 | 1 | 1 |
| 18-1/18-2 | — | — | A/D | 10/90 | — | — | — | — | 15 | 1 | 1 |
| 19-1/19-2 | — | — | B/D | 50/50 | — | — | — | — | 15 | 1 | 1 |
| 20-1/20-2 | — | — | A/D | 50/50 | — | — | — | — | 5 | 1 | 1 |
| 21-1/21-2 | — | — | A/D | 50/50 | — | — | — | — | 30 | 1 | 1 |
| 22-1/22-2 | — | — | A/D | 50/50 | — | — | 6 | 2.5 | 15 | 1 | 1 |
| 23 | — | — | A/D | 50/50 | — | — | — | — | — | 1 | 1 |
| 24-1/24-2 | A | 100 | — | — | — | | 1 | 0.1 | 15 | 1 | 1 |
| 25-1/25-2 | D | 100 | — | — | — | | 1 | 0.1 | 15 | 1 | 1 |
| 26-1/26-2 | C | 100 | — | — | — | | 2 | 1 | 15 | 1 | 1 |
| 27-1/27-2 | D | 100 | — | — | — | | 2 | 1 | 15 | 1 | 1 |
| 28-1/28-2 | A | 100 | — | — | — | | 3 | 0.5 | 15 | 1 | 1 |
| 29-1/29-2 | D | 100 | — | — | — | | 3 | 0.5 | 15 | 1 | 1 |
| 30-1/30-2 | A | 100 | — | — | — | | 6 | 2.5 | 15 | 1 | 1 |
| 31-1/31-2 | — | — | — | — | E | 100 | — | — | 15 | 1 | 1 |
| 32-1/32-2 | — | — | — | — | F | 100 | — | — | 15 | 1 | 1 |
| 33-1/33-2 | — | — | — | — | G | 100 | — | — | 15 | 1 | 1 |
| 34-1/34-2 | — | — | — | — | H | 100 | — | — | 15 | 1 | 1 |
| 35-1/35-2 | — | — | — | — | I | 100 | — | — | 15 | 1 | 1 |
| 36-1/36-2 | — | — | — | — | J | 100 | — | — | 15 | 1 | 1 |
| 37-1/37-2 | — | — | — | — | E | 100 | 4 | 0.5 | 15 | 1 | 1 |
| 38-1/38-2 | A | 50 | — | — | E | 50 | 5 | 0.5 | 15 | 1 | 1 |
| 39-1/39-2 | — | — | — | — | F | 100 | 5 | 0.5 | 15 | 1 | 1 |
| 40-1/40-2 | — | — | — | — | E | 100 | 6 | 2.5 | 15 | 1 | 1 |
| 41-1/41-2 | — | — | — | — | F | 100 | 6 | 2.5 | 15 | 1 | 1 |
| 42-1/42-2 | — | — | — | — | G | 100 | 6 | 2.5 | 15 | 1 | 1 |
| 43-1/43-2 | — | — | — | — | H | 100 | 6 | 2.5 | 15 | 1 | 1 |
| 44-1/44-2 | — | — | — | — | I | 100 | 6 | 2.5 | 15 | 1 | 1 |
| 45-1/45-2 | — | — | — | — | J | 100 | 6 | 2.5 | 15 | 1 | 1 |
| 46 | — | — | — | — | E | 100 | — | — | — | 1 | 1 |
| 47-1/47-2 | — | — | — | — | — | — | 6 | 40 | 100 | 1 | 1 |

Paint No. 47-1/47-2 is for comparison.

TABLE 2A

| Example/ comparison | No. | Substrate to be coated | Intermediate coating film Kind of coating material | Brilliant base coating film (1) or (2) | | | Clear coating film | | | | | | | |
|---|---|---|---|---|---|---|---|---|---|---|---|---|---|---|
| | | | | | | | Brilliant clear coating film | | Color clear coating film | | Matting clear coating film | | Top clear coating film | |
| | | | | Paint No. (1) | Paint No. (2) | Baking (° C.) | Paint No. | Baking (° C.) | Paint No. | Baking (° C.) | Paint No. | Baking (° C.) | Paint No. | Baking (° C.) |
| Example | 1 | 1A | 2A | 1-1 | 1-2 | 120–10 | — | — | — | — | — | — | 4A | 140–20 |
| | 2 | 1A | 2A | 1-1 | 1-2 | 120–10 | 5A | W/W | — | — | — | — | 4A | 140–20 |
| | 3 | 1A | 2A | 3-1 | 3-2 | 120–10 | 5A | W/W | — | — | — | — | 4A | 140–20 |
| | 4 | 1A | 2A | 4-1 | 4-2 | 120–10 | 5A | W/W | — | — | — | — | 4A | 140–20 |
| | 5 | 1A | 2A | 5-1 | 5-2 | 120–10 | 5A | W/W | — | — | — | — | 4A | 140–20 |
| | 6 | 1A | 2A | 7-1 | 7-2 | 120–10 | 5A | W/W | — | — | — | — | 4A | 140–20 |
| | 7 | 1A | 2A | 8-1 | 8-2 | 120–10 | 5A | W/W | — | — | — | — | 4A | 140–20 |
| | 8 | 1A | 2A | 1-1 | 1-2 | 120–10 | 5A | W/W | — | — | — | — | 4B | 140–20 |
| | 9 | 1B | 2B | 1-1 | 1-2 | 120–10 | — | — | — | — | — | — | 4A | 140–20 |
| | 10 | 1B | 2B | 1-1 | 1-2 | 120–10 | 5A | W/W | — | — | — | — | 4A | 140–20 |
| | 11 | 1B | 2B | 2-1 | 2-2 | 120–10 | 5A | W/W | — | — | — | — | 4A | 140–20 |
| | 12 | 1B | 2B | 3-1 | 3-2 | 120–10 | 5A | W/W | — | — | — | — | 4A | 140–20 |
| | 13 | 1B | 2B | 4-1 | 4-2 | 120–10 | 5A | W/W | — | — | — | — | 4A | 140–20 |

TABLE 2A-continued

| | | | | | | | | | | | | | | |
|---|---|---|---|---|---|---|---|---|---|---|---|---|---|---|
| 14 | 1B | 2B | 5-1 | 5-2 | 120–10 | 5A | W/W | — | — | — | — | 4A | 140–20 |
| 15 | 1B | 2B | 6-1 | 6-2 | 120–10 | 5A | W/W | — | — | — | — | 4A | 140–20 |
| 16 | 1B | 2B | 7-1 | 7-2 | 120–10 | 5A | W/W | — | — | — | — | 4A | 140–20 |
| 17 | 1B | 2B | 8-1 | 8-2 | 120–10 | 5A | W/W | — | — | — | — | 4A | 140–20 |
| 18 | 1B | 2B | 9-1 | 9-2 | 120–10 | 5A | W/W | — | — | — | — | 4A | 140–20 |
| 19 | 1B | 2B | 10-1 | 10-2 | 120–10 | 5A | W/W | — | — | — | — | 4A | 140–20 |
| 20 | 1C | 2B | 1-1 | 1-2 | 120–10 | — | — | — | — | — | — | 4A | 140–20 |
| 21 | 1C | 2B | 1-1 | 1-2 | 120–10 | 5A | W/W | — | — | — | — | 4A | 140–20 |
| 22 | 1C | 2B | 3-1 | 3-2 | 120–10 | 5A | W/W | — | — | — | — | 4A | 140–20 |
| 23 | 1C | 2B | 4-1 | 4-2 | 120–10 | 5A | W/W | — | — | — | — | 4A | 140–20 |
| 24 | 1C | 2B | 5-1 | 5-2 | 120–10 | 5A | W/W | — | — | — | — | 4A | 140–20 |
| 25 | 1C | 2B | 7-1 | 7-2 | 120–10 | 5A | W/W | — | — | — | — | 4A | 140–20 |
| 26 | 1C | 2B | 8-1 | 8-2 | 120–10 | 5A | W/W | — | — | — | — | 4A | 140–20 |
| 27 | 1D | — | 1-1 | 1-2 | 120–10 | 5A | W/W | — | — | — | — | 4A | 140–20 |
| 28 | 1D | — | 2-1 | 2-2 | 120–10 | 5A | W/W | — | — | — | — | 4A | 140–20 |
| 29 | 1D | — | 3-1 | 3-2 | 120–10 | 5A | W/W | — | — | — | — | 4A | 140–20 |
| 30 | 1D | — | 4-1 | 4-2 | 120–10 | 5A | W/W | — | — | — | — | 4A | 140–20 |
| 31 | 1E | 2C | 1-1 | 1-2 | 80–20 | — | — | — | — | — | — | 4E | 80–20 |
| 32 | 1E | 2C | 2-1 | 2-2 | 80–20 | — | — | — | — | — | — | 4E | 80–20 |
| 33 | 1E | 2C | 3-1 | 3-2 | 80–20 | — | — | — | — | — | — | 4E | 80–20 |
| 34 | 1E | 2C | 4-1 | 4-2 | 80–20 | — | — | — | — | — | — | 4E | 80–20 |
| 35 | 1A | 2A | 24-1 | 24-2 | 120–10 | — | — | — | — | — | — | 4A | 140–20 |
| 36 | 1A | 2A | 24-1 | 24-2 | 120–10 | 5A | W/W | — | — | — | — | 4A | 140–20 |
| 37 | 1B | 2B | 24-1 | 24-2 | 120–10 | 5A | W/W | — | — | — | — | 4B | 140–20 |
| 38 | 1C | 2B | 24-1 | 24-2 | 120–10 | 5A | W/W | — | — | — | — | 4A | 140–20 |
| 39 | 1D | — | 24-1 | 24-2 | 120–10 | 5A | W/W | — | — | — | — | 4A | 140–20 |
| 40 | 1E | 2C | 24-1 | 24-2 | 80–20 | 5A | W/W | — | — | — | — | 4A | 140–20 |

| | | Evaluation | | | | | | | | | | | | | |
|---|---|---|---|---|---|---|---|---|---|---|---|---|---|---|---|
| | | When the brilliant base coating film (1) is used: | | | | | | | When the brilliant base coating film(2) is used: use phosphate group-containing acryl resin. | | | | | | |
| Example/ comparison | No. | Metal feeling (1) | Metal feeling (2) | Metal feeling (3) | Hue uni-formity | Gloss feel-ing | Weath-er-ability | Film perfor-mance | Metal feeling (1) | Metal feeling (2) | Metal feeling (3) | Hue uni-formity | Gloss feel-ing | Weath-er-ability | Film perfor-mance |
| Example | 1 | 2 | — | — | 2-3 | 3 | 2 | 2-3 | 2 | — | — | 2-3 | 3 | 2 | 3 |
| | 2 | 3 | — | — | 2-3 | 3 | 2 | 2-3 | 3 | — | — | 2-3 | 3 | 2 | 3 |
| | 3 | 3 | — | — | 2-3 | 3 | 2 | 2-3 | 3 | — | — | 2-3 | 3 | 2 | 3 |
| | 4 | 3 | — | — | 2-3 | 3 | 2 | 2-3 | 3 | — | — | 2-3 | 3 | 2 | 3 |
| | 5 | 3 | — | — | 2-3 | 3 | 3 | 2-3 | 3 | — | — | 2-3 | 3 | 3 | 3 |
| | 6 | 3 | — | — | 2-3 | 3 | 3 | 2-3 | 3 | — | — | 2-3 | 3 | 3 | 3 |
| | 7 | 3 | — | — | 2-3 | 3 | 3 | 2-3 | 3 | — | — | 2-3 | 3 | 3 | 3 |
| | 8 | 3 | — | — | 2-3 | 3 | 2 | 2-3 | 3 | — | — | 2-3 | 3 | 2 | 3 |
| | 9 | 2 | — | — | 2-3 | 3 | 2 | 2-3 | 2 | — | — | 2-3 | 3 | 2 | 3 |
| | 10 | 3 | — | — | 2-3 | 3 | 2 | 2-3 | 3 | — | — | 2-3 | 3 | 2 | 3 |
| | 11 | 3 | — | — | 2-3 | 3 | 2 | 2-3 | 3 | — | — | 2-3 | 3 | 2 | 3 |
| | 12 | 3 | — | — | 2-3 | 3 | 2 | 2-3 | 3 | — | — | 2-3 | 3 | 2 | 3 |
| | 13 | 3 | — | — | 2-3 | 3 | 2 | 2-3 | 3 | — | — | 2-3 | 3 | 2 | 3 |
| | 14 | 3 | — | — | 2-3 | 3 | 3 | 2-3 | 3 | — | — | 2-3 | 3 | 3 | 3 |
| | 15 | 3 | — | — | 2-3 | 3 | 3 | 2-3 | 3 | — | — | 2-3 | 3 | 3 | 3 |
| | 16 | 3 | — | — | 2-3 | 3 | 3 | 2-3 | 3 | — | — | 2-3 | 3 | 3 | 3 |
| | 17 | 3 | — | — | 2-3 | 3 | 3 | 2-3 | 3 | — | — | 2-3 | 3 | 3 | 3 |
| | 18 | 3 | — | — | 2-3 | 3 | 3 | 2-3 | 3 | — | — | 2-3 | 3 | 3 | 3 |
| | 19 | 2 | — | — | 2-3 | 2 | 3 | 2-3 | 2 | — | — | 2-3 | 2 | 3 | 3 |
| | 20 | 2 | — | — | 2-3 | 3 | 2 | 2-3 | 2 | — | — | 2-3 | 3 | 2 | 3 |
| | 21 | 3 | — | — | 2-3 | 3 | 2 | 2-3 | 3 | — | — | 2-3 | 3 | 2 | 3 |
| | 22 | 3 | — | — | 2-3 | 3 | 2 | 2-3 | 3 | — | — | 2-3 | 3 | 2 | 3 |
| | 23 | 3 | — | — | 2-3 | 3 | 2 | 2-3 | 3 | — | — | 2-3 | 3 | 2 | 3 |
| | 24 | 3 | — | — | 2-3 | 3 | 3 | 2-3 | 3 | — | — | 2-3 | 3 | 3 | 3 |
| | 25 | 3 | — | — | 2-3 | 3 | 3 | 2-3 | 3 | — | — | 2-3 | 3 | 3 | 3 |
| | 26 | 3 | — | — | 2-3 | 3 | 3 | 2-3 | 3 | — | — | 2-3 | 3 | 3 | 3 |
| | 27 | 3 | — | — | 2-3 | 3 | 2 | 2-3 | 3 | — | — | 2-3 | 3 | 2 | 3 |
| | 28 | 3 | — | — | 2-3 | 3 | 2 | 2-3 | 3 | — | — | 2-3 | 3 | 2 | 3 |
| | 29 | 3 | — | — | 2-3 | 3 | 2 | 2-3 | 3 | — | — | 2-3 | 3 | 2 | 3 |
| | 30 | 3 | — | — | 2-3 | 3 | 2 | 2-3 | 3 | — | — | 2-3 | 3 | 2 | 3 |
| | 31 | 3 | — | — | 2-3 | 3 | 2 | 2-3 | 3 | — | — | 2-3 | 3 | 2 | 3 |
| | 32 | 3 | — | — | 2-3 | 3 | 2 | 2-3 | 3 | — | — | 2-3 | 3 | 2 | 3 |
| | 33 | 3 | — | — | 2-3 | 3 | 2 | 2-3 | 3 | — | — | 2-3 | 3 | 2 | 3 |
| | 34 | 3 | — | — | 2-3 | 3 | 2 | 2-3 | 3 | — | — | 2-3 | 3 | 2 | 3 |
| | 35 | — | — | 3 | 2-3 | 3 | 3 | 3 | — | — | 3 | 2-3 | 3 | 3 | 3 |
| | 36 | — | — | 3 | 2-3 | 3 | 3 | 3 | — | — | 3 | 2-3 | 3 | 3 | 3 |
| | 37 | — | — | 3 | 2-3 | 3 | 3 | 3 | — | — | 3 | 2-3 | 3 | 3 | 3 |
| | 38 | — | — | 3 | 2-3 | 3 | 3 | 3 | — | — | 3 | 2-3 | 3 | 3 | 3 |
| | 39 | — | — | 3 | 2-3 | 3 | 3 | 3 | — | — | 3 | 2-3 | 3 | 3 | 3 |
| | 40 | — | — | 3 | 2-3 | 3 | 3 | 3 | — | — | 3 | 2-3 | 3 | 3 | 3 |

TABLE 2B

| Example/ comparison | No. | Substrate to be coated | Intermediate coating film Kind of coating material | Brilliant base coating film (1) or (2) Paint No. (1) | Paint No. (2) | Baking (° C.) | Clear coating film: Brilliant clear coating film Paint No. | Baking (° C.) | Color clear coating film Paint No. | Baking (° C.) | Matting clear coating film Paint No. | Baking (° C.) | Top clear coating film Paint No. | Baking (° C.) |
|---|---|---|---|---|---|---|---|---|---|---|---|---|---|---|
| Example | 41 | 1A | 2A | 25-1 | 25-2 | 120–10 | 5A | W/W | — | — | — | — | 4A | 140–20 |
| | 42 | 1B | 2B | 26-1 | 26-2 | 120–10 | 5A | W/W | — | — | — | — | 4A | 140–20 |
| | 43 | 1C | 2B | 27-1 | 27-2 | 120–10 | 5A | W/W | — | — | — | — | 4A | 140–20 |
| | 44 | 1D | — | 28-1 | 28-2 | 120–10 | 5A | W/W | — | — | — | — | 4A | 140–20 |
| | 45 | 1E | 2C | 29-1 | 29-2 | 80–20 | 5A | W/W | — | — | — | — | 4A | 140–20 |
| | 46 | 1A | 2A | 30-1 | 30-2 | 120–10 | 5A | W/W | — | — | — | — | 4A | 140–20 |
| | 47 | 1A | 2A | 31-1 | 31-2 | 120–10 | — | — | — | — | — | — | 4A | 140–20 |
| | 48 | 1A | 2A | 31-1 | 31-2 | 120–10 | 5A | W/W | — | — | — | — | 4A | 140–20 |
| | 49 | 1B | 2B | 31-1 | 31-2 | 120–10 | 5A | W/W | — | — | — | — | 4B | 140–20 |
| | 50 | 1C | 2B | 31-1 | 31-2 | 120–10 | 5A | W/W | — | — | — | — | 4A | 140–20 |
| | 51 | 1D | — | 31-1 | 31-2 | 120–10 | 5A | W/W | — | — | — | — | 4A | 140–20 |
| | 52 | 1E | 2C | 31-1 | 31-2 | 80–20 | 5A | W/W | — | — | — | — | 4A | 140–20 |
| | 53 | 1A | 2A | 32-1 | 32-2 | 120–10 | 5A | W/W | — | — | — | — | 4A | 140–20 |
| | 54 | 1B | 2B | 33-1 | 33-2 | 120–10 | 5A | W/W | — | — | — | — | 4A | 140–20 |
| | 55 | 1C | 2B | 34-1 | 34-2 | 120–10 | 5A | W/W | — | — | — | — | 4A | 140–20 |
| | 56 | 1D | — | 35-1 | 35-2 | 120–10 | 5A | W/W | — | — | — | — | 4A | 140–20 |
| | 57 | 1E | 2C | 36-1 | 36-2 | 80–20 | 5A | W/W | — | — | — | — | 4A | 140–20 |
| | 58 | 1A | 2A | 37-1 | 37-2 | 120–10 | 5A | W/W | — | — | — | — | 4A | 140–20 |
| | 59 | 1B | 2B | 38-1 | 38-2 | 120–10 | 5A | W/W | — | — | — | — | 4A | 140–20 |
| | 60 | 1C | 2B | 39-1 | 39-2 | 120–10 | 5A | W/W | — | — | — | — | 4A | 140–20 |
| | 61 | 1D | — | 40-1 | 40-2 | 120–10 | 5A | W/W | — | — | — | — | 4A | 140–20 |
| | 62 | 1E | 2C | 41-1 | 41-2 | 80–20 | 5A | W/W | — | — | — | — | 4A | 140–20 |
| | 63 | 1A | 2A | 42-1 | 42-2 | 120–10 | 5A | W/W | — | — | — | — | 4A | 140–20 |
| | 64 | 1B | 2B | 43-1 | 43-2 | 120–10 | 5A | W/W | — | — | — | — | 4A | 140–20 |
| | 65 | 1C | 2B | 44-1 | 44-2 | 120–10 | 5A | W/W | — | — | — | — | 4A | 140–20 |
| | 66 | 1D | — | 45-1 | 45-2 | 120–10 | 5A | W/W | — | — | — | — | 4A | 140–20 |
| | 67 | 1E | 2C | 46 | — | 80–20 | 5A | W/W | — | — | — | — | 4A | 140–20 |
| | 68 | 1B | 2B | 9-1 | 9-2 | 120–10 | 5B | W/W | — | — | — | — | 4A | 140–20 |
| | 69 | 1B | 2B | 9-1 | 9-2 | 120–10 | 5C | W/W | — | — | — | — | 4A | 140–20 |
| | 70 | 1B | 2B | 9-1 | 9-2 | 120–10 | 5A | W/W | — | — | — | — | 4C | 140–20 |
| | 71 | 1B | 2B | 9-1 | 9-2 | 120–10 | 5A | W/W | — | — | — | — | 4D | 140–20 |
| | 72 | 1A | 2A | 11 | — | 120–10 | 5A | W/W | — | — | — | — | 4A | 140–20 |
| | 73 | 1A | 2B | 11 | — | 120–10 | 5A | W/W | — | — | — | — | 4A | 140–20 |
| Comparison | 1 | 1B | 2A | 47-1 | 47-2 | 120–10 | 5A | W/W | — | — | — | — | 4A | 140–20 |
| | 2 | 1B | 2B | 47-1 | 47-2 | 120–10 | 5A | W/W | — | — | — | — | 4A | 140–20 |
| Example | 74 | 1A | 2A | 1-1 | 1-2 | 120–10 | — | — | — | — | 6A | 140–20 | — | — |
| | 75 | 1A | 2A | 3-1 | 3-2 | 120–10 | — | — | — | — | 6A | 140–20 | — | — |
| | 76 | 1A | 2A | 4-1 | 4-2 | 120–10 | — | — | — | — | 6A | 140–20 | — | — |
| | 77 | 1A | 2A | 5-1 | 5-2 | 120–10 | — | — | — | — | 6A | 140–20 | — | — |
| | 78 | 1A | 2A | 7-1 | 7-2 | 120–10 | — | — | — | — | 6A | 140–20 | — | — |
| | 79 | 1A | 2A | 8-1 | 8-2 | 120–10 | — | — | — | — | 6B | 140–20 | — | — |
| | 80 | 1A | 2A | 1-1 | 1-2 | 120–10 | — | — | — | — | 6A | 140–20 | — | — |

| Example/ comparison | No. | Evaluation: When the brilliant base coating film (1) is used: Metal feeling (1) | Metal feeling (2) | Metal feeling (3) | Hue uniformity | Gloss feeling | Weatherability | Film performance | When the brilliant base coating film(2) is used: use phosphate group-containing acryl resin. Metal feeling (1) | Metal feeling (2) | Metal feeling (3) | Hue uniformity | Gloss feeling | Weatherability | Film performance |
|---|---|---|---|---|---|---|---|---|---|---|---|---|---|---|---|
| Example | 41 | — | — | 3 | 2-3 | 3 | 3 | 3 | — | — | 3 | 2-3 | 3 | 3 | 3 |
| | 42 | — | — | 3 | 2-3 | 3 | 3 | 3 | — | — | 3 | 2-3 | 3 | 3 | 3 |
| | 43 | — | — | 3 | 2-3 | 3 | 3 | 3 | — | — | 3 | 2-3 | 3 | 3 | 3 |
| | 44 | — | — | 3 | 2-3 | 3 | 3 | 3 | — | — | 3 | 2-3 | 3 | 3 | 3 |
| | 45 | — | — | 3 | 2-3 | 3 | 3 | 3 | — | — | 3 | 2-3 | 3 | 3 | 3 |
| | 46 | — | — | 3 | 3 | 3 | 3 | 3 | — | — | 3 | 3 | 3 | 3 | 3 |
| | 47 | — | — | 3 | 2-3 | 3 | 3 | 3 | — | — | 3 | 2-3 | 3 | 3 | 3 |
| | 48 | — | — | 3 | 2-3 | 3 | 3 | 3 | — | — | 3 | 2-3 | 3 | 3 | 3 |
| | 49 | — | — | 3 | 2-3 | 3 | 3 | 3 | — | — | 3 | 2-3 | 3 | 3 | 3 |
| | 50 | — | — | 3 | 2-3 | 3 | 3 | 3 | — | — | 3 | 2-3 | 3 | 3 | 3 |
| | 51 | — | — | 3 | 2-3 | 3 | 3 | 3 | — | — | 3 | 2-3 | 3 | 3 | 3 |
| | 52 | — | — | 3 | 2-3 | 3 | 3 | 3 | — | — | 3 | 2-3 | 3 | 3 | 3 |
| | 53 | — | — | 3 | 2-3 | 3 | 3 | 3 | — | — | 3 | 2-3 | 3 | 3 | 3 |
| | 54 | — | — | 3 | 2-3 | 3 | 3 | 3 | — | — | 3 | 2-3 | 3 | 3 | 3 |
| | 55 | — | — | 3 | 2-3 | 3 | 3 | 3 | — | — | 3 | 2-3 | 3 | 3 | 3 |
| | 56 | — | — | 3 | 2-3 | 3 | 3 | 3 | — | — | 3 | 2-3 | 3 | 3 | 3 |
| | 57 | — | — | 3 | 2-3 | 3 | 3 | 3 | — | — | 3 | 2-3 | 3 | 3 | 3 |
| | 58 | — | — | 3 | 2-3 | 3 | 3 | 3 | — | — | 3 | 2-3 | 3 | 3 | 3 |
| | 59 | — | — | 3 | 2-3 | 3 | 3 | 3 | — | — | 3 | 2-3 | 3 | 3 | 3 |

TABLE 2B-continued

| | | | | | | | | | | | | | | | |
|---|---|---|---|---|---|---|---|---|---|---|---|---|---|---|---|
| | 60 | — | — | 3 | 2-3 | 3 | 3 | 3 | — | — | 3 | 2-3 | 3 | 3 | 3 |
| | 61 | — | — | 3 | 3 | 3 | 3 | 3 | — | — | 3 | 3 | 3 | 3 | 3 |
| | 62 | — | — | 3 | 3 | 3 | 3 | 3 | — | — | 3 | 3 | 3 | 3 | 3 |
| | 63 | — | — | 3 | 3 | 3 | 3 | 3 | — | — | 3 | 3 | 3 | 3 | 3 |
| | 64 | — | — | 3 | 3 | 3 | 3 | 3 | — | — | 3 | 3 | 3 | 3 | 3 |
| | 65 | — | — | 3 | 3 | 3 | 3 | 3 | — | — | 3 | 3 | 3 | 3 | 3 |
| | 66 | — | — | 3 | 3 | 3 | 3 | 3 | — | — | 3 | 3 | 3 | 3 | 3 |
| | 67 | — | — | 3 | 2-3 | 3 | 3 | 3 | — | — | — | — | — | — | — |
| | 68 | 3 | — | — | 2-3 | 3 | 3 | 2-3 | 3 | — | — | 2-3 | 3 | 3 | 3 |
| | 69 | 3 | — | — | 2-3 | 3 | 3 | 2-3 | 3 | — | — | 2-3 | 3 | 3 | 3 |
| | 70 | 3 | — | — | 2-3 | 3 | 3 | 2-3 | 3 | — | — | 2-3 | 3 | 3 | 3 |
| | 71 | 3 | — | — | 2-3 | 3 | 3 | 2-3 | 3 | — | — | 2-3 | 3 | 3 | 3 |
| | 72 | 3 | — | — | 2-3 | 3 | 2 | 2-3 | — | — | — | — | — | — | — |
| | 73 | 3 | — | — | 2-3 | 3 | 2 | 2-3 | — | — | — | — | — | — | — |
| Comparison | 1 | 1 | — | — | 3 | 2 | 3 | 3 | 1 | — | — | 3 | 2 | 3 | 3 |
| | 2 | 1 | — | — | 3 | 2 | 3 | 3 | 1 | — | — | 3 | 2 | 3 | 3 |
| Example | 74 | — | 3 | — | 2-3 | — | 2 | 2-3 | — | 3 | — | 2-3 | — | 2 | 3 |
| | 75 | — | 3 | — | 2-3 | — | 2 | 2-3 | — | 3 | — | 2-3 | — | 2 | 3 |
| | 76 | — | 3 | — | 2-3 | — | 2 | 2-3 | — | 3 | — | 2-3 | — | 2 | 3 |
| | 77 | — | 3 | — | 2-3 | — | 3 | 2-3 | — | 3 | — | 2-3 | — | 3 | 3 |
| | 78 | — | 3 | — | 2-3 | — | 3 | 2-3 | — | 3 | — | 2-3 | — | 3 | 3 |
| | 79 | — | 3 | — | 2-3 | — | 3 | 2-3 | — | 3 | — | 2-3 | — | 3 | 3 |
| | 80 | — | 3 | — | 2-3 | — | 2 | 2-3 | — | 3 | — | 2-3 | — | 2 | 3 |

TABLE 2C

| | | | Intermediate | | | | | Clear coating film | | | | | | | |
|---|---|---|---|---|---|---|---|---|---|---|---|---|---|---|---|
| | | Substrate | coating film Kind of | Brilliant base coating film (1) or (2) | | | Brilliant clear coating film | | Color clear coating film | | Matting clear coating film | | Top clear coating film | |
| Example/ comparison | No. | to be coated | coating material | Paint No. (1) | Paint No. (2) | Baking (° C.) | Paint No. | Baking (° C.) | Paint No. | Baking (° C.) | Paint No. | Baking (° C.) | Paint No. | Baking (° C.) |
| Example | 81 | 1B | 2B | 1-1 | 1-2 | 120–10 | — | — | — | — | 6A | 140–20 | — | — |
| | 82 | 1B | 2B | 2-1 | 2-2 | 120–10 | — | — | — | — | 6A | 140–20 | — | — |
| | 83 | 1B | 2B | 3-1 | 3-2 | 120–10 | — | — | — | — | 6A | 140–20 | — | — |
| | 84 | 1B | 2B | 4-1 | 4-2 | 120–10 | — | — | — | — | 6A | 140–20 | — | — |
| | 85 | 1B | 2B | 5-1 | 5-2 | 120–10 | — | — | — | — | 6A | 140–20 | — | — |
| | 86 | 1B | 2B | 6-1 | 6-2 | 120–10 | — | — | — | — | 6A | 140–20 | — | — |
| | 87 | 1B | 2B | 7-1 | 7-2 | 120–10 | — | — | — | — | 6A | 140–20 | — | — |
| | 88 | 1B | 2B | 8-1 | 8-2 | 120–10 | — | — | — | — | 6A | 140–20 | — | — |
| | 89 | 1B | 2B | 9-1 | 9-2 | 120–10 | — | — | — | — | 6A | 140–20 | — | — |
| | 90 | 1B | 2B | 10-1 | 10-2 | 120–10 | — | — | — | — | 6A | 140–20 | — | — |
| | 91 | 1C | 2B | 1-1 | 1-2 | 120–10 | — | — | — | — | 6A | 140–20 | — | — |
| | 92 | 1C | 2B | 3-1 | 3-2 | 120–10 | — | — | — | — | 6A | 140–20 | — | — |
| | 93 | 1C | 2B | 4-1 | 4-2 | 120–10 | — | — | — | — | 6A | 140–20 | — | — |
| | 94 | 1C | 2B | 5-1 | 5-2 | 120–10 | — | — | — | — | 6A | 140–20 | — | — |
| | 95 | 1C | 2B | 7-1 | 7-2 | 120–10 | — | — | — | — | 6A | 140–20 | — | — |
| | 96 | 1C | 2B | 8-1 | 8-2 | 120–10 | — | — | — | — | 6A | 140–20 | — | — |
| | 97 | 1D | — | 5-1 | 5-2 | 120–10 | — | — | — | — | 6A | 140–20 | — | — |
| | 98 | 1D | — | 6-1 | 6-2 | 120–10 | — | — | — | — | 6A | 140–20 | — | — |
| | 99 | 1D | — | 7-1 | 7-2 | 120–10 | — | — | — | — | 6A | 140–20 | — | — |
| | 100 | 1D | — | 8-1 | 8-2 | 120–10 | — | — | — | — | 6A | 140–20 | — | — |
| | 101 | 1E | 2C | 1-1 | 1-2 | 80–20 | — | — | — | — | 6E | 80–20 | — | — |
| | 102 | 1E | 2C | 2-1 | 2-2 | 80–20 | — | — | — | — | 6E | 80–20 | — | — |
| | 103 | 1E | 2C | 3-1 | 3-2 | 80–20 | — | — | — | — | 6E | 80–20 | — | — |
| | 104 | 1E | 2C | 4-1 | 4-2 | 80–20 | — | — | — | — | 6E | 80–20 | — | — |
| | 105 | 1A | 2A | 24-1 | 24-2 | 120–10 | — | — | — | — | 6A | 140–20 | — | — |
| | 106 | 1A | 2A | 24-1 | 24-2 | 120–10 | — | — | — | — | 6B | 140–20 | — | — |
| | 107 | 1B | 2B | 24-1 | 24-2 | 120–10 | — | — | — | — | 6A | 140–20 | — | — |
| | 108 | 1C | 2B | 24-1 | 24-2 | 120–10 | — | — | — | — | 6A | 140–20 | — | — |
| | 109 | 1D | — | 24-1 | 24-2 | 120–10 | — | — | — | — | 6A | 140–20 | — | — |
| | 110 | 1E | 2C | 24-1 | 24-2 | 80–20 | — | — | — | — | 6E | 80–20 | — | — |
| | 111 | 1A | 2A | 25-1 | 25-2 | 120–10 | — | — | — | — | 6A | 140–20 | — | — |
| | 112 | 1B | 2B | 26-1 | 26-2 | 120–10 | — | — | — | — | 6A | 140–20 | — | — |
| | 113 | 1C | 2B | 27-1 | 27-2 | 120–10 | — | — | — | — | 6A | 140–20 | — | — |
| | 114 | 1D | — | 28-1 | 28-2 | 120–10 | — | — | — | — | 6E | 80–20 | — | — |
| | 115 | 1E | 2C | 29-1 | 29-2 | 80–20 | — | — | — | — | 6A | 140–20 | — | — |
| | 116 | 1A | 2A | 30-1 | 30-2 | 120–10 | — | — | — | — | 6A | 140–20 | — | — |
| | 117 | 1A | 2A | 31-1 | 31-2 | 120–10 | — | — | — | — | 6A | 140–20 | — | — |
| | 118 | 1B | 2B | 31-1 | 31-2 | 120–10 | — | — | — | — | 6B | 140–20 | — | — |
| | 119 | 1C | 2B | 31-1 | 31-2 | 120–10 | — | — | — | — | 6A | 140–20 | — | — |
| | 120 | 1D | — | 31-1 | 31-2 | 120–10 | — | — | — | — | 6A | 140–20 | — | — |

TABLE 2C-continued

| Example/ comparison | No. | Evaluation: When the brilliant base coating film (1) is used: Metal feeling (1) | Metal feeling (2) | Metal feeling (3) | Hue uni-formity | Gloss feel-ing | Weath-er-ability | Film perfor-mance | When the brilliant base coating film(2) is used: use phosphate group-containing acryl resin. Metal feeling (1) | Metal feeling (2) | Metal feeling (3) | Hue uni-formity | Gloss feel-ing | Weath-er-ability | Film perfor-mance |
|---|---|---|---|---|---|---|---|---|---|---|---|---|---|---|---|
| Example | 81 | — | 3 | — | 2-3 | — | 2 | 2-3 | — | 3 | — | 2-3 | — | 2 | 3 |
| | 82 | — | 3 | — | 2-3 | — | 2 | 2-3 | — | 3 | — | 2-3 | — | 2 | 3 |
| | 83 | — | 3 | — | 2-3 | — | 2 | 2-3 | — | 3 | — | 2-3 | — | 2 | 3 |
| | 84 | — | 3 | — | 2-3 | — | 2 | 2-3 | — | 3 | — | 2-3 | — | 2 | 3 |
| | 85 | — | 3 | — | 2-3 | — | 3 | 2-3 | — | 3 | — | 2-3 | — | 3 | 3 |
| | 86 | — | 3 | — | 2-3 | — | 3 | 2-3 | — | 3 | — | 2-3 | — | 3 | 3 |
| | 87 | — | 3 | — | 2-3 | — | 3 | 2-3 | — | 3 | — | 2-3 | — | 3 | 3 |
| | 88 | — | 3 | — | 2-3 | — | 3 | 2-3 | — | 3 | — | 2-3 | — | 3 | 3 |
| | 89 | — | 3 | — | 2-3 | — | 3 | 2-3 | — | 3 | — | 2-3 | — | 3 | 3 |
| | 90 | — | 3 | — | 2-3 | — | 3 | 2-3 | — | 3 | — | 2-3 | — | 3 | 3 |
| | 91 | — | 3 | — | 2-3 | — | 2 | 2-3 | — | 3 | — | 2-3 | — | 2 | 3 |
| | 92 | — | 3 | — | 2-3 | — | 2 | 2-3 | — | 3 | — | 2-3 | — | 2 | 3 |
| | 93 | — | 3 | — | 2-3 | — | 2 | 2-3 | — | 3 | — | 2-3 | — | 2 | 3 |
| | 94 | — | 3 | — | 2-3 | — | 3 | 2-3 | — | 3 | — | 2-3 | — | 3 | 3 |
| | 95 | — | 3 | — | 2-3 | — | 3 | 2-3 | — | 3 | — | 2-3 | — | 3 | 3 |
| | 96 | — | 3 | — | 2-3 | — | 3 | 2-3 | — | 3 | — | 2-3 | — | 3 | 3 |
| | 97 | — | 3 | — | 2-3 | — | 3 | 2-3 | — | 3 | — | 2-3 | — | 3 | 3 |
| | 98 | — | 3 | — | 2-3 | — | 3 | 2-3 | — | 3 | — | 2-3 | — | 3 | 3 |
| | 99 | — | 3 | — | 2-3 | — | 3 | 2-3 | — | 3 | — | 2-3 | — | 3 | 3 |
| | 100 | — | 3 | — | 2-3 | — | 3 | 2-3 | — | 3 | — | 2-3 | — | 3 | 3 |
| | 101 | — | 3 | — | 2-3 | — | 2 | 2-3 | — | 3 | — | 2-3 | — | 2 | 3 |
| | 102 | — | 3 | — | 2-3 | — | 2 | 2-3 | — | 3 | — | 2-3 | — | 2 | 3 |
| | 103 | — | 3 | — | 2-3 | — | 2 | 2-3 | — | 3 | — | 2-3 | — | 2 | 3 |
| | 104 | — | 3 | — | 2-3 | — | 2 | 2-3 | — | 3 | — | 2-3 | — | 2 | 3 |
| | 105 | — | 3 | 3 | 2-3 | — | 3 | 3 | — | 3 | 3 | 2-3 | — | 3 | 3 |
| | 106 | — | 3 | 3 | 2-3 | — | 3 | 3 | — | 3 | 3 | 2-3 | — | 3 | 3 |
| | 107 | — | 3 | 3 | 2-3 | — | 3 | 3 | — | 3 | 3 | 2-3 | — | 3 | 3 |
| | 108 | — | 3 | 3 | 2-3 | — | 3 | 3 | — | 3 | 3 | 2-3 | — | 3 | 3 |
| | 109 | — | 3 | 3 | 2-3 | — | 3 | 3 | — | 3 | 3 | 2-3 | — | 3 | 3 |
| | 110 | — | 3 | 3 | 2-3 | — | 3 | 3 | — | 3 | 3 | 2-3 | — | 3 | 3 |
| | 111 | — | 3 | 3 | 2-3 | — | 3 | 3 | — | 3 | 3 | 2-3 | — | 3 | 3 |
| | 112 | — | 3 | 3 | 2-3 | — | 3 | 3 | — | 3 | 3 | 2-3 | — | 3 | 3 |
| | 113 | — | 3 | 3 | 2-3 | — | 3 | 3 | — | 3 | 3 | 2-3 | — | 3 | 3 |
| | 114 | — | 3 | 3 | 2-3 | — | 3 | 3 | — | 3 | 3 | 2-3 | — | 3 | 3 |
| | 115 | — | 3 | 3 | 2-3 | — | 3 | 3 | — | 3 | 3 | 2-3 | — | 3 | 3 |
| | 116 | — | 3 | 3 | 3 | — | 3 | 3 | — | 3 | 3 | 3 | — | 3 | 3 |
| | 117 | — | 3 | 3 | 2-3 | — | 3 | 3 | — | 3 | 3 | 2-3 | — | 3 | 3 |
| | 118 | — | 3 | 3 | 2-3 | — | 3 | 3 | — | 3 | 3 | 2-3 | — | 3 | 3 |
| | 119 | — | 3 | 3 | 2-3 | — | 3 | 3 | — | 3 | 3 | 2-3 | — | 3 | 3 |
| | 120 | — | 3 | 3 | 2-3 | — | 3 | 3 | — | 3 | 3 | 2-3 | — | 3 | 3 |

TABLE 2D

| Example/ comparison | No. | Substrate to be coated | Intermediate coating film Kind of coating material | Brilliant base coating film (1) or (2) Paint No. (1) | Paint No. (2) | Baking (° C.) | Clear coating film: Brilliant clear coating film Paint No. | Baking (° C.) | Color clear coating film Paint No. | Baking (° C.) | Matting clear coating film Paint No. | Baking (° C.) | Top clear coating film Paint No. | Baking (° C.) |
|---|---|---|---|---|---|---|---|---|---|---|---|---|---|---|
| Example | 121 | 1E | 2C | 31-1 | 31-2 | 80–20 | — | — | — | — | 6E | 80–20 | — | — |
| | 122 | 1A | 2A | 32-1 | 32-2 | 120–10 | — | — | — | — | 6A | 140–20 | — | — |
| | 123 | 1B | 2B | 33-1 | 33-2 | 120–10 | — | — | — | — | 6A | 140–20 | — | — |
| | 124 | 1C | 2B | 34-1 | 34-2 | 120–10 | — | — | — | — | 6A | 140–20 | — | — |
| | 125 | 1D | — | 35-1 | 35-2 | 120–10 | — | — | — | — | 6A | 140–20 | — | — |
| | 126 | 1E | 2C | 36-1 | 36-2 | 80–20 | — | — | — | — | 6E | 80–20 | — | — |
| | 127 | 1A | 2A | 37-1 | 37-2 | 120–10 | — | — | — | — | 6A | 140–20 | — | — |
| | 128 | 1B | 2B | 38-1 | 38-2 | 120–10 | — | — | — | — | 6A | 140–20 | — | — |
| | 129 | 1C | 2B | 39-1 | 39-2 | 120–10 | — | — | — | — | 6A | 140–20 | — | — |
| | 130 | 1D | — | 40-1 | 40-2 | 120-20 | — | — | — | — | 6A | 140–20 | — | — |
| | 131 | 1E | 2C | 41-1 | 41-2 | 80–20 | — | — | — | — | 6E | 80–20 | — | — |
| | 132 | 1A | 2A | 42-1 | 42-2 | 120–10 | — | — | — | — | 6A | 140–20 | — | — |
| | 133 | 1B | 2B | 43-1 | 43-2 | 120–10 | — | — | — | — | 6A | 140–20 | — | — |
| | 134 | 1C | 2B | 44-1 | 44-2 | 120–10 | — | — | — | — | 6A | 140–20 | — | — |
| | 135 | 1D | — | 45-1 | 45-2 | 120–10 | — | — | — | — | 6A | 140–20 | — | — |
| | 136 | 1E | 2C | 46 | — | 80–20 | — | — | — | — | 6E | 80–20 | — | — |

TABLE 2D-continued

| | | | | | | | | | | | | | | |
|---|---|---|---|---|---|---|---|---|---|---|---|---|---|---|
| | 137 | 1B | 2B | 7-1 | 7-2 | 120–10 | — | — | — | — | 6C | 140–20 | — | — |
| | 138 | 1B | 2B | 7-1 | 7-2 | 120–10 | — | — | — | — | 6D | 140–20 | — | — |
| | 139 | 1A | 2A | 11 | — | 120–10 | — | — | — | — | 6A | 140–20 | — | — |
| | 140 | 1A | 2B | 11 | — | 120–10 | — | — | — | — | 6A | 140–20 | — | — |
| Comparison | 3 | 1B | 2A | 47-1 | 47-2 | 120–10 | — | — | — | — | 6A | 140–20 | — | — |
| | 4 | 1B | 2B | 47-1 | 47-2 | 120–10 | — | — | — | — | 6A | 140–20 | — | — |
| Example | 141 | 1A | 2A | 1-1 | 1-2 | 120–10 | — | — | 7A | 140–20 | — | — | — | — |
| | 142 | 1A | 2A | 1-1 | 1-2 | 120–10 | 5A | W/W | 7A | 140–20 | — | — | — | — |
| | 143 | 1A | 2A | 2-1 | 2-2 | 120–10 | 5A | W/W | 7A | 140–20 | — | — | — | — |
| | 144 | 1A | 2A | 3-1 | 3-2 | 120–10 | 5A | W/W | 7A | 140–20 | — | — | — | — |
| | 145 | 1A | 2A | 4-1 | 4-2 | 120–10 | 5A | W/W | 7A | 140–20 | — | — | — | — |
| | 146 | 1A | 2A | 5-1 | 5-2 | 120–10 | 5A | W/W | 7A | 140–20 | — | — | — | — |
| | 147 | 1A | 2A | 6-1 | 6-2 | 120–10 | 5A | W/W | 7A | 140–20 | — | — | — | — |
| | 148 | 1A | 2A | 7-1 | 7-2 | 120–10 | 5A | W/W | 7A | 140–20 | — | — | — | — |
| | 149 | 1A | 2A | 8-1 | 8-2 | 120–10 | 5A | W/W | 7A | 140–20 | — | — | — | — |
| | 150 | 1A | 2A | 9-1 | 9-2 | 120–10 | 5A | W/W | 7A | 140–20 | — | — | — | — |
| | 151 | 1A | 2A | 10-1 | 10-2 | 120–10 | 5A | W/W | 7A | 140–20 | — | — | — | — |
| | 152 | 1A | 2A | 1-1 | 1-2 | 120–10 | 5A | W/W | 7B | 140–20 | — | — | — | — |
| | 153 | 1B | 2B | 1-1 | 1-2 | 120–10 | — | — | 7A | 140–20 | — | — | — | — |
| | 154 | 1B | 2B | 1-1 | 1-2 | 120–10 | 5A | W/W | 7A | 140–20 | — | — | — | — |
| | 155 | 1B | 2B | 3-1 | 3-2 | 120–10 | 5A | W/W | 7A | 140–20 | — | — | — | — |
| | 156 | 1B | 2B | 4-1 | 4-2 | 120–10 | 5A | W/W | 7A | 140–20 | — | — | — | — |
| | 157 | 1B | 2B | 5-1 | 5-2 | 120–10 | 5A | W/W | 7A | 140–20 | — | — | — | — |
| | 158 | 1B | 2B | 7-1 | 7-2 | 120–10 | 5A | W/W | 7A | 140–20 | — | — | — | — |
| | 159 | 1B | 2B | 8-1 | 8-2 | 120–10 | 5A | W/W | 7A | 140–20 | — | — | — | — |
| | 160 | 1C | 2B | 1-1 | 1-2 | 120–10 | — | — | 7A | 140–20 | — | — | — | — |

| | | Evaluation | | | | | | | | | | | | | |
|---|---|---|---|---|---|---|---|---|---|---|---|---|---|---|---|
| | | When the brilliant base coating film (1) is used: | | | | | | | When the brilliant base coating film(2) is used: use phosphate group-containing acryl resin. | | | | | | |
| Example/ comparison | No. | Metal feeling (1) | Metal feeling (2) | Metal feeling (3) | Hue uni-formity | Gloss feel-ing | Weath-er-ability | Film perfor-mance | Metal feeling (1) | Metal feeling (2) | Metal feeling (3) | Hue uni-formity | Gloss feel-ing | Weath-er-ability | Film perfor-mance |
| Example | 121 | — | 3 | 3 | 2-3 | — | 3 | 3 | — | 3 | 3 | 2-3 | — | 3 | 3 |
| | 122 | — | 3 | 3 | 2-3 | — | 3 | 3 | — | 3 | 3 | 2-3 | — | 3 | 3 |
| | 123 | — | 3 | 3 | 2-3 | — | 3 | 3 | — | 3 | 3 | 2-3 | — | 3 | 3 |
| | 124 | — | 3 | 3 | 2-3 | — | 3 | 3 | — | 3 | 3 | 2-3 | — | 3 | 3 |
| | 125 | — | 3 | 3 | 2-3 | — | 3 | 3 | — | 3 | 3 | 2-3 | — | 3 | 3 |
| | 126 | — | 3 | 3 | 2-3 | — | 3 | 3 | — | 3 | 3 | 2-3 | — | 3 | 3 |
| | 127 | — | 3 | 3 | 2-3 | — | 3 | 3 | — | 3 | 3 | 2-3 | — | 3 | 3 |
| | 128 | — | 3 | 3 | 2-3 | — | 3 | 3 | — | 3 | 3 | 2-3 | — | 3 | 3 |
| | 129 | — | 3 | 3 | 2-3 | — | 3 | 3 | — | 3 | 3 | 2-3 | — | 3 | 3 |
| | 130 | — | 3 | 3 | 3 | — | 3 | 3 | — | 3 | 3 | 3 | — | 3 | 3 |
| | 131 | — | 3 | 3 | 3 | — | 3 | 3 | — | 3 | 3 | 3 | — | 3 | 3 |
| | 132 | — | 3 | 3 | 3 | — | 3 | 3 | — | 3 | 3 | 3 | — | 3 | 3 |
| | 133 | — | 3 | 3 | 3 | — | 3 | 3 | — | 3 | 3 | 3 | — | 3 | 3 |
| | 134 | — | 3 | 3 | 3 | — | 3 | 3 | — | 3 | 3 | 3 | — | 3 | 3 |
| | 135 | — | 3 | 3 | 3 | — | 3 | 3 | — | 3 | 3 | 3 | — | 3 | 3 |
| | 136 | — | 3 | 3 | 2-3 | — | 2 | 2-3 | — | — | — | — | — | — | — |
| | 137 | — | 3 | — | 2-3 | — | 3 | 2-3 | — | 3 | — | 2-3 | — | 3 | 3 |
| | 138 | — | 3 | — | 2-3 | — | 3 | 2-3 | — | 3 | — | 2-3 | — | 3 | 3 |
| | 139 | — | 3 | — | 2-3 | — | 2 | 2-3 | — | — | — | — | — | — | — |
| | 140 | — | 3 | — | 2-3 | — | 2 | 2-3 | — | — | — | — | — | — | — |
| Comparison | 3 | — | 1 | — | 3 | — | 3 | 3 | — | 1 | — | 3 | — | 3 | 3 |
| | 4 | — | 1 | — | 3 | — | 3 | 3 | — | 1 | — | 3 | — | 3 | 3 |
| Example | 141 | 2 | — | — | 2-3 | 3 | 2-3 | 2-3 | 2 | — | — | 2-3 | 3 | 2-3 | 3 |
| | 142 | 3 | — | — | 2-3 | 3 | 2-3 | 2-3 | 3 | — | — | 2-3 | 3 | 2-3 | 3 |
| | 143 | 3 | — | — | 2-3 | 3 | 2-3 | 2-3 | 3 | — | — | 2-3 | 3 | 2-3 | 3 |
| | 144 | 3 | — | — | 2-3 | 3 | 2-3 | 2-3 | 3 | — | — | 2-3 | 3 | 2-3 | 3 |
| | 145 | 3 | — | — | 2-3 | 3 | 2-3 | 2-3 | 3 | — | — | 2-3 | 3 | 2-3 | 3 |
| | 146 | 3 | — | — | 2-3 | 3 | 3 | 2-3 | 3 | — | — | 2-3 | 3 | 3 | 3 |
| | 147 | 3 | — | — | 2-3 | 3 | 3 | 2-3 | 3 | — | — | 2-3 | 3 | 3 | 3 |
| | 148 | 3 | — | — | 2-3 | 3 | 3 | 2-3 | 3 | — | — | 2-3 | 3 | 3 | 3 |
| | 149 | 3 | — | — | 2-3 | 3 | 3 | 2-3 | 3 | — | — | 2-3 | 3 | 3 | 3 |
| | 150 | 3 | — | — | 2-3 | 3 | 3 | 2-3 | 3 | — | — | 2-3 | 3 | 3 | 3 |
| | 151 | 3 | — | — | 2-3 | 3 | 2-3 | 2-3 | 3 | — | — | 2-3 | 3 | 2-3 | 3 |
| | 152 | 3 | — | — | 2-3 | 3 | 2-3 | 2-3 | 3 | — | — | 2-3 | 3 | 2-3 | 3 |
| | 153 | 2 | — | — | 2-3 | 3 | 2-3 | 2-3 | 2 | — | — | 2-3 | 3 | 2-3 | 3 |
| | 154 | 3 | — | — | 2-3 | 3 | 2-3 | 2-3 | 3 | — | — | 2-3 | 3 | 2-3 | 3 |
| | 155 | 3 | — | — | 2-3 | 3 | 2-3 | 2-3 | 3 | — | — | 2-3 | 3 | 2-3 | 3 |
| | 156 | 3 | — | — | 2-3 | 3 | 2-3 | 2-3 | 3 | — | — | 2-3 | 3 | 2-3 | 3 |
| | 157 | 3 | — | — | 2-3 | 3 | 3 | 2-3 | 3 | — | — | 2-3 | 3 | 3 | 3 |
| | 158 | 3 | — | — | 2-3 | 3 | 3 | 2-3 | 3 | — | — | 2-3 | 3 | 3 | 3 |
| | 159 | 3 | — | — | 2-3 | 3 | 3 | 2-3 | 3 | — | — | 2-3 | 3 | 3 | 3 |
| | 160 | 2 | — | — | 2-3 | 3 | 2-3 | 2-3 | 2 | — | — | 2-3 | 3 | 2-3 | 3 |

TABLE 2E

| Example/ comparison | No. | Substrate to be coated | Intermediate coating film Kind of coating material | Brilliant base coating film (1) or (2) Paint No. (1) | Paint No. (2) | Baking (° C.) | Clear coating film: Brilliant clear coating film Paint No. | Baking (° C.) | Color clear coating film Paint No. | Baking (° C.) | Matting clear coating film Paint No. | Baking (° C.) | Top clear coating film Paint No. | Baking (° C.) |
|---|---|---|---|---|---|---|---|---|---|---|---|---|---|---|
| Example | 161 | 1C | 2B | 1-1 | 1-2 | 120–10 | 5A | W/W | 7A | 140–20 | — | — | — | — |
| | 162 | 1C | 2B | 3-1 | 3-2 | 120–10 | 5A | W/W | 7A | 140–20 | — | — | — | — |
| | 163 | 1C | 2B | 4-1 | 4-2 | 120–10 | 5A | W/W | 7A | 140–20 | — | — | — | — |
| | 164 | 1C | 2B | 5-1 | 5-2 | 120–10 | 5A | W/W | 7A | 140–20 | — | — | — | — |
| | 165 | 1C | 2B | 7-1 | 7-2 | 120–10 | 5A | W/W | 7A | 140–20 | — | — | — | — |
| | 166 | 1C | 2B | 8-1 | 8-2 | 120–10 | 5A | W/W | 7A | 140–20 | — | — | — | — |
| | 167 | 1D | — | 5-1 | 5-2 | 120–10 | 5A | W/W | 7A | 140–20 | — | — | — | — |
| | 168 | 1D | — | 6-1 | 6-2 | 120–10 | 5A | W/W | 7A | 140–20 | — | — | — | — |
| | 169 | 1D | — | 7-1 | 7-2 | 120–10 | 5A | W/W | 7A | 140–20 | — | — | — | — |
| | 170 | 1D | — | 8-1 | 8-2 | 120–10 | 5A | W/W | 7A | 140–20 | — | — | — | — |
| | 171 | 1E | 2C | 5-1 | 5-2 | 80–20 | 5D | W/W | 7E | 80–20 | — | — | — | — |
| | 172 | 1E | 2C | 6-1 | 6-2 | 80–20 | 5D | W/W | 7E | 80–20 | — | — | — | — |
| | 173 | 1E | 2C | 7-1 | 7-2 | 80–20 | 5D | W/W | 7E | 80–20 | — | — | — | — |
| | 174 | 1E | 2C | 8-1 | 8-2 | 80–20 | 5D | W/W | 7E | 80–20 | — | — | — | — |
| | 175 | 1A | 2A | 24-1 | 24-2 | 120–10 | — | — | 7A | 140–20 | — | — | — | — |
| | 176 | 1A | 2A | 24-1 | 24-2 | 120–10 | 5A | W/W | 7A | 140–20 | — | — | — | — |
| | 177 | 1B | 2B | 24-1 | 24-2 | 120–10 | 5A | W/W | 7B | 140–20 | — | — | — | — |
| | 178 | 1C | 2B | 24-1 | 24-2 | 120–10 | 5A | W/W | 7A | 140–20 | — | — | — | — |
| | 179 | 1D | — | 24-1 | 24-2 | 120–10 | 5A | W/W | 7A | 140–20 | — | — | — | — |
| | 180 | 1E | 2C | 24-1 | 24-2 | 80–20 | 5A | W/W | 7E | 80–20 | — | — | — | — |
| | 181 | 1A | 2A | 25-1 | 24-2 | 120–10 | 5A | W/W | 7A | 140–20 | — | — | — | — |
| | 182 | 1B | 2B | 26-1 | 25-2 | 120–10 | 5A | W/W | 7A | 140–20 | — | — | — | — |
| | 183 | 1C | 2B | 27-1 | 26-2 | 120–10 | 5A | W/W | 7A | 140–20 | — | — | — | — |
| | 184 | 1D | — | 28-1 | 27-2 | 120–10 | 5A | W/W | 7A | 140–20 | — | — | — | — |
| | 185 | 1E | 2C | 29-1 | 28-2 | 80–20 | 5A | W/W | 7E | 80–20 | — | — | — | — |
| | 186 | 1A | 2A | 30-1 | 29-2 | 120–10 | 5A | W/W | 7A | 140–20 | — | — | — | — |
| | 187 | 1A | 2A | 31-1 | 30-2 | 120–10 | — | — | 7A | 140–20 | — | — | — | — |
| | 188 | 1A | 2A | 31-1 | 31-2 | 120–10 | 5A | W/W | 7A | 140–20 | — | — | — | — |
| | 189 | 1B | 2B | 31-1 | 31-2 | 120–10 | 5A | W/W | 7B | 140–20 | — | — | — | — |
| | 190 | 1C | 2B | 31-1 | 31-2 | 120–10 | 5A | W/W | 7A | 140–20 | — | — | — | — |
| | 191 | 1D | — | 31-1 | 31-2 | 120–10 | 5A | W/W | 7A | 140–20 | — | — | — | — |
| | 192 | 1E | 2C | 31-1 | 31-2 | 80–20 | 5A | W/W | 7E | 80–20 | — | — | — | — |
| | 193 | 1A | 2A | 32-1 | 32-2 | 120–10 | 5A | W/W | 7A | 140–20 | — | — | — | — |
| | 194 | 1B | 2B | 33-1 | 33-2 | 120–10 | 5A | W/W | 7A | 140–20 | — | — | — | — |
| | 195 | 1C | 2B | 34-1 | 34-2 | 120–10 | 5A | W/W | 7A | 140–20 | — | — | — | — |
| | 196 | 1D | — | 35-1 | 35-2 | 120–10 | 5A | W/W | 7A | 140–20 | — | — | — | — |
| | 197 | 1E | 2C | 36-1 | 36-2 | 80–20 | 5A | W/W | 7E | 80–20 | — | — | — | — |
| | 198 | 1A | 2A | 37-1 | 37-2 | 120–10 | 5A | W/W | 7A | 140–20 | — | — | — | — |
| | 199 | 1B | 2B | 38-1 | 38-2 | 120–10 | 5A | W/W | 7A | 140–20 | — | — | — | — |
| | 200 | 1C | 2B | 39-1 | 39-2 | 120–10 | 5A | W/W | 7A | 140–20 | — | — | — | — |

| Example/ comparison | No. | Evaluation: When the brilliant base coating film (1) is used: Metal feeling (1) | Metal feeling (2) | Metal feeling (3) | Hue uniformity | Gloss feeling | Weatherability | Film performance | When the brilliant base coating film(2) is used: use phosphate group-containing acryl resin. Metal feeling (1) | Metal feeling (2) | Metal feeling (3) | Hue uniformity | Gloss feeling | Weatherability | Film performance |
|---|---|---|---|---|---|---|---|---|---|---|---|---|---|---|---|
| Example | 161 | 3 | — | — | 2-3 | 3 | 2-3 | 2-3 | 3 | — | — | 2-3 | 3 | 2-3 | 3 |
| | 162 | 3 | — | — | 2-3 | 3 | 2-3 | 2-3 | 3 | — | — | 2-3 | 3 | 2-3 | 3 |
| | 163 | 3 | — | — | 2-3 | 3 | 2-3 | 2-3 | 3 | — | — | 2-3 | 3 | 2-3 | 3 |
| | 164 | 3 | — | — | 2-3 | 3 | 3 | 2-3 | 3 | — | — | 2-3 | 3 | 3 | 3 |
| | 165 | 3 | — | — | 2-3 | 3 | 3 | 2-3 | 3 | — | — | 2-3 | 3 | 3 | 3 |
| | 166 | 3 | — | — | 2-3 | 3 | 3 | 2-3 | 3 | — | — | 2-3 | 3 | 3 | 3 |
| | 167 | 3 | — | — | 2-3 | 3 | 3 | 2-3 | 3 | — | — | 2-3 | 3 | 3 | 3 |
| | 168 | 3 | — | — | 2-3 | 3 | 3 | 2-3 | 3 | — | — | 2-3 | 3 | 3 | 3 |
| | 169 | 3 | — | — | 2-3 | 3 | 3 | 2-3 | 3 | — | — | 2-3 | 3 | 3 | 3 |
| | 170 | 3 | — | — | 2-3 | 3 | 3 | 2-3 | 3 | — | — | 2-3 | 3 | 3 | 3 |
| | 171 | 3 | — | — | 2-3 | 3 | 2 | 2-3 | 3 | — | — | 2-3 | 3 | 2 | 3 |
| | 172 | 3 | — | — | 2-3 | 3 | 2 | 2-3 | 3 | — | — | 2-3 | 3 | 2 | 3 |
| | 173 | 3 | — | — | 2-3 | 3 | 2 | 2-3 | 3 | — | — | 2-3 | 3 | 2 | 3 |
| | 174 | 3 | — | — | 2-3 | 3 | 2 | 2-3 | 3 | — | — | 2-3 | 3 | 2 | 3 |
| | 175 | — | — | 3 | 2-3 | 3 | 3 | 3 | — | — | 3 | 2-3 | 3 | 3 | 3 |
| | 176 | — | — | 3 | 2-3 | 3 | 3 | 3 | — | — | 3 | 2-3 | 3 | 3 | 3 |
| | 177 | — | — | 3 | 2-3 | 3 | 3 | 3 | — | — | 3 | 2-3 | 3 | 3 | 3 |
| | 178 | — | — | 3 | 2-3 | 3 | 3 | 3 | — | — | 3 | 2-3 | 3 | 3 | 3 |
| | 179 | — | — | 3 | 2-3 | 3 | 3 | 3 | — | — | 3 | 2-3 | 3 | 3 | 3 |
| | 180 | — | — | 3 | 2-3 | 3 | 3 | 3 | — | — | 3 | 2-3 | 3 | 3 | 3 |
| | 181 | — | — | 3 | 2-3 | 3 | 3 | 3 | — | — | 3 | 2-3 | 3 | 3 | 3 |

TABLE 2E-continued

| | | | | | | | | | | | | | | |
|---|---|---|---|---|---|---|---|---|---|---|---|---|---|---|
| 182 | — | — | 3 | 2-3 | 3 | 3 | 3 | — | — | 3 | 2-3 | 3 | 3 | 3 |
| 183 | — | — | 3 | 2-3 | 3 | 3 | 3 | — | — | 3 | 2-3 | 3 | 3 | 3 |
| 184 | — | — | 3 | 2-3 | 3 | 3 | 3 | — | — | 3 | 2-3 | 3 | 3 | 3 |
| 185 | — | — | 3 | 2-3 | 3 | 3 | 3 | — | — | 3 | 2-3 | 3 | 3 | 3 |
| 186 | — | — | 3 | 3 | 3 | 3 | 3 | — | — | 3 | 3 | 3 | 3 | 3 |
| 187 | — | — | 3 | 2-3 | 3 | 3 | 3 | — | — | 3 | 2-3 | 3 | 3 | 3 |
| 188 | — | — | 3 | 2-3 | 3 | 3 | 3 | — | — | 3 | 2-3 | 3 | 3 | 3 |
| 189 | — | — | 3 | 2-3 | 3 | 3 | 3 | — | — | 3 | 2-3 | 3 | 3 | 3 |
| 190 | — | — | 3 | 2-3 | 3 | 3 | 3 | — | — | 3 | 2-3 | 3 | 3 | 3 |
| 191 | — | — | 3 | 2-3 | 3 | 3 | 3 | — | — | 3 | 2-3 | 3 | 3 | 3 |
| 192 | — | — | 3 | 2-3 | 3 | 3 | 3 | — | — | 3 | 2-3 | 3 | 3 | 3 |
| 193 | — | — | 3 | 2-3 | 3 | 3 | 3 | — | — | 3 | 2-3 | 3 | 3 | 3 |
| 194 | — | — | 3 | 2-3 | 3 | 3 | 3 | — | — | 3 | 2-3 | 3 | 3 | 3 |
| 195 | — | — | 3 | 2-3 | 3 | 3 | 3 | — | — | 3 | 2-3 | 3 | 3 | 3 |
| 196 | — | — | 3 | 2-3 | 3 | 3 | 3 | — | — | 3 | 2-3 | 3 | 3 | 3 |
| 197 | — | — | 3 | 2-3 | 3 | 3 | 3 | — | — | 3 | 2-3 | 3 | 3 | 3 |
| 198 | — | — | 3 | 2-3 | 3 | 3 | 3 | — | — | 3 | 2-3 | 3 | 3 | 3 |
| 199 | — | — | 3 | 2-3 | 3 | 3 | 3 | — | — | 3 | 2-3 | 3 | 3 | 3 |
| 200 | — | — | 3 | 2-3 | 3 | 3 | 3 | — | — | 3 | 2-3 | 3 | 3 | 3 |

TABLE 2F

| | | | Intermediate | | | | Clear coating film | | | | | | | |
|---|---|---|---|---|---|---|---|---|---|---|---|---|---|---|
| | | Substrate | coating film Kind of | Brilliant base coating film (1) or (2) | | | Brilliant clear coating film | | Color clear coating film | | Matting clear coating film | | Top clear coating film | |
| Example/ comparison | No. | to be coated | coating material | Paint No. (1) | Paint No. (2) | Baking (° C.) | Paint No. | Baking (° C.) | Paint No. | Baking (° C.) | Paint No. | Baking (° C.) | Paint No. | Baking (° C.) |
| Example | 201 | 1D | — | 40-1 | 40-2 | 120–10 | 5A | W/W | 7A | 140–20 | — | — | — | — |
| | 202 | 1E | 2C | 41-1 | 41-2 | 80–20 | 5A | W/W | 7E | 80–20 | — | — | — | — |
| | 203 | 1A | 2A | 42-1 | 42-2 | 120–10 | 5A | W/W | 7A | 140–20 | — | — | — | — |
| | 204 | 1B | 2B | 43-1 | 43-2 | 120–10 | 5A | W/W | 7A | 140–20 | — | — | — | — |
| | 205 | 1C | 2B | 44-1 | 44-2 | 120–10 | 5A | W/W | 7A | 140–20 | — | — | — | — |
| | 206 | 1D | — | 45-1 | 45-2 | 120–10 | 5A | W/W | 7A | 140–20 | — | — | — | — |
| | 207 | 1E | 2C | 46 | — | 80–20 | 5A | W/W | 7E | 80–20 | — | — | — | — |
| | 208 | 1A | 2A | 7-1 | 7-2 | 120–10 | 5B | W/W | — | — | — | — | 4A | 140–20 |
| | 209 | 1A | 2A | 7-1 | 7-2 | 120–10 | 5C | W/W | 7A | 140–20 | — | — | — | — |
| | 210 | 1A | 2A | 7-1 | 7-2 | 120–10 | 5A | W/W | 7C | 140–20 | — | — | — | — |
| | 211 | 1A | 2A | 7-1 | 7-2 | 120–10 | 5A | W/W | 7D | 140–20 | — | — | — | — |
| | 212 | 1B | 2A | 11 | — | 120–10 | 5A | W/W | 7A | 140–20 | — | — | — | — |
| | 213 | 1B | 2B | 11 | — | 120–10 | 5A | W/W | 7A | 140–20 | — | — | — | — |
| Comparison | 5 | 1A | 2A | 47-1 | 47-2 | 120–10 | 5A | W/W | 7A | 140–20 | — | — | — | — |
| | 6 | 1A | 2B | 47-1 | 47-2 | 120–10 | 5A | W/W | 7A | 140–20 | — | — | — | — |
| Example | 214 | 1A | 2A | 12-1 | 12-2 | 120–10 | — | — | 7A | 140–20 | — | — | — | — |
| | 215 | 1A | 2A | 12-1 | 12-2 | 120–10 | 5A | W/W | 7A | 140–20 | — | — | — | — |
| | 216 | 1A | 2A | 13-1 | 13-2 | 120–10 | 5A | W/W | 7A | 140–20 | — | — | — | — |
| | 217 | 1A | 2A | 14-1 | 14-2 | 120–10 | 5A | W/W | 7A | 140–20 | — | — | — | — |
| | 218 | 1A | 2A | 15-1 | 15-2 | 120–10 | 5A | W/W | 7A | 140–20 | — | — | — | — |
| | 219 | 1A | 2A | 16-1 | 16-2 | 120–10 | 5A | W/W | 7A | 140–20 | — | — | — | — |
| | 220 | 1A | 2A | 17-1 | 17-2 | 120–10 | 5A | W/W | 7A | 140–20 | — | — | — | — |
| | 221 | 1A | 2A | 18-1 | 18-2 | 120–10 | 5A | W/W | 7A | 140–20 | — | — | — | — |
| | 222 | 1A | 2A | 19-1 | 19-2 | 120–10 | 5A | W/W | 7A | 140–20 | — | — | — | — |
| | 223 | 1A | 2A | 20-1 | 20-2 | 120–10 | 5A | W/W | 7A | 140–20 | — | — | — | — |
| | 224 | 1A | 2A | 21-1 | 21-2 | 120–10 | 5A | W/W | 7A | 140–20 | — | — | — | — |
| | 225 | 1A | 2A | 12-1 | 12-2 | 120–10 | 5A | W/W | 7B | 140–20 | — | — | — | — |
| | 226 | 1B | 2B | 12-1 | 12-2 | 120–10 | — | — | 7A | 140–20 | — | — | — | — |
| | 227 | 1B | 2B | 12-1 | 12-2 | 120–10 | 5A | W/W | 7A | 140–20 | — | — | — | — |
| | 228 | 1B | 2B | 14-1 | 14-2 | 120–10 | 5A | W/W | 7A | 140–20 | — | — | — | — |
| | 229 | 1B | 2B | 15-1 | 15-2 | 120–10 | 5A | W/W | 7A | 140–20 | — | — | — | — |
| | 230 | 1B | 2B | 16-1 | 16-2 | 120–10 | 5A | W/W | 7A | 140–20 | — | — | — | — |
| | 231 | 1B | 2B | 17-1 | 17-2 | 120–10 | 5A | W/W | 7A | 140–20 | — | — | — | — |
| | 232 | 1B | 2B | 18-1 | 18-2 | 120–10 | 5A | W/W | 7A | 140–20 | — | — | — | — |
| | 233 | 1C | 2B | 12-1 | 12-2 | 120–10 | — | — | 7A | 140–20 | — | — | — | — |
| | 234 | 1C | 2B | 12-1 | 12-2 | 120–10 | 5A | W/W | 7A | 140–20 | — | — | — | — |
| | 235 | 1C | 2B | 14-1 | 14-2 | 120–10 | 5A | W/W | 7A | 140–20 | — | — | — | — |
| | 236 | 1C | 2B | 15-1 | 15-2 | 120–10 | 5A | W/W | 7A | 140–20 | — | — | — | — |
| | 237 | 1C | 2B | 16-1 | 16-2 | 120–10 | 5A | W/W | 7A | 140–20 | — | — | — | — |
| | 238 | 1C | 2B | 18-1 | 18-2 | 120–10 | 5A | W/W | 7A | 140–20 | — | — | — | — |
| | 239 | 1C | 2B | 19-1 | 19-2 | 120–10 | 5A | W/W | 7A | 140–20 | — | — | — | — |
| | 240 | 1D | — | 16-1 | 16-2 | 120–10 | 5A | W/W | 7A | 140–20 | — | — | — | — |

TABLE 2F-continued

| | | Evaluation | | | | | | | | | | | | | |
|---|---|---|---|---|---|---|---|---|---|---|---|---|---|---|---|
| | | When the brilliant base coating film (1) is used: | | | | | | | When the brilliant base coating film(2) is used: use phosphate group-containing acryl resin. | | | | | | |
| Example/ comparison | No. | Metal feeling (1) | Metal feeling (2) | Metal feeling (3) | Hue uni-formity | Gloss feel-ing | Weath-er-ability | Film perfor-mance | Metal feeling (1) | Metal feeling (2) | Metal feeling (3) | Hue uni-formity | Gloss feel-ing | Weath-er-ability | Film perfor-mance |
| Example | 201 | — | — | 3 | 3 | 3 | 3 | 3 | — | — | 3 | 3 | 3 | 3 | 3 |
| | 202 | — | — | 3 | 3 | 3 | 3 | 3 | — | — | 3 | 3 | 3 | 3 | 3 |
| | 203 | — | — | 3 | 3 | 3 | 3 | 3 | — | — | 3 | 3 | 3 | 3 | 3 |
| | 204 | — | — | 3 | 3 | 3 | 3 | 3 | — | — | 3 | 3 | 3 | 3 | 3 |
| | 205 | — | — | 3 | 3 | 3 | 3 | 3 | — | — | 3 | 3 | 3 | 3 | 3 |
| | 206 | — | — | 3 | 3 | 3 | 3 | 3 | — | — | 3 | 3 | 3 | 3 | 3 |
| | 207 | — | — | 3 | 2-3 | 3 | 2 | 2-3 | — | — | — | — | — | — | — |
| | 208 | 3 | — | — | 2-3 | 3 | 3 | 2-3 | 3 | — | — | 2-3 | 3 | 3 | 3 |
| | 209 | 3 | — | — | 2-3 | 3 | 3 | 2-3 | 3 | — | — | 2-3 | 3 | 3 | 3 |
| | 210 | 3 | — | — | 2-3 | 3 | 3 | 2-3 | 3 | — | — | 2-3 | 3 | 3 | 3 |
| | 211 | 3 | — | — | 2-3 | 3 | 3 | 2-3 | 3 | — | — | 2-3 | 3 | 3 | 2-3 |
| | 212 | 3 | — | — | 2-3 | 3 | 2 | 2-3 | — | — | — | — | — | — | — |
| | 213 | 3 | — | — | 2-3 | 3 | 2 | 2-3 | — | — | — | — | — | — | — |
| Comparison | 5 | 1 | — | — | 3 | 1 | 3 | 3 | 1 | — | — | 3 | 1 | 3 | 3 |
| | 6 | 1 | — | — | 3 | 1 | 3 | 3 | 1 | — | — | 3 | 1 | 3 | 3 |
| Example | 214 | — | — | 2 | 2-3 | 3 | 2-3 | 2-3 | — | — | 2 | 2-3 | 3 | 2-3 | 3 |
| | 215 | — | — | 3 | 2-3 | 3 | 2-3 | 2-3 | — | — | 3 | 2-3 | 3 | 2-3 | 3 |
| | 216 | — | — | 3 | 2-3 | 3 | 2-3 | 2-3 | — | — | 3 | 2-3 | 3 | 2-3 | 3 |
| | 217 | — | — | 3 | 2-3 | 3 | 2-3 | 2-3 | — | — | 3 | 2-3 | 3 | 2-3 | 3 |
| | 218 | — | — | 3 | 2-3 | 3 | 2-3 | 2-3 | — | — | 3 | 2-3 | 3 | 2-3 | 3 |
| | 219 | — | — | 3 | 2-3 | 3 | 3 | 2-3 | — | — | 3 | 2-3 | 3 | 3 | 3 |
| | 220 | — | — | 3 | 2-3 | 3 | 3 | 2-3 | — | — | 3 | 2-3 | 3 | 3 | 3 |
| | 221 | — | — | 3 | 2-3 | 3 | 3 | 2-3 | — | — | 3 | 2-3 | 3 | 3 | 3 |
| | 222 | — | — | 3 | 2-3 | 3 | 3 | 2-3 | — | — | 3 | 2-3 | 3 | 3 | 3 |
| | 223 | — | — | 3 | 2-3 | 3 | 3 | 2-3 | — | — | 3 | 2-3 | 3 | 3 | 3 |
| | 224 | — | — | 3 | 2-3 | 3 | 3 | 2-3 | — | — | 3 | 2-3 | 3 | 3 | 3 |
| | 225 | — | — | 3 | 2-3 | 3 | 2-3 | 2-3 | — | — | 3 | 2-3 | 3 | 2-3 | 3 |
| | 226 | — | — | 2 | 2-3 | 3 | 2-3 | 2-3 | — | — | 2 | 2-3 | 3 | 2-3 | 3 |
| | 227 | — | — | 3 | 2-3 | 3 | 2-3 | 2-3 | — | — | 3 | 2-3 | 3 | 2-3 | 3 |
| | 228 | — | — | 3 | 2-3 | 3 | 2-3 | 2-3 | — | — | 3 | 2-3 | 3 | 2-3 | 3 |
| | 229 | — | — | 3 | 2-3 | 3 | 2-3 | 2-3 | — | — | 3 | 2-3 | 3 | 2-3 | 3 |
| | 230 | — | — | 3 | 2-3 | 3 | 3 | 2-3 | — | — | 3 | 2-3 | 3 | 3 | 3 |
| | 231 | — | — | 3 | 2-3 | 3 | 3 | 2-3 | — | — | 3 | 2-3 | 3 | 3 | 3 |
| | 232 | — | — | 3 | 2-3 | 3 | 3 | 2-3 | — | — | 3 | 2-3 | 3 | 3 | 3 |
| | 233 | — | — | 2 | 2-3 | 3 | 2-3 | 2-3 | — | — | 2 | 2-3 | 3 | 2-3 | 3 |
| | 234 | — | — | 3 | 2-3 | 3 | 2-3 | 2-3 | — | — | 3 | 2-3 | 3 | 2-3 | 3 |
| | 235 | — | — | 3 | 2-3 | 3 | 2-3 | 2-3 | — | — | 3 | 2-3 | 3 | 2-3 | 3 |
| | 236 | — | — | 3 | 2-3 | 3 | 2-3 | 2-3 | — | — | 3 | 2-3 | 3 | 2-3 | 3 |
| | 237 | — | — | 3 | 2-3 | 3 | 3 | 2-3 | — | — | 3 | 2-3 | 3 | 3 | 3 |
| | 238 | — | — | 3 | 2-3 | 3 | 3 | 2-3 | — | — | 3 | 2-3 | 3 | 3 | 3 |
| | 239 | — | — | 3 | 2-3 | 3 | 3 | 2-3 | — | — | 3 | 2-3 | 3 | 3 | 3 |
| | 240 | — | — | 3 | 2-3 | 3 | 3 | 2-3 | — | — | 3 | 2-3 | 3 | 3 | 3 |

TABLE 2G

| | | | Intermediate | | | | Clear coating film | | | | | | | |
|---|---|---|---|---|---|---|---|---|---|---|---|---|---|---|
| | | Substrate | coating film Kind of | Brilliant base coating film (1) or (2) | | | Brilliant clear coating film | | Color clear coating film | | Matting clear coating film | | Top clear coating film | |
| Example/ comparison | No. | to be coated | coating material | Paint No. (1) | Paint No. (2) | Baking (° C.) | Paint No. | Baking (° C.) | Paint No. | Baking (° C.) | Paint No. | Baking (° C.) | Paint No. | Baking (° C.) |
| Example | 241 | 1D | — | 17-1 | 17-2 | 120–10 | 5A | W/W | 7A | 140–20 | — | — | — | — |
| | 242 | 1D | — | 18-1 | 18-2 | 120–10 | 5A | W/W | 7A | 140–20 | — | — | — | — |
| | 243 | 1D | — | 19-1 | 19-2 | 120–10 | 5A | W/W | 7A | 140–20 | — | — | — | — |
| | 244 | 1E | 2C | 16-1 | 16-2 | 80–20 | 5D | W/W | 7E | 80–20 | — | — | — | — |
| | 245 | 1E | 2C | 17-1 | 17-2 | 80–20 | 5D | W/W | 7E | 80–20 | — | — | — | — |
| | 246 | 1E | 2C | 18-1 | 19-2 | 80–20 | 5D | W/W | 7E | 80–20 | — | — | — | — |
| | 247 | 1E | 2C | 19-1 | 19-2 | 80–20 | 5D | W/W | 7E | 80–20 | — | — | — | — |
| | 248 | 1A | 2A | 18-1 | 18-2 | 120–10 | 5B | W/W | 7A | 140–20 | — | — | — | — |
| | 249 | 1A | 2A | 18-1 | 18-2 | 120–10 | 5C | W/W | 7A | 140–20 | — | — | — | — |
| | 250 | 1A | 2A | 18-1 | 18-2 | 120–10 | 5A | W/W | 7C | 140–20 | — | — | — | — |
| | 251 | 1A | 2A | 18-1 | 18-2 | 120–10 | 5A | W/W | 7D | 140–20 | — | — | — | — |
| | 252 | 1A | 2A | 18-1 | 18-2 | 120–10 | 5A | W/W | — | — | — | — | 4A | 140–20 |
| | 253 | 1B | 2A | 22-1 | 22-2 | 120–10 | 5A | W/W | 7A | 140–20 | — | — | — | — |
| | 254 | 1B | 2B | 22-1 | 22-2 | 120–10 | 5A | W/W | 7A | 140–20 | — | — | — | — |

TABLE 2G-continued

| | | | | | | | | | | | | | | |
|---|---|---|---|---|---|---|---|---|---|---|---|---|---|---|
| | 255 | 1B | 2A | 23 | — | 120–10 | 5A | W/W | 7A | 140–20 | — | — | — | — |
| | 256 | 1B | 2B | 23 | — | 120–10 | 5A | W/W | 7A | 140–20 | — | — | — | — |

| | | Evaluation | | | | | | | | | | | | | |
|---|---|---|---|---|---|---|---|---|---|---|---|---|---|---|---|
| | | When the brilliant base coating film (1) is used: | | | | | | | When the brilliant base coating film(2) is used: use phosphate group-containing acryl resin. | | | | | | |
| Example/ comparison | No. | Metal feeling (1) | Metal feeling (2) | Metal feeling (3) | Hue uni-formity | Gloss feel-ing | Weath-er-ability | Film perfor-mance | Metal feeling (1) | Metal feeling (2) | Metal feeling (3) | Hue uni-formity | Gloss feel-ing | Weath-er-ability | Film perfor-mance |
| Example | 241 | — | — | 3 | 2-3 | 3 | 3 | 2-3 | — | — | 3 | 2-3 | 3 | 3 | 3 |
| | 242 | — | — | 3 | 2-3 | 3 | 3 | 2-3 | — | — | 3 | 2-3 | 3 | 3 | 3 |
| | 243 | — | — | 3 | 2-3 | 3 | 3 | 2-3 | — | — | 3 | 2-3 | 3 | 3 | 3 |
| | 244 | — | — | 3 | 2-3 | 3 | 2 | 2-3 | — | — | 3 | 2-3 | 3 | 2 | 3 |
| | 245 | — | — | 3 | 2-3 | 3 | 2 | 2-3 | — | — | 3 | 2-3 | 3 | 2 | 3 |
| | 246 | — | — | 3 | 2-3 | 3 | 2 | 2-3 | — | — | 3 | 2-3 | 3 | 2 | 3 |
| | 247 | — | — | 3 | 2-3 | 3 | 2 | 2-3 | — | — | 3 | 2-3 | 3 | 2 | 3 |
| | 248 | — | — | 3 | 2-3 | 3 | 3 | 2-3 | — | — | 3 | 2-3 | 3 | 3 | 3 |
| | 249 | — | — | 3 | 2-3 | 3 | 3 | 2-3 | — | — | 3 | 2-3 | 3 | 3 | 3 |
| | 250 | — | — | 3 | 2-3 | 3 | 3 | 2-3 | — | — | 3 | 2-3 | 3 | 3 | 3 |
| | 251 | — | — | 3 | 2-3 | 3 | 3 | 2-3 | — | — | 3 | 2-3 | 3 | 3 | 3 |
| | 252 | — | — | 3 | 2-3 | 3 | 3 | 2-3 | — | — | 3 | 2-3 | 3 | 3 | 3 |
| | 253 | — | — | 3 | 3 | 3 | 3 | 2-3 | — | — | 3 | 3 | 3 | 3 | 3 |
| | 254 | — | — | 3 | 3 | 3 | 3 | 2-3 | — | — | 3 | 3 | 3 | 3 | 3 |
| | 255 | — | — | 3 | 2-3 | 3 | 2 | 2-3 | — | — | — | — | — | — | — |
| | 256 | — | — | 3 | 2-3 | 3 | 2 | 2-3 | — | — | — | — | — | — | — |

As seen from Tables 2A to 2G, in the embodiments 1 to 256, coating films were formed by a coating film forming method, which uses a glittering base coating material constructed according to the invention. The coating film was excellent in coating performances and weathering resistance, and was capable of developing designs as intended. However, comparisons 1 to 6 could not develop intended designs.

What is claimed is:

1. A method for forming a glittering coating film comprising the steps of:

forming a glittering base coating film on a substrate to be coated by applying thereto a glittering base coating material;

heating or setting said glittering base coating film; and forming a clear coating film on said glittering base coating film;

wherein said glittering base coating material comprises a noble metal or copper particle colloid liquid comprising colloid particle of noble metal or copper, and a vehicle, wherein a concentration of said noble metal or copper to a solid content in said noble metal or copper particle colloid liquid is not less than 83 mass % but less than 99 mass %, and a ratio of solid content of said vehicle to a solid content in said colloid particle liquid is not less than 1/100 but not exceeding 30/100.

2. A method for forming a glittering coating film according to claim 1, wherein said noble or copper colloid particle liquid contains colloid particles of at least two kinds of metals selected from noble metal or copper.

3. A method for forming a glittering coating film according to claim 1, wherein said glittering coating material contains a colloid particle liquid containing metal colloid particles including at least two metals selected from the group consisting of noble metal, copper, nickel, bismuth, indium, cobalt, zinc, tungsten, chromium, iron, molybdenum, tantalum, manganese, tin, and titanium.

4. A method for forming a glittering coating film according to claim 1, wherein said glittering base coating material further contains at least one metal selected from the group consisting of nickel, bismuth, indium, cobalt, zinc, tungsten, chromium, iron, molybdenum, tantalum, manganese, tin, titanium, and aluminum or a metal compound containing the selected metal and at least one further element.

5. A method for forming a glittering coating film according to claim 1, wherein said substrate to be coated is coated with an undercoating film a swelling ratio of which is within a range from more than 0% up to 5%.

6. A method for forming a glittering coating film according to claim 5, wherein a crosslinking density of an undercoating material of said undercoating film is selected to be not less than 1.1×1 0–3 mol/cc but less than not exceeding 1 O×1 0–3 mol/cc, whereby a swelling ratio of said undercoating film is within a range from more than 0% up to 5%.

7. A method for forming a glittering coating film according to claim 1, wherein said vehicle comprises a coating film forming resin selected from the group consisting of at least one of acrylic resin, polyester resin, alkyd resin, fluororesin, epoxy resin, polyurethane resin, and polyether resin.

8. A method for forming a glittering coating film according to claim 7, wherein said vehicle further comprises a cross-linking agent selected from the group consisting of one of an amino resin and a block polyisocyanate compound.

9. A method for forming a glittering coating film according to claim 8, wherein said coating film forming resin is formed by reacting a phosphoric-acid-group-containing monomer.

10. A method for forming a glittering coating film according to claim 1, wherein said glittering base coating material contains a vapor deposition metallic pigment formed by aluminum and/or aluminum-titanium alloy.

11. A method for forming a glittering coating film according to claim 1, wherein said glittering base coating material contain an ultraviolet absorber and/or a light stabilizer.

12. A method for forming a glittering coating film according to claim 1, wherein said substrate to be coated is the following substrate (a) or (b):

(a) a substrate having an undercoating film, which is formed by spraying or electrodepositing a liquid coating material or by spraying a powder coating material;

(b) a substrate having an intermediate coating film, which is formed by spraying a liquid coating material or a powder coating material on an undercoating film which is formed by spraying or electrodepositing a liquid coating material or by spraying a powder coating material.

13. A method for forming a glittering coating film according to claim 1, wherein said substrate to be coated is an aluminum wheel, a car body or plastic automobile parts.

14. The method as recited in claim 1 wherein the step of forming a clear coating film comprises the steps of forming and heating a top clear coating film by applying a clear coating material thereto, and heating the formed top clear coating film.

15. The method as recited in claim 1 wherein the step of forming a clear coating film comprises the steps of forming and heating a glittering clear coating film by applying thereto a glittering clear coating material containing a glittering material, which is different from said noble metal or copper colloid particles.

16. The method as recited in claim 1 wherein the step of forming a clear coating film comprises the steps of forming and heating a gliffering clear coating film by applying thereto a glittering clear coating material containing a glittering material, which is different from said noble metal or copper colloid particles, and then forming and heating a top clear coating film by applying a clear coating material thereto.

17. The method as recited in claim 1 wherein the step of forming a clear coating film comprises the steps of forming and heating a matting top clear coating film by applying thereto a matting clear coating material.

18. The method as recited in claim 1 wherein the step of forming a clear coating film comprises the steps of forming and heating a top color clear coating film by applying thereto a color clear coating material.

19. The method as recited in claim 1 wherein the step of forming a clear coating film comprises the steps of forming and heating a glittering clear coating film by applying thereto a glittering clear coating material containing a glittering material, which is different from said noble metal or copper colloid particles, and then applying a color clear coating material to form a top color clear coating film, and heating the resultant.

* * * * *